US009240635B2

(12) United States Patent
Kawamura et al.

(10) Patent No.: US 9,240,635 B2
(45) Date of Patent: Jan. 19, 2016

(54) CRIMP TERMINAL, CONNECTION STRUCTURAL BODY, CONNECTOR AND PRESSURE-BONDING METHOD OF CRIMP TERMINAL

(71) Applicants: FURUKAWA ELECTRIC CO., LTD., Tokyo (JP); FURUKAWA AUTOMOTIVE SYSTEMS INC., Inukami-gun (JP)

(72) Inventors: Yukihiro Kawamura, Inukami-gun (JP); Yasushi Kihara, Tokyo (JP); Hiroshi Orito, Inukami-gun (JP); Takashi Tonoike, Inukami-gun (JP)

(73) Assignees: Furukawa Electric Co., Ltd., Tokyo (JP); Furukawa Automotive Systems, Inc., Inukami-gun (JP)

( * ) Notice: Subject to any disclaimer, the term of this patent is extended or adjusted under 35 U.S.C. 154(b) by 0 days.

(21) Appl. No.: 14/520,447

(22) Filed: Oct. 22, 2014

(65) Prior Publication Data

US 2015/0126079 A1 May 7, 2015

Related U.S. Application Data

(63) Continuation of application No. PCT/JP2013/069692, filed on Jul. 19, 2013.

(30) Foreign Application Priority Data

Jul. 20, 2012 (JP) ..... 2012-162077
Aug. 31, 2012 (JP) ..... 2012-192380

(51) Int. Cl.
*H01R 4/20* (2006.01)
*H01R 4/18* (2006.01)

(Continued)

(52) U.S. Cl.
CPC ..... *H01R 4/20* (2013.01); *H01R 4/183* (2013.01); *H01R 4/206* (2013.01); *H01R 4/62* (2013.01); *H01R 13/52* (2013.01); *H01R 43/0221* (2013.01); *H01R 43/0482* (2013.01)

(58) Field of Classification Search
CPC ..... H01R 4/206; H01R 4/62; H01R 13/52; H01R 4/20; H01R 43/0482; H01R 4/183; H01R 43/0221
USPC ..... 439/877, 421, 834, 868, 879–882, 442, 439/730, 406; 29/860
See application file for complete search history.

(56) References Cited

U.S. PATENT DOCUMENTS 2,596,528 A 5/1952 Carlson
2,692,422 A 10/1954 Pierce (Continued)

FOREIGN PATENT DOCUMENTS

DE 198 43 886 A1 3/2000
JP 2002-216862 A 8/2002

(Continued)

OTHER PUBLICATIONS

Translation of the International Search Report for PCT/JP2013/069692 dated Oct. 29, 2013.

(Continued)

*Primary Examiner* — Edwin A. Leon
(74) *Attorney, Agent, or Firm* — Oblon, McClelland, Maier & Neustadt, L.L.P.

(57) ABSTRACT

In a female crimp terminal having a pressure-bonding section which allows pressure-bonding and connection of a conductor tip in an insulated wire obtained by coating a conductor with an insulating cover and having the conductor tip in which the conductor is exposed by peeling off the insulating cover in a tip side, the pressure-bonding section is constructed by arranging a conductor pressure-bonding section and a cover pressure-bonding section from a tip side to a base end side in a long length direction in this order, the conductor pressure-bonding section pressure-bonding the conductor tip, and the cover pressure-bonding section pressure-bonding a conductor tip portion in the tip side of the insulating cover, the cover pressure-bonding section is formed into a hollow shape which can surround the conductor tip portion, and the conductor pressure-bonding section is formed to have a smaller diameter than the cover pressure-bonding section, and is formed into a hollow shape which can surround the conductor tip.

10 Claims, 28 Drawing Sheets

(51) Int. Cl.

| | |
|---|---|
| *H01R 4/62* | (2006.01) |
| *H01R 13/52* | (2006.01) |
| *H01R 43/02* | (2006.01) |
| *H01R 43/048* | (2006.01) |

(56) References Cited

U.S. PATENT DOCUMENTS

| | | | | |
|---|---|---|---|---|
| 7,048,551 | B2 * | 5/2006 | Takayama | 439/67 |
| 7,828,611 | B2 * | 11/2010 | Nakamura et al. | 439/877 |
| 7,896,712 | B2 * | 3/2011 | Cecil et al. | 439/730 |
| 9,028,284 | B2 * | 5/2015 | Lengert et al. | 439/877 |
| 2002/0096352 | A1 | 7/2002 | Kuwayama et al. | |
| 2004/0168315 | A1 | 9/2004 | Onuma | |
| 2010/0144189 | A1 | 6/2010 | Watanabe et al. | |

FOREIGN PATENT DOCUMENTS

| | | | |
|---|---|---|---|
| JP | 2004-71437 | A | 3/2004 |
| JP | 2004-200094 | A | 7/2004 |
| JP | 2009-117039 | A | 5/2009 |
| JP | 2009-176547 | A | 8/2009 |
| JP | 2010-140651 | A | 6/2010 |
| JP | 2011-233273 | A | 11/2011 |
| JP | 2011-243329 | A | 12/2011 |
| WO | WO 2011/122622 | A1 | 10/2011 |

OTHER PUBLICATIONS

Office Action issued Dec. 24, 2013 in Japanese Patent Application No. 2013-544902, with English Translation.

Written Opinion issued May 9, 2015, in Korean Patent Application No. 10-2014-7023529, with English Translation.

Office Action issued Apr. 16, 2015 in Chinese Patent Application No. 201380007969.5, with English Translation.

Search Report issued Jul. 19, 2013 in Chinese Patent Application. No. 2013800079695, with English Translation.

Decision to Grant a Patent filed Mar. 18, 2014 in Japanese Patent Application No. 2013-544902, with English Translation.

Decision to Grant a Patent filed Apr. 10, 2015 in Korean Patent Application No. 10-2014-7023529, with English Translation.

* cited by examiner

FIG. 6B ENLARGER VIEW OF PART"a"

FRONT SIDE X REAR SIDE

CRIMP TERMINAL, CONNECTION STRUCTURAL BODY, CONNECTOR AND PRESSURE-BONDING METHOD OF CRIMP TERMINAL

CROSS-REFERENCE TO RELATED APPLICATIONS

This application is a continuation application of PCT International Application No. PCT/JP2013/069692 filed Jul. 19, 2013, which claims priority to Japanese Application No. 2012-162077 filed Jul. 20, 2012 and Japanese Application No. 2012-192380 filed Aug. 31, 2012, each of which are herein incorporated by reference in their entirety for all purposes.

TECHNICAL FIELD

The present invention relates to a crimp terminal configured such as to be installed to a connector of a wire harness, for example, for a motor vehicle, a connection structural body and a connector.

BACKGROUND ART

An electric apparatus equipped in a motor vehicle is connected to the other electric apparatus or an electric power unit via a wire harness obtained by bundling insulated wires so as to construct an electric circuit. At this time, the wire harness is connected to the electric apparatus and the electric power unit by the connectors which are installed respectively.

Various crimp terminals have been proposed as the crimp terminal provided in the connector mentioned above, and a conductor member disclosed in Patent Document 1 is one of the crimp terminals mentioned above.

The conductor member disclosed in the Patent Document 1 is constructed by a wire connection portion which is provided with a connection surface connected to the other member and corresponds to a base material, and a fastening portion which is protruded in relation to the wire connection portion and fastens a tip portion of an electric wire.

The fastening portion has an insertion hole which can insert a tip portion of the electric wire thereto, and is formed into a tubular shape which is open in a tip side of a protruding direction. The connection of the electric wire to the conductive member in the Patent Document 1 can be achieved by inserting the tip portion of the electric wire to the insertion hole of the fastening portion, and caulking the fastening portion in this state.

In the meantime, in the case where the electric wire connected to the crimp terminal is the insulated wire obtained by coating the conductor with an insulating cover, there is generally taken measures to prevent the conductor tip from being exposed to an outer portion from a base end side of a caulking portion after caulking, by caulking by the caulking portion in a state of not only inserting only the conductor tip exposing the conductor by peeling off the insulating cover in the tip side in the insulated wire to the insertion hole of the caulking portion, but also inserting the conductor tip portion which is a portion closer to a rear side than the conductor tip and forms the tip portion of the insulating cover, to the insertion hole together with the conductor tip.

However, in the case where the conductor tip portion is inserted to the caulking portion in "conductor member" disclosed in the Patent Document 1 together with the conductor tip, it is necessary to diameter-reduce the portion corresponding to the conductor tip in a long length direction of the caulking portion with a greater diameter reduction rate according to the caulking, the caulking portion being previously formed with a large diameter for allowing insertion of the conductor tip portion, since the conductor tip has a smaller diameter by a thickness of the insulating cover than the conductor tip portion.

As a result, the caulking portion cannot be closely contacted firmly with the conductor tip after being caulked, an air gap tends to be generated in an inner portion of the caulking portion, and there has been a problem that stable conductivity cannot be obtained between the conductor of the electric wire and the pressure-bonding section of the crimp terminal.

PRIOR ART DOCUMENTS

Patent Documents

Patent Document 1: Japanese Patent Laid-Open Publication No. 2011-233273

SUMMARY OF THE INVENTION

Problems to be Solved by the Invention

An object of the present invention is to provide a crimp terminal, a connection structural body and a connector which can closely contact firmly a conductor of an electric wire and a pressure-bonding section of a crimp terminal in a state in which the electric wire is pressure-bonded to the crimp terminal, and which can obtain stable conductivity.

Solutions to the Problems

The present invention provides a crimp terminal having a pressure-bonding section which allows pressure-bonding and connection of at least a conductor tip in an insulated wire obtained by coating a conductor with an insulating cover and having the conductor tip in which the conductor is exposed by peeling off the insulating cover in a tip side, wherein the pressure-bonding section is constructed by arranging a conductor pressure-bonding section, a diameter reduction portion and a cover pressure-bonding section from a tip side to a base end side in a long length direction in this order, the conductor pressure-bonding section pressure-bonding the conductor tip, and the cover pressure-bonding section pressure-bonding a conductor tip portion in the tip side of the insulating cover, the cover pressure-bonding section is formed into a hollow shape which can surround the conductor tip portion, the conductor pressure-bonding section is formed to have a smaller diameter than the cover pressure-bonding section, and is formed into a hollow shape which can surround the conductor tip, and the pressure-bonding section is formed into a tubular shape by rounding a barrel piece in which the conductor pressure-bonding section and the cover pressure-bonding section are integrally formed via the diameter reduction portion and welding confronting end portions obtained by confronting both end portions in a width direction of the barrel piece, and is formed so that a barrel width is wider in the cover pressure-bonding section than in the conductor pressure-bonding section.

According to the structure mentioned above, it is possible to provide a crimp terminal, a connection structural body and a connector which can closely contact firmly the conductor of the electric wire with the pressure-bonding section of the crimp terminal in a state in which the electric wire is pressure-bonded to the crimp terminal, and which can obtain the stable conductivity.

This will be described in more detail. In the crimp terminal according to the present invention, since the pressure-bonding section is constructed by the cover pressure-bonding section, and the conductor pressure-bonding section which is formed to have the smaller diameter than the cover pressure-bonding section, the conductor tip can be appropriately arranged in the conductor pressure-bonding section by inserting the tip side of the insulated wire to the pressure-bonding section, and the conductor tip portion can be appropriately arranged in the cover pressure-bonding section.

As a result, the conductor tip neither twist nor incline in an inner portion of the pressure-bonding section, and any air gap is left closer to the tip side than the conductor tip in the inner portion of the pressure-bonding section due to short of insertion.

Further, in the crimp terminal according to the present invention, since the conductor pressure-bonding section is formed to have the small diameter so as to correspond to the diameter of the conductor tip rather than the cover pressure-bonding section, it is possible to suppress deformation of the conductor pressure-bonding section due to the pressure-bonding, at the pressure-bonding time of the pressure-bonding section and the tip side of the insulated wire.

Accordingly, it is possible to closely contact firmly the conductor of the electric wire and the pressure-bonding section of the crimp terminal in a state in which the electric wire is pressure-bonded to the crimp terminal, and it is possible to obtain the stable conductivity.

According to an aspect of the present invention, a sealing portion sealing the tip side can be formed in the tip side in the long length direction of the pressure-bonding section, and the pressure-bonding section can be formed into a continuous shape which is continuous in a whole of a peripheral direction from the cover pressure-bonding section toward the sealing portion.

As mentioned above, it is possible to prevent moisture from entering into the inner portion of the pressure-bonding section from the tip side, by forming the sealing portion in the tip side in the long length direction of the pressure-bonding section.

Further, it is possible to prevent the moisture from entering into the inner portion of the pressure-bonding section through the other portion than the tip side of the pressure-bonding section by forming into the continuous shape which is continuous in the whole of the peripheral direction from the cover pressure-bonding section toward the sealing portion.

In addition, any air gap is not generated in the inner portion of the pressure-bonding section in the state in which the pressure-bonding section is pressure-bonded by forming the conductor pressure-bonding section to have the smaller diameter than the cover pressure-bonding section, and it is possible to prevent the pressure-bonding section from greatly deforming and breaking due to the pressure-bonding. As a result, it is possible to prevent the moisture from entering into the inner portion of the pressure-bonding section and prevent the entering moisture from staying in the inner portion of the pressure-bonding section.

According to the above, it is possible to obtain an excellent water-blocking performance in the inner portion of the pressure-bonding section in a state in which the pressure-bonding section is pressure-bonded.

Further, according to an aspect of the present invention, a first diameter reduction portion can be formed in a boundary portion between the cover pressure-bonding section and the conductor pressure-bonding section, a diameter of the first diameter reduction portion being smaller little by little from the cover pressure-bonding section toward the conductor pressure-bonding section.

According to the structure mentioned above, the first diameter reduction portion can be arranged so as to face to the conductor tip portion and the conductor tip which are arranged along the long length direction, in comparison with the case that the boundary portion between the cover pressure-bonding section and the conductor pressure-bonding section is formed along an orthogonal direction which is orthogonal to the long length direction and a width direction. As a result, in the case where the pressure-bonding section including the first diameter reduction portion is pressure-bonded, the first diameter reduction portion can be pressure-bonded in a state in which the first diameter reduction portion is closely contacted firmly with the boundary portion between the conductor tip portion and the conductor tip.

Further, according to the structure mentioned above, the first diameter reduction portion is formed in the boundary portion between the cover pressure-bonding section and the conductor pressure-bonding section, the diameter of the first diameter reduction portion being smaller little by little from the cover pressure-bonding section toward the conductor pressure-bonding section. As a result, it is possible to align the boundary portion between the cover pressure-bonding section and the conductor pressure-bonding section with the boundary portion between the conductor tip portion and the conductor tip in the electric wire tip portion, in the state in which the electric wire tip portion is inserted to the pressure-bonding section, in the long length direction.

Further, a base end portion of the conductor tip is arranged in the boundary portion between the conductor tip portion and the conductor tip, the conductor tip diameter reducing little by little toward the tip side, for example, just after being derived from the insulating cover to the outer side.

As a result, it is possible to form in correspondence to the shape of the base end portion of the conductor tip by forming the first diameter reduction portion in the boundary portion between the cover pressure-bonding section and the conductor pressure-bonding section.

Therefore, the pressure-bonding section can be closely contacted with the tip side of the insulated wire including the boundary portion between the cover pressure-bonding section and the conductor pressure bonding section, at the pressure-bonding time between the pressure-bonding section and the tip side of the insulated wire, and it is particularly possible to prevent an internal air gap from being generated in the boundary portion between the cover pressure-bonding section and the conductor pressure-bonding section.

Further, according to an aspect of the present invention, a second diameter reduction portion can be formed in a boundary portion between the conductor pressure-bonding section and the sealing portion, a diameter of the second diameter reduction portion being smaller little by little from the conductor pressure-bonding section toward the sealing portion.

According to the structure mentioned above, the second diameter reduction portion can be arranged so as to face, for example, to a conductor tip arranged along the long length direction, or a bottom surface of the pressure-bonding portion, in comparison with the case that the boundary portion between the conductor pressure-bonding section and the sealing portion is formed along an orthogonal direction which is orthogonal to the long length direction and the width direction. As a result, it is possible to pressure-bond the second diameter reduction portion, for example, in a state in which the second diameter reduction portion is closely contacted firmly with the conductor tip arranged along the long length direction or the bottom surface of the pressure-bonding section, at the pressure-bonding time of the pressure-bonding section including the second diameter reduction portion.

Further, according to the structure mentioned above, the second diameter reduction portion is formed in the boundary portion between the conductor pressure-bonding section and the sealing portion, the diameter of the second diameter reduction portion being smaller little by little from the conductor pressure-bonding section toward the sealing portion. As a result, it is possible to enter a tip portion of the conductor tip, for example, a tip portion of at least partial raw wires of a plurality of raw wires constructing the conductor tip, into the second diameter reduction portion.

Therefore, it is possible to closely contact with the conductor tip even in the boundary portion between the conductor pressure-bonding section and the sealing portion at the pressure-bonding time between the pressure-bonding section and the tip side of the insulated wire, and it is particularly possible to prevent the internal air gap from being generated in the boundary portion between the conductor pressure-bonding section and the sealing portion.

Further, according to an aspect of the present invention, the pressure-bonding section constructed by the cover pressure-bonding section and the conductor pressure-bonding section can be constructed by a stepped pressure-bonding section which is diameter-reduced step by step in its whole periphery.

According to the present invention, it is possible to make pressure-bonding amounts at the pressure-bonding time of the conductor tip approximately equal even in the conductor tips having a plurality of diameters, and it is possible to prevent a pressure-bonding deformation amount from being enlarged too much, and prevent the pressure-bonding section from being damaged due to a deformation load at the pressure-bonding time. Further, since the pressure-bonding section is pressure-bonded from all the peripheral direction at the pressure-bonding time, it is possible to reduce the load caused by the pressure-bonding deformation acting on the pressure-bonding section.

Further, since all the periphery is diameter-reduced step by step, it is possible to easily insert the electric wire tip portion to a predetermined insertion position while guiding the conductor tip.

Further, deviation of a processing strain is reduced at the processing and manufacturing time of the crimp terminal in comparison with the stepped pressure-bonding section in a state in which a bottom surface is flat, and it is possible to manufacture the durable crimp terminal. Further, in the case of fixing a length in the long length direction of a step portion which is inclined between the stage portions in the stepped pressure-bonding section, an angle of incline of the step portion can be formed gently in comparison with the stepped pressure-bonding section in which the bottom surface is flat. Therefore, it is possible to reduce the processing load. On the contrary, in the case where the step portion is formed at a fixed angle of incline, it is possible to form the step portion such that the length in the long length direction X of the step portion is short.

Further, according to an aspect of the present invention, the pressure-bonding section can be formed by a terminal base material which is formed by an expanded shape expanding the pressure-bonding section, and is formed into a hollow cross sectional shape obtained by rounding the terminal base material so as to set a long length direction to a center axis, a diameter reduction portion can be formed at least partially except a bottom surface portion in a peripheral direction, the diameter reduction portion diameter-reducing from a base end side toward a tip side in a boundary portion of each of the sealing portion, the conductor tip, and the conductor tip portion, and a weld portion can be formed in a bottom surface portion of the pressure-bonding section along a long length direction, the weld portion welding a pair of facing end portions facing to each other in the terminal base material.

According to the structure mentioned above, since the diameter reduction portion provided in the boundary portion in each of the sealing portion, the conductor tip and the conductor tip portion is formed at least partially except at least the bottom surface portion in the peripheral direction, the bottom surface portion can be formed into a flat shape which is not fluctuated along the long length direction.

Therefore, in the case where a pair of facing end portions are welded to each other while a laser irradiation apparatus is caused to slide along the long length direction in the bottom surface portion of the pressure-bonding section, a laser irradiation distance irradiating to a pair of facing end portions fluctuates according to fluctuation of the diameter in the boundary portion to each of the cover pressure-bonding section, the conductor pressure-bonding section and the sealing portion, so that it is possible to securely form the weld portion without deviating focus of the laser.

Further, in the case where a pair of facing end portions are welded to each other while the laser irradiation apparatus is caused to slide along the long length direction in the bottom surface portion of the pressure-bonding section, it is not necessary to actuate a laser irradiator point by point in a direction of moving close to and away from the pressure-bonding section, for focusing the laser, and it is possible to smoothly form the weld portion.

Further, according to an aspect of the present invention, the conductor portion can be constructed by an aluminum material, and at least the pressure-bonding section can be formed by a copper material.

According to the invention, it is possible to save weight in comparison with the insulated wire having the conductor portion constructed by the copper wire, and it is possible to prevent a so-called dissimilar metal corrosion (hereinafter, refer to as galvanic corrosion) on the basis of the secure water-blocking performance mentioned above.

This will be described in more detail. In the case where the copper material which has been conventionally used in the conductor portion of the insulated wire is replaced by the aluminum material such as the aluminum or the aluminum alloy, and the conductor portion made of the aluminum material is pressure-bonded to the crimp terminal, phenomenon that the aluminum material corresponding to a less noble material is corroded, that is, galvanic corrosion becomes a problem due to contact of the terminal material with a nobler metal material such as a tin plating, a gold plating and a copper alloy.

The galvanic corrosion is a phenomenon that corrosion electric current is generated and the less noble metal corrodes, dissolves and disappears due to attachment of moisture to a position where the nobler metal material and the less noble metal are in contact. Due to the phenomenon, the conductor portion which is pressure-bonded to the pressure-bonding section of the crimp terminal and made of the aluminum material corrodes, dissolves and disappears and the electric resistance finally rises. As a result, there is a problem that a conductive function cannot be sufficiently achieved.

However, on the basis of the secure water-blocking performance mentioned above, it is possible to prevent the so-called galvanic corrosion while the weight saving is achieved in comparison with the insulated wire having the conductor portion made of the copper material.

The present invention is characterized by a connection structural body which connects the insulated wire and the crimp terminal by the pressure-bonding section in the crimp terminal described in any one mentioned above.

According to the present invention, it is possible to construct the connection structural body which can secure the complete water-blocking performance only by surrounding and pressure-bonding by means of the pressure-bonding section of the crimp terminal. Therefore, it is possible to secure stable conductivity.

Further, the present invention is characterized by a wire hardness which is constructed by bundling a plurality of the connection structural bodies.

According to the present invention, it is possible to construct the wire hardness which secures the stable conductivity regardless of the metal kind constructing the crimp terminal and the wire conductor.

Further, the present invention is characterized by a connector in which the crimp terminal in the connection structural body is arranged within a connector housing.

According to the present invention, it is possible to connect the crimp terminal while the stable conductivity is secured regardless of the metal kind constructing the crimp terminal and the conductor portion.

This will be described in more detail. For example, in the case where a female type connector and a male type connector are fitted to each other, and the crimp terminals arranged within the connector housings of the respective connectors are connected to each other, it is possible to connect the crimp terminals of the respective connectors while the water-blocking performance is secured.

As a result, it is possible to secure a connection state which is provided with the secure conductivity.

The present invention provides a crimp terminal including a barrel portion integrally constructed by a cover pressure-bonding section which compresses the vicinity of a tip of an insulative insulating cover body in an insulated wire obtained by coating an outer periphery of a wire conductor with the insulating cover body with a predetermined compression force so as to pressure-bond, and a conductor pressure-bonding section which pressure-bonds the wire conductor exposed at a predetermined length in a long length direction of the insulated wire from the tip of the insulating cover body, wherein the cover pressure-bonding section is formed into a closed cross sectional shape which surrounds the insulating cover body in a cross sectional shape in a short length direction of the insulated wire, and is formed so as to be extended in the long length direction, the conductor pressure-bonding section is formed by extending one end of the cover pressure-bonding section in the long length direction, and is formed into a closed cross sectional shape which surrounds the wire conductor in a cross sectional shape in the short length direction, and the barrel portion is provided with a weak pressure-bonding section which is integrally formed by extending the other end side of the cover pressure-bonding section in the long length direction, and compresses the insulating cover body at a predetermined pressure-bonding length with a smaller compression force than the predetermined compression force so as to pressure-bond, in a pressure-bonding state.

The predetermined compression force can be set to a compression force with which the cover pressure-bonding section caulked to a desired height compresses the insulating cover body, a compression force which establishes both a retaining performance of the insulated wire and a water-blocking performance by the cover pressure-bonding section, or a compression force which is greater than the force demanded for retaining the insulated wire, for improving the water-blocking performance by the cover pressure-bonding section.

The barrel portion can be constructed by a closed barrel type having an internal hollow shape.

The closed cross sectional shape can be formed into a closed cross sectional shape which is integrally formed by welding end portions, or a closed cross sectional shape which is integrally formed by welding overlapped end portions.

The predetermined pressure-bonding length can be set to a length which can secure the water-blocking performance against intrusion of the moisture from the insulated wire side to the inner portion of the barrel portion.

According to the present invention, it is possible to secure the stable water-blocking performance.

This will be described in more detail. The electric apparatus equipped in the motor vehicle constructs the electric circuit by being connected to the other electric apparatus and the electric power unit via the wire harness obtained by bundling the insulated wires. At this time, the wire harness is connected to the electric apparatus and the electric power unit by the connectors which are respectively installed.

The connectors are structured such that the crimp terminals pressure-bonded and connected to the insulated wires are installed in the inner portions, and the female type connectors and the male type connectors connected in correspondence to the concave and convex types are fitted.

In the meantime, since the connectors mentioned above are used under various environments, the unexpected moisture may be attached to the surface of the insulated wire due to dew condensation caused by change of atmospheric temperature. Further, if the moisture enters into the inner portion of the connector through the surface of the insulated wire, there is a problem that the surface of the wire conductor exposed out of the tip of the insulated wire corrodes.

Accordingly, there has been proposed various technologies which prevent the moisture from entering into the wire conductor which is pressure-bonded by the crimp terminal.

For example, a crimp terminal described in Patent Document 1 is a crimp terminal including a conductor pressure-bonding section which pressure-bonds a conductor of an electric wire, and a wire connection portion which is constructed by a cover caulking portion pressure-bonding an insulating cover of the electric wire, wherein serrations are provided in the cover caulking portion in a direction which intersects a long length direction of the electric wire, and a boundary between the cover caulking portion and the insulating cover is formed into a concavo-convex shape. As a result, the crimp terminal of the Patent Document 1 complicates a moisture entering route and prevents the moisture from entering from the insulating cover side.

However, in the crimp terminal such as the Patent Document 1, in the case where the cover caulking portion is firmly caulked for further securing the water-blocking performance by the serrations, there is a risk that a rear end of the cover caulking portion damages or shears the insulating cover due to dispersion of a collapsing margin in the cover caulking portion, and the conductor is exposed. As a result, the crimp terminal of the Patent Document 1 has a risk that the crimp terminal cannot secure the stable water-blocking performance against the moisture intrusion from the insulating cover side.

However, specifically, since the weak pressure-bonding section compresses the insulating cover body with the smaller compression force than the predetermined compression force in the case where the insulated wire is pressure-bonded by caulking the barrel portion, it is possible to make the compression amount of the insulating cover body by the weak pressure-bonding section smaller than the compression amount of the insulating cover body by the cover pressure-bonding section.

Further, it is possible to enlarge the compression amount of the insulating cover body by the weak pressure-bonding section according to increase of the load caulking the barrel portion. Namely, the crimp terminal can retain the insulated wire in the weak pressure-bonding section in addition to the cover pressure-bonding section. In other words, the crimp terminal can prevent the moisture from entering into the inner portion of the barrel portion from the insulated wire side by the cover pressure-bonding section and the weak pressure-bonding section.

Further, for example, in the case where the cover pressure-bonding section is caulked until the insulating cover body is damaged, the crimp terminal can compress and retain the insulating cover body by the weak pressure-bonding section. As a result, the crimp terminal can prevent the moisture from entering into the inner portion of the barrel portion from the insulated wire side by the weak pressure-bonding section which is formed in the insulated wire side of the cover pressure-bonding section.

More specifically, in comparison with the case that the moisture intrusion from the insulated wire side to the inner portion of the barrel portion is prevented only by the cover pressure-bonding section, the crimp terminal can enlarge the collapsing amount of the barrel portion until the water-blocking performance is damaged, since the weak pressure-bonding section is integrally formed.

As a result, the crimp terminal can prevent the insulating cover body from being damaged due to the dispersion of the collapsing amount of the cover pressure-bonding section at the caulking time of the barrel portion, and can prevent the matter that the water-blocking performance cannot be secured against the moisture intrusion from the insulated wire side to the inner portion of the barrel portion, on the basis of the weak pressure-bonding section.

In addition, the crimp terminal can securely prevent the moisture from entering into the inner portion from both ends in the long length direction of the barrel portion, for example, by sealing the wire conductor side end portions in the barrel portion by the other member or sealing by caulking.

Therefore, the crimp terminal can secure the stable water-blocking performance against the dispersion of the collapsing amount of the barrel portion, since the weak pressure-bonding section is provided.

According to an aspect of the present invention, the weak pressure-bonding section can be formed thinner than a thickness of the cover pressure-bonding section.

According to the invention, it is possible to differentiate the compression amount of the insulating cover body by the cover pressure-bonding section from the compression amount of the insulating cover body by the weak pressure-bonding section, even if the barrel portion is caulked with a uniform force. Namely, the crimp terminal can save the trouble of caulking the cover pressure-bonding section and the weak pressure-bonding section with different forces.

As a result, the crimp terminal can pressure-bond the insulated wire by caulking the weak pressure-bonding section without increase of an assembling man hour, at the caulking time of the barrel portion. Further, it is possible to use the existing crimp device, crimp tool or crimp jig.

Therefore, the crimp terminal can suppress increase of the assembling man hour at the caulking time of the barrel portion, by making the thickness of the weak pressure-bonding section thinner than the thickness of the cover pressure-bonding section.

Further, according to an aspect of the present invention, an inner surface shape of the weak pressure-bonding section can be formed so that a distance between inner surfaces facing to each other in the short length direction is fixed, in a cross section in the long length direction.

According to the invention, the weak pressure-bonding section can compress the insulating cover body in a range of a predetermined pressure-bonding length with a uniform compression force. Namely, the weak pressure-bonding section can compress the insulating cover body in the range of the predetermined pressure-bonding length with the uniform compression amount. As a result, the weak pressure-bonding section can secure the more stable water-blocking performance.

As a result, even if the insulating cover body is damaged by the cover pressure-bonding section, the crimp terminal can make arriving of the moisture at the damaged position of the insulating cover body from the insulated wire side harder, on the basis of the weak pressure-bonding section.

Therefore, the crimp terminal can secure the stable conductivity by securing the more stable water-blocking performance.

Further, according to an aspect of the present invention, an inner surface shape in the weak pressure-bonding section can be formed into an approximately tapered shape which has a smaller diameter side in the cover pressure-bonding section and is continuous with the inner surface of the cover pressure-bonding section, in a cross section in the long length direction.

The approximately tapered shape may be formed by thinning the thickness of the weak pressure-bonding section little by little along the long length direction, or may be formed by forming inner and outer surface shapes into an approximately tapered shape with the thickness thereof kept uniform.

According to the invention, it is possible to further stabilize the compression force with which the weak pressure-bonding section compresses the insulating cover body. For example, in the case of the barrel portion having an approximately cylindrical weak pressure-bonding section in which an inner diameter is larger than an inner diameter in an approximately cylindrical cover pressure-bonding section, difference of inner diameter between the cover pressure-bonding section and the weak pressure-bonding section comes to difference between the compression amount of the insulating cover body by the cover pressure-bonding section and the compression amount of the insulating cover body by the weak pressure-bonding section.

As a result, in the case where the collapsing amount of the barrel portion is close to the minimum value, there is a risk that the compression amount of the insulating cover body by the weak pressure-bonding section cannot be sufficiently secured. More specifically, the weak pressure-bonding section has a risk that the weak pressure-bonding section cannot compress the insulating cover body with the stable compression force.

On the other hand, in the case where the collapsing amount of the barrel portion is close to the maximum value, the crimp terminal has a risk that the crimp terminal easily shears the insulating cover body due to a step caused by an inner diameter difference between the cover pressure-bonding section and the weak pressure-bonding section.

The crimp terminal can gently enlarge the compression force with which the weak pressure-bonding section compresses the insulating cover body along the long length direction from the insulated wire side, by forming the inner surface shape of the weak pressure-bonding section into the approximately tapered shape. As a result, the crimp terminal can compress the insulating cover body with the compression force which is equal to or more than the compression force capable of securing the stable water-blocking performance, at any position in the long length direction in the approximately tapered inner surface shape of the weak pressure-bonding section, against the dispersion of the collapsing amount of the barrel portion.

Further, the crimp terminal can prevent the weak pressure-bonding section from easily shearing the insulating cover body, by dissolving the step caused by the inner diameter difference on the basis of the approximately tapered inner surface shape.

Therefore, the crimp terminal can stably secure the water-blocking performance against the moisture intrusion from the insulated wire side in the barrel portion, by forming the inner surface shape of the weak pressure-bonding section into the approximately tapered shape.

Further, according to an aspect of the present invention, an inner surface shape in the weak pressure-bonding section can be formed into an approximately stepped shape in which a distance between facing inner surfaces in the short length direction is enlarged step by step from the cover pressure-bonding section side toward the insulated wire side in the long length direction, in a cross section in the long length direction.

According to the invention, since the boundary between the weak pressure-bonding section and the insulating cover body is formed into the approximately stepped shape, it is possible to complicate the moisture intrusion route from the insulated wire side to the inner portion of the barrel portion and elongate the distance of the intrusion route.

As a result, even if the moisture enters into the inner portion of the barrel portion from the insulated wire side, the crimp terminal can make the arriving of the entering moisture at the wire conductor harder.

Therefore, the crimp terminal can more completely secure the water-blocking performance against the moisture intrusion from the insulated wire side in the weak pressure-bonding section.

Further, according to an aspect of the present invention, the barrel portion constructed by the cover pressure-bonding section and the conductor pressure-bonding section can be constructed by a stepped pressure-bonding section in which its whole periphery is diameter-reduced step by step.

According to the invention, it is possible to make the pressure-bonding amount at the pressure-bonding time of the wire conductor approximately identical, even in the wire conductors having a plurality of diameters, and it is possible to prevent the pressure-bonding deformation amount from being too great, and it is possible to prevent the barrel portion from being damaged by the deformation load at the pressure-bonding time. Further, since the pressure-bonding is applied from a whole peripheral direction at the pressure-bonding time, it is possible to reduce the load due to the pressure-bonding deformation acting on the barrel portion.

Further, since the whole periphery is diameter-reduced step by step, the wire tip portion can be easily inserted to a predetermined insertion position while the wire conductor is guided.

Further, the deviation of the processing strain at the processing and manufacturing time of the crimp terminal becomes less, for example, in comparison with the stepped pressure-bonding section in a state in which the bottom surface is flat, and it is possible to manufacture a durable crimp terminal. Further, in the case where the length in the long length direction is fixed in the step portion which is inclined between the step portions in the stepped pressure-bonding section, an angle of incline of the step portion can be formed gently in comparison with the stepped pressure-bonding section in which the bottom surface is flat. Accordingly, it is possible to reduce the processing load. On the contrary, in the case where the step portion is formed with a fixed angle of incline, it is possible to form the step portion such that a length in a long length direction X of the step portion is short.

Further, according to an aspect of the present invention, the barrel portion can be provided with a sealing portion which is obtained by extending the conductor pressure-bonding section in the long length direction and seals a tip in the long length direction.

According to the invention, the crimp terminal can prevent the moisture intrusion from an opening in the wire conductor side in the barrel portion. Further, the crimp terminal can set the inner portion of the barrel portion in the pressure-bonding state to a sealed state, by the sealing portion, the cover pressure-bonding section and the weak pressure-bonding section. As a result, the crimp terminal can more securely prevent the moisture intrusion into the inner portion of the barrel portion.

Therefore, the crimp terminal can secure the complete water-blocking performance and secure the more stable conductivity by setting the inner portion of the barrel portion in the pressure-bonding state to the sealed state.

Further, the present invention is characterized by a connection structure body which connects the insulated wire and the crimp terminal by the barrel portion in the crimp terminal.

According to the invention, it is possible to construct the connection structural body which can secure the complete water-blocking performance only by pressure-bonding by means of the barrel portion of the crimp terminal. Therefore, it is possible to secure the stable conductivity.

Further, according to an aspect of the present invention, the wire conductor can be constructed by the aluminum material and at least the barrel portion can be constructed by the copper material.

According to the invention, it is possible to save weight in comparison with the insulated wire having the wire conductor constructed by the copper wire, and it is possible to prevent the so-called dissimilar metal corrosion (hereinafter, refer to as galvanic corrosion) by the secure water-blocking performance mentioned above.

This will be described in more detail. In the case where the copper material which has been conventionally used in the wire conductor of the insulated wire is replaced by the aluminum material such as the aluminum or the aluminum alloy, and the wire conductor made of the aluminum material is pressure-bonded to the crimp terminal, the phenomenon that the aluminum material corresponding to the less noble material is corroded, that is, the galvanic corrosion becomes a problem due to the contact of the terminal material with the nobler metal material such as the tin plating, the gold plating and the copper alloy.

The galvanic corrosion is the phenomenon that the corrosion electric current is generated and the less noble metal corrodes, dissolves and disappears due to the attachment of moisture to the position where the nobler metal material and the less noble metal are in contact. Due to the phenomenon, the conductor portion which is pressure-bonded to the pressure-bonding section of the crimp terminal and made of the aluminum material corrodes, dissolves and disappears and the electric resistance finally rises. As a result, there has been the problem that the conductive function cannot be sufficiently achieved.

However, on the basis of the secure water-blocking performance mentioned above, it is possible to prevent the so-called galvanic corrosion while the weight saving is achieved in comparison with the insulated wire having the conductor portion made of the copper material.

Further, the present invention is characterized by a wire hardness which is constructed by bundling a plurality of the connection structural bodies.

According to the present invention, it is possible to construct the wire hardness which secures the stable conductivity regardless of the metal kind constructing the crimp terminal and the wire conductor.

Further, the present invention is characterized by a connector in which the crimp terminal in the connection structural body is arranged within a connector housing.

According to the present invention, it is possible to connect the crimp terminal while the stable conductivity is secured regardless of the metal kind constructing the crimp terminal and the conductor portion.

This will be described in more detail. For example, in the case where a female type connector and a male type connector are fitted to each other, and the crimp terminals arranged within the connector housings of the respective connectors are connected to each other, it is possible to connect the crimp terminals of the respective connectors while the water-blocking performance is secured.

As a result, the connector can secure a connection state which is provided with the secure conductivity.

The present invention provides a pressure-bonding method of a crimp terminal including a barrel portion integrally constructed by a cover pressure-bonding section which compresses the vicinity of a tip of an insulative insulating cover body in an insulated wire obtained by coating an outer periphery of a wire conductor with the insulating cover body with a predetermined compression force so as to pressure-bond, and a conductor pressure-bonding section which pressure-bonds the wire conductor exposed at a predetermined length in a long length direction of the insulated wire from the tip of the insulating cover body, wherein the cover pressure-bonding section is formed into a closed cross sectional shape which surrounds the insulating cover body in a cross sectional shape in a short length direction of the insulated wire, and is formed so as to be extended in the long length direction, the conductor pressure-bonding section is formed by extending one end of the cover pressure-bonding section in the long length direction, and is formed into a closed cross sectional shape which surrounds the wire conductor in a cross sectional shape in the short length direction, the barrel portion is constructed by the cover pressure-bonding section and the conductor pressure-bonding section, and a weak pressure-bonding section is formed in the other end side of the cover pressure-bonding section, the weak pressure-bonding section compressing the insulating cover body at a predetermined pressure-bonding length with a smaller compression force than the predetermined compression force so as to pressure-bond, in a pressure-bonding state, at the pressure-bonding time of the barrel portion.

According to the invention, it is possible to more securely form the weak pressure-bonding section while the deformation of the cover pressure-bonding section is followed at the pressure-bonding time. As a result, the pressure-bonding method of the crimp terminal can inhibit the weak pressure-bonding section from deforming into an irregular shape at the pressure-bonding time, in comparison with the case that the weak pressure-bonding section is formed previously in the barrel portion, and it is possible to uniformly compress the insulating cover body.

Further, since the weak pressure-bonding section can be formed at the same time of the process of pressure-bonding by caulking the barrel portion to the insulating cover body, the pressure-bonding method of the crimp terminal can make any special process for forming the weak pressure-bonding section unnecessary.

Therefore, the pressure-bonding method of the crimp terminal can efficiently form the weak pressure-bonding section, and can secure the more complete water-blocking performance.

Effects of the Invention

According to the present invention, it is possible to provide the crimp terminal, the connection structural body and the connector which can obtain an excellent water-blocking performance without any interposition of moisture between the pressure-bonding section and the conductor, while the moisture is prevented from entering into the inner portion of the pressure-bonding section.

BRIEF DESCRIPTION OF THE DRAWINGS

FIGS. 6A and 6B are explanatory views explaining welding in the pressure-bonding section;

EMBODIMENTS OF THE INVENTION

Embodiment 1

A description will be in detail given below of one embodiment according to the present invention with reference to the accompanying drawings.

Figure 1A:
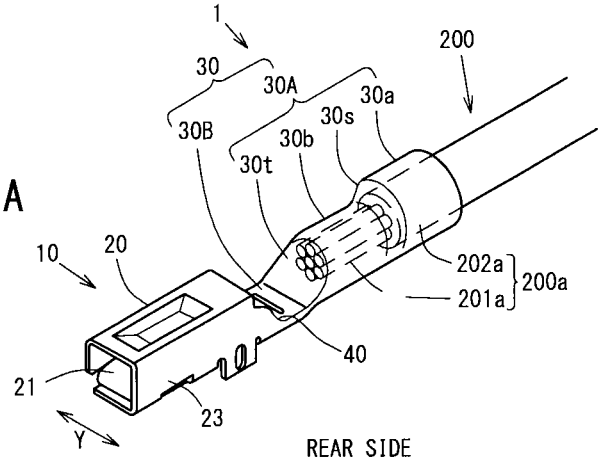
FIGS. 1A and 1B are explanatory views of an electric wire with a female crimp terminal according to the present embodiment.
Figure 1B:
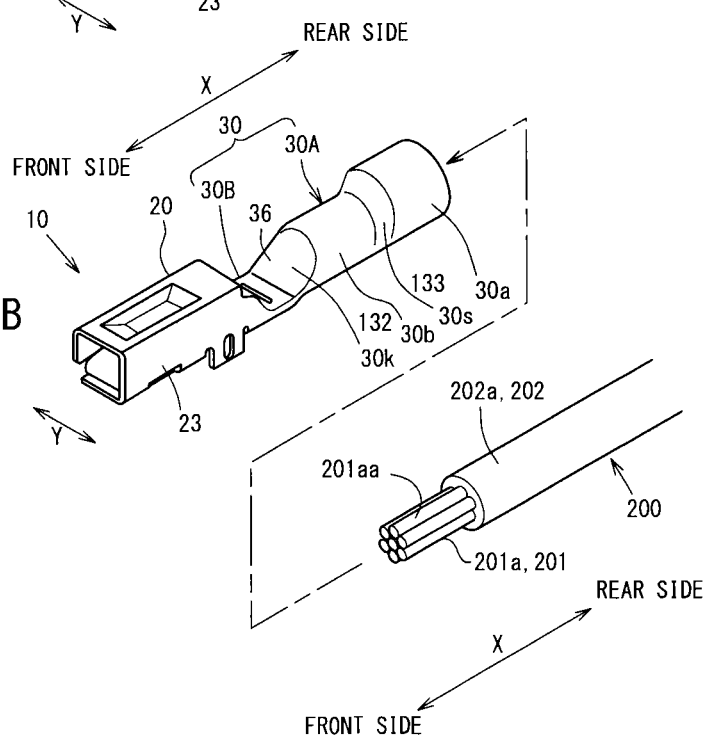

FIG. 1A is a perspective view of a wire tip portion 200*a* of an electric wire 1 with a female crimp terminal according to the present embodiment, and a rear portion of the wire tip portion, and FIG. 1B is a perspective view of a female crimp terminal 10 and the wire tip portion 200*a* according to the present embodiment, and shows a state just before the wire tip portion 200*a* is inserted to the female crimp terminal 10.

Figure 2:
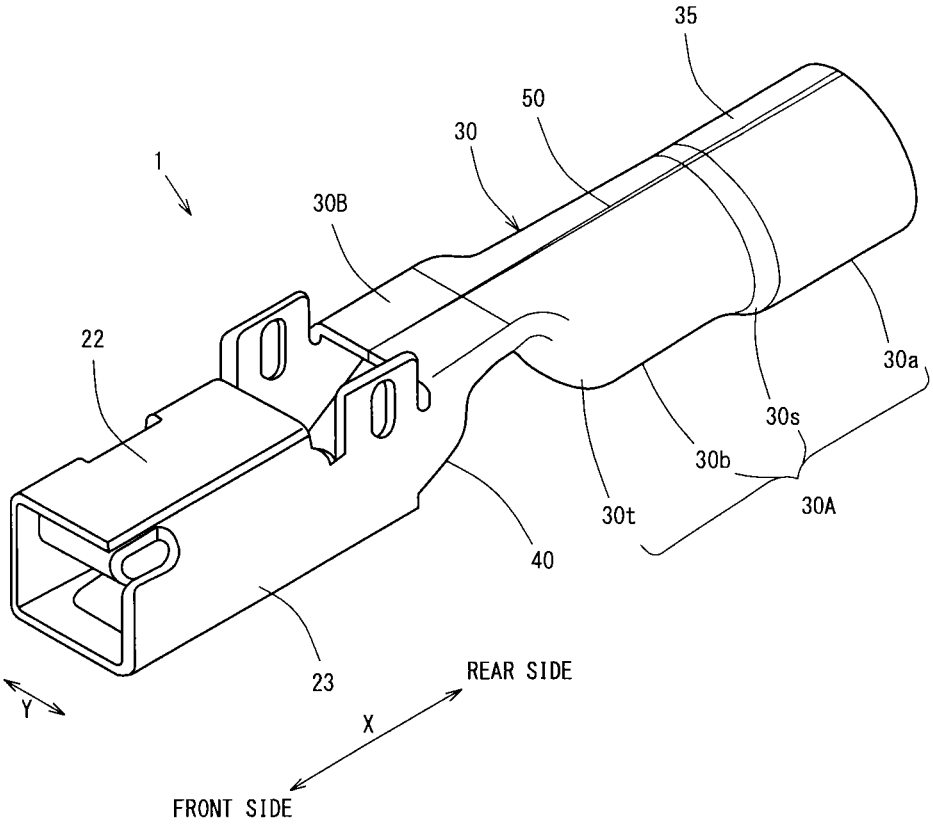
FIG. 2 is an explanatory view of a structure of the female crimp terminal according to the present embodiment as seen from a diagonally downward side.
Figure 3:
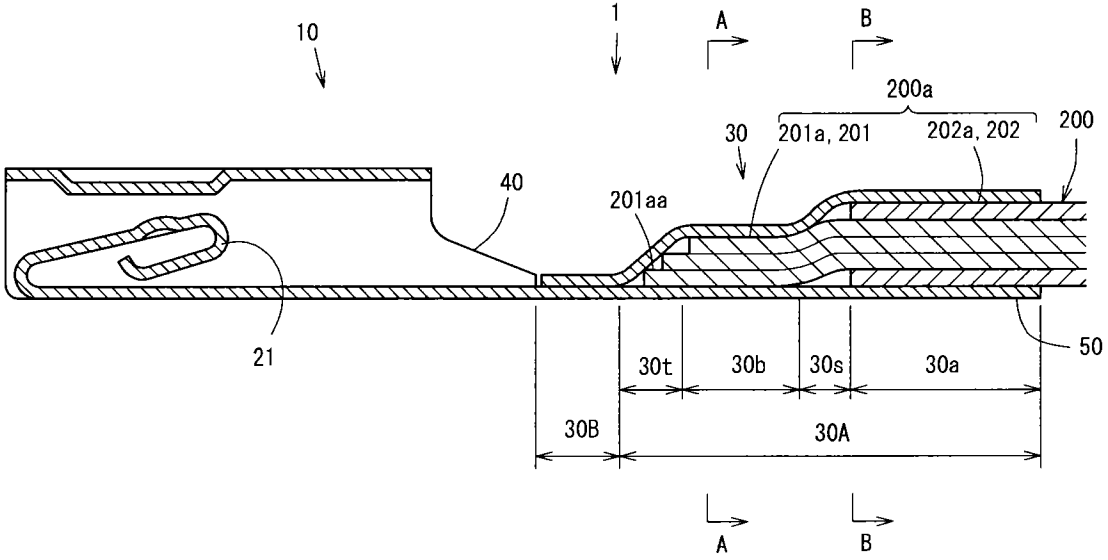
FIG. 3 is a vertical cross sectional view of a center in a width direction of a tip portion of the electric wire with the female crimp terminal according to the present embodiment.

Further, FIG. 2 is a perspective view of the female crimp terminal 10 according to the present embodiment as seen from a diagonally lower side, and FIG. 3 is a vertical cross sectional view showing the wire tip portion 200*a* of the electric wire 1 with the female crimp terminal according to the present embodiment, and its peripheral portion in an intermediate portion in a width direction.

The electric wire 1 with the female crimp terminal according to the present embodiment is constructed by connecting an insulated wire 200 to the female crimp terminal 10, as shown in FIGS. 1A and 3. Namely, the wire tip portion 200*a* in the insulated wire 200 is pressure-bonded and connected to a pressure-bonding section 30 of the female crimp terminal 10.

The insulated wire 200 pressure-bonded and connected to the female crimp terminal 10 is constructed by coating an aluminum core wire 201 obtained by bundling aluminum raw wires with an insulating cover 202 constructed by an insulating resin. This will be described in more detail. The aluminum core wire 201 is constructed by twisting aluminum alloy wires so that a cross section thereof becomes 0.75 $mm^2$.

The wire tip portion 200*a* is a portion which is provided with a conductor tip portion 202*a* and a conductor tip 201*a* in series according to this order toward a tip side, in a tip portion of the insulated wire 200.

The conductor tip 201*a* is a portion in which the aluminum core wire 201 is exposed by peeling off the insulating cover 202 in the tip side of the insulated wire 200, and the conductor tip portion 202*a* is a portion closer to a rear side than the conductor tip portion 202*a* in the tip portion of the insulated wire 200, and is a portion in which the aluminum core wire 201 is coated with the insulating cover 202.

A description will be in detail given below of the female crimp terminal 10.

The female crimp terminal 10 is structured such that a box portion 20 and a pressure-bonding section 30 are integrally constructed, the box portion 20 allowing insertion of an insertion tab in a male type terminal (not shown) from a front side corresponding to a tip side in a long length direction X toward a rear side, and the pressure-bonding section 30 being arranged in a rear side of the box portion 20 via a transition section 40 having a predetermined length.

In the present embodiment, the female crimp terminal 10 is constructed by the box portion 20 and the pressure-bonding section 30 as mentioned above, but it is possible to employ a male crimp terminal which is constructed by an insertion tab inserted and connected to the box portion 20 in the female crimp terminal 10 mentioned above and the pressure-bonding section 30, or a crimp terminal which is constructed only by the pressure-bonding section 30 and is provided for bundling and connecting the aluminum core wires 201 of a plurality of insulated wires 200, as long as a crimp terminal has the pressure-bonding section 30.

Further, the long length direction X is a direction which coincides with the long length direction of the insulated wire 200 pressure-bonding and connecting the pressure-bonding section 30, as shown in FIG. 1, and a width direction Y is a direction which intersects in a plane direction in relation to the long length direction X. Further, the side of the box portion 20 in relation to the pressure-bonding section 30 is set to a front side, and the side of the pressure-bonding section 30 in relation to the box portion 20 is inversely set to a rear side.

The box portion 20 is constructed by a tilting hollow square column body, and is provided in an inner portion with an elastic contact piece 21 which is folded toward a rear side in the long length direction X and comes into contact with an insertion tab (not shown) of a male type connecter to be inserted.

Further, the box portion 20 corresponding to the hollow square column body is folded so as to overlap side surface portions 23 which are provided in both side portions in the width direction Y which is orthogonal to the long length direction X of a bottom surface portion 22, and is constructed into an approximately rectangular shape as seen from a tip side in the long length direction X.

The pressure-bonding section 30 in a pre-pressure-bonding state is formed into an approximately O shape in a rear view by rounding a pressure-bonding surface 31 and a barrel construction piece 32 extending to both sides in the width direction Y of the pressure-bonding surface 31 so as to confront end portions 32*a* to each other and welding, as shown in FIG. 1B.

A length in the long length direction of the barrel construction piece 32 is formed longer than an exposure length in the long length direction X of the conductor tip 201*a* which is exposed in a front side in the long length direction X from the conductor tip portion 202*a* corresponding to the tip in the front side in the long length direction X of the insulating cover 202.

In the pressure-bonding section 30, a wire tip pressure-bonding section 30A and a sealing portion 30B are continuously arranged in this order from a rear side to a front side.

The sealing portion 30B is constructed into a flat shape such that sheet members are superposed each other by being deformed so as to crush an end portion closer to a front side than the wire tip pressure-bonding section 30A like an approximately flat plate.

A cover pressure-bonding section 30*a* is formed into a hollow shape which can surround the conductor tip portion 202*a*.

The wire tip pressure-bonding section 30A is structured by continuously arranging the cover pressure-bonding section 30*a*, a rear side diameter reduction portion 30*s*, a conductor pressure-bonding section 30*b* and a front side diameter reduction portion 30*t* in this order from a rear side to a front side. The wire tip pressure-bonding section 30A is constructed into a hollow shape which can insert the wire tip portion 200*a* from the cover pressure-bonding section 30*a* toward the front side diameter reduction portion 30*t*, and is integrally formed into a continuous shape which is continuous from the cover pressure-bonding section 30*a* toward the sealing portion 30B in a whole in a peripheral direction. In other words, the pressure-bonding section 30 is formed into a hollow shape (a tubular shape) which is not open in a peripheral surface portion from the cover pressure-bonding section 30*a* toward the sealing portion 30B.

The conductor pressure-bonding section 30*b* is formed into a smaller diameter than the cover pressure-bonding section 30*a*, and is formed into a hollow shape which can surround the conductor tip 201*a*.

The rear side diameter reduction portion 30*s* is formed while having a peripheral surface portion which is smaller in diameter little by little from the cover pressure-bonding section 30*a* toward the conductor pressure-bonding section 30*b*, in a boundary portion between the cover pressure-bonding section 30*a* and the conductor pressure-bonding section 30*b*. This will be described in more detail. The rear side diameter reduction portion 30*s* is diameter-reduced little by little toward a front side in the long length direction X in a whole of the peripheral surface except the bottom surface portion in the peripheral direction.

The front side diameter reduction portion 30*t* is formed while having a peripheral surface portion which is smaller in diameter little by little from the conductor pressure-bonding section 30*b* toward the sealing portion 30B, in a boundary portion between the conductor pressure-bonding section 30*b* and the sealing portion 30B. This will be described in more detail. The front side diameter reduction portion 30*t* is diameter-reduced toward a front side in the long length direction X at least in an upper surface portion 36, while not being diameter-reduced toward a front side in the long length direction X in a bottom surface portion 35 in a peripheral direction.

A description will be given of a procedure of pressure-bonding and connecting the female crimp terminal 10 to the wire tip portion 200*a* mentioned above, and operations and effects which are achieved at this time, with reference to FIGS. 4 and 5.

Figures 4A, 4B:
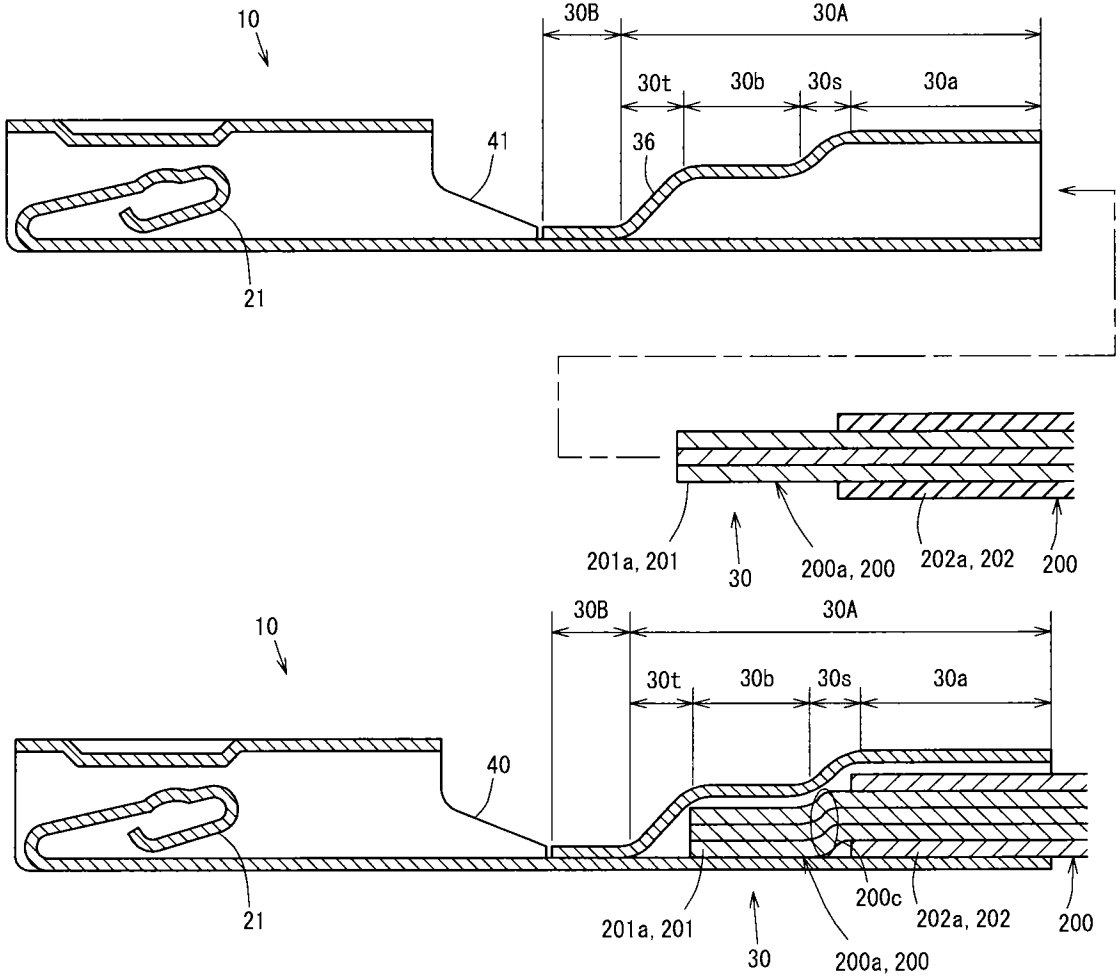
FIGS. 4A and 4B are explanatory views of an operation in the case where the female crimp terminal according to the present embodiment is pressure-bonded to an insulated wire.
Figure 5A:
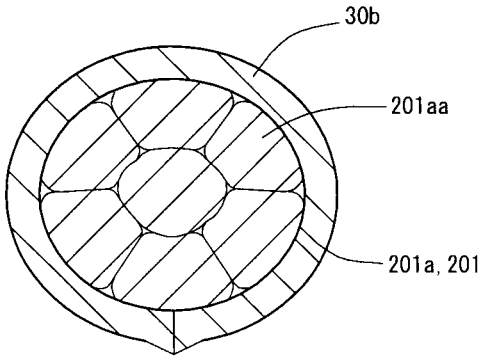
FIGS. 5A and 5B are cross sectional views in the case where a pressure-bonding section is cut at a predetermined position in a long length direction.
Figure 5B:
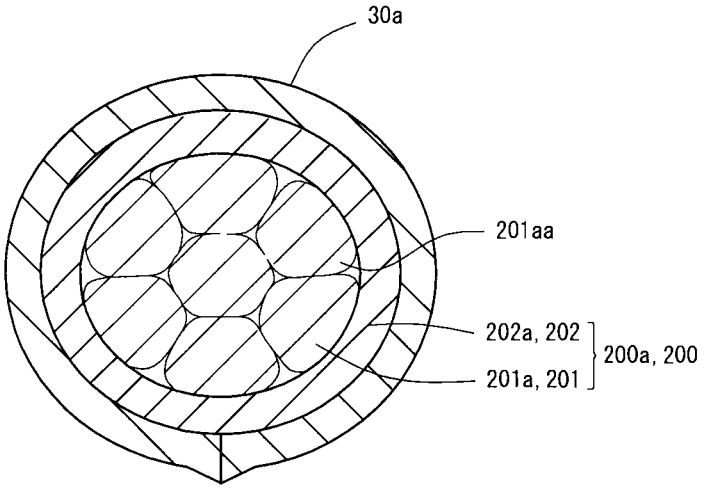

FIG. 4 is an explanatory view of an operation of the electric wire 1 with the female crimp terminal according to the present embodiment. This will be described in more detail. FIG. 4A is a vertical cross sectional view showing a state just before inserting the wire tip portion 200*a* to the female crimp terminal 10, and FIG. 4B is a vertical cross sectional view showing a state in which the wire tip portion 200*a* is inserted to the female crimp terminal 10. FIG. 5A is a vertical cross sectional view along a line A-A in FIG. 3, and FIG. 5B is a vertical cross sectional view along a line B-B in FIG. 3.

First of all, as shown in FIG. 4A, the wire tip portion 200*a* is inserted to the wire tip pressure-bonding section 30A in the pressure-bonding section 30. At this time, as shown in FIG. 4B, the conductor tip portion 202*a* of the wire tip portion 200*a* is inserted to an inner portion of the cover pressure-bonding section 30*a*, and the conductor tip 201*a* of the wire tip portion 200*a* is inserted to an inner portion of the conductor pressure-bonding section 30*b*.

In this state, the female crimp terminal 10 can be pressure-bonded and connected to the wire tip portion 200*a*, as shown in FIGS. 3 and 5, by pressure-bonding the pressure-bonding section 30 to the wire tip pressure-bonding section 30A by means of a crimp tool (not shown).

The electric wire 1 with the female crimp terminal mentioned above and the female crimp terminal 10 can obtain the following effects.

The pressure-bonding section 30 in the female crimp terminal 10 is constructed by arranging the conductor pressure-bonding section 30*b* which pressure-bonds the conductor tip 201*a*, and the cover pressure-bonding section 30*a* which pressure-bonds the conductor tip portion 202*a*, in this order from the tip side to the base end side in the long length direction X, and is structured such that the cover pressure-bonding section 30*a* is formed into the hollow shape which can surround the conductor tip portion 202*a*, and the conductor pressure-bonding section 30*b* is formed to have the smaller diameter than the conductor pressure-bonding section 30*b*, and is formed into the hollow shape which can surround the conductor tip 201*a*. As a result, it is possible to closely contact firmly the conductor tip 201*a* and the conductor pressure-bonding section 30*b*, in the state in which the wire tip portion 200*a* is pressure-bonded to the female crimp terminal 10, and it is possible to obtain a stable conductivity.

This will be described in more detail. In the case of the conventional female crimp terminal provided with the pressure-bonding section which is formed waistless while having approximately fixed diameter along the long length direction X, there is generated a situation that not only the conductor tip 201*a* but also the conductor tip portion 202*a* are arranged in the conductor pressure-bonding section 30*b* by inserting the tip side portion (the wire tip portion 200*a*) of the insulated wire 200 to the pressure-bonding section 30 too much.

As a result, the conductor tip 201*a* is twisted in the inner portion of the pressure-bonding section 30 by being pressed, or is pressure-bonded to the pressure-bonding section in a tilting state. Therefore, there is a problem that the pressure-bonding section is not closely contacted with the conductor tip 201*a* and an air gap tends to be generated in the inner portion between the pressure-bonding section and the conductor tip 201*a*, in the pressure-bonding state.

On the contrary, in the case where the insertion to the pressure-bonding section 30 in the tip side (the wire tip portion 200*a*) of the insulated wire 200 is not enough, a position where the conductor tip 201*a* is not arranged is generated in the tip portion of the pressure-bonding section, and there is a problem that an internal air gap tends to be left in the inner portion of the pressure-bonding section even in the pressure-bonding state.

Accordingly, it is impossible to closely contact firmly the conductor tip 201*a* and the conductor tip in a state in which the wire tip portion 200*a* is pressure-bonded to the female crimp terminal, and the stable conductivity cannot be obtained.

On the contrary, in the female crimp terminal 10 according to the present embodiment, the pressure-bonding section 30 is constructed by the cover pressure-bonding section 30*a*, and the conductor pressure-bonding section 30*b* which is formed to have the smaller diameter than the conductor pressure-bonding section 30*b*, as mentioned above. Therefore, the conductor tip 201*a* can be appropriately arranged in the conductor pressure-bonding section 30*b* in the long length direction X by inserting the tip side of the insulated wire 200 to the pressure-bonding section 30, and the conductor tip portion 202*a* can be appropriately arranged in the cover pressure-bonding section 30*a*.

As a result, the conductor tip 201*a* neither twist nor tilt in the inner portion of the pressure-bonding section 30, and any air gap is not left closer to the tip side than the conductor tip 201*a* in the inner portion of the pressure-bonding section 30 due to short of insertion.

Accordingly, any air gap is not generated in the inner portion of the pressure-bonding section 30 in the state in which the pressure-bonding section 30 is pressure-bonded, it is possible to closely contact firmly the conductor tip 201*a* and the conductor tip 201*a* in the state in which the wire tip portion 200*a* is pressure-bonded to the female crimp terminal 10, and it is possible to obtain the stable conductivity.

This will be described in more detail. Even if the conductor tip 201*a* is intended to be inserted to reach the conductor pressure-bonding section 30*b* at the inserting time of the wire tip portion 200*a* to the pressure-bonding section 30, the conductor tip portion 202*a* can be prevented from being inserted to a position which is deeper than the position of the cover pressure-bonding section 30*a*, and to reach the conductor pressure-bonding section 30*b*, since the conductor pressure-bonding section 30*b* is formed to have the smaller diameter than the cover pressure-bonding section 30*a*.

On the contrary, if the conductor tip portion 202*a* is inserted to the portion before the conductor pressure-bonding section 30*b* in the case where the wire tip portion 200*a* is inserted to the pressure-bonding section 30, the conductor tip portion 202*a* comes into contact with the base end side of the conductor pressure-bonding section 30*b* which is formed to have the small diameter, so that it is possible to easily recognize completion of insertion to a predetermined insertion position.

Accordingly, the wire tip portion 200*a* neither be inserted to the pressure-bonding section 30 nor be short in insertion, it is possible to appropriately arrange the conductor tip 201*a* in the conductor pressure-bonding section 30*b*, and it is possible to appropriately arrange the conductor tip portion 202*a* in the cover pressure-bonding section 30*a*.

Further, in the conventional female crimp terminal, since the pressure-bonding section is formed approximately at the same diameter over a whole length in the long length direction, a great compression deformation is forced to the pressure-bonding section according to the pressure-bonding, particularly in the case of intending to compression-deform and pressure-bond to a degree that the pressure-bonding section closely contacts with the conductor tip 201*a* which is arranged in the inner portion of the pressure-bonding section.

Accordingly, the deformation degree of the shape of the post-pressure-bonding state becomes greater, for example, the pressure-bonding section is partly broken in the process of the pressure-bonding, or the deflection is generated in the pressure-bonding section (the pressure-bonding completion portion) of the post-pressure-bonding state. As a result, the air gap is generated between the pressure-bonding section and the tip portion of the insulated wire 200.

As a result, the conductor tip 201*a* and the conductor pressure-bonding section cannot be closely contacted in the state in which the wire tip portion 200*a* is pressure-bonded to the female crimp terminal, and the stable conductivity cannot be obtained.

On the contrary, in the female crimp terminal 10 according to the present embodiment, since the conductor pressure-bonding section 30*b* is formed to have the small diameter so as to correspond to the diameter of the conductor tip 201*a* in comparison with the cover pressure-bonding section 30*a*, it is possible to suppress deformation according to the pressure-bonding in the conductor pressure-bonding section 30*b*, in the case where the pressure-bonding section 30 is pressure-bonded to the wire tip portion 200*a*.

Therefore, since the conductor pressure-bonding section 30*b* is not partly broken according to the pressure-bonding, and the conductor pressure-bonding section 30*b* can be closely contacted firmly with the conductor tip 201*a*, it is possible to prevent any internal air gap from being generated in the pressure-bonding section 30, it is possible to closely contact firmly the conductor tip 201*a* and the conductor tip 201*a*, and it is possible to obtain the stable conductivity.

Further, in the female crimp terminal 10 according to the present embodiment, since the conductor pressure-bonding section 30*b* is formed to have the smaller diameter than the cover pressure-bonding section 30*a* as mentioned above, it is possible to closely contact the cover pressure-bonding section 30*a* with the conductor tip portion 202*a*, in the state in which the wire tip portion 200*a* is pressure-bonded to the female crimp terminal 10, it is possible to closely contact the conductor pressure-bonding section 30*b* with the conductor tip 201*a*, and it is possible to prevent any air gap from being generated between the conductor pressure-bonding section 30*b* and the conductor tip 201*a*.

Further, in the female crimp terminal 10 according to the present embodiment, since the sealing portion 30B is formed in the tip side in the long length direction X of the pressure-bonding section 30, the terminal base material 100 is formed into the continuous shape in the whole in the peripheral direction from the cover pressure-bonding section 30*a* toward the sealing portion 30*b*, and the conductor pressure-bonding section 30*b* is formed to have the smaller diameter than the cover pressure-bonding section 30*a*, it is possible to obtain an excellent water-blocking performance that the moisture does not enter into the inner portion of the pressure-bonding section 30, and the moisture is not interposed between the pressure-bonding section 30 and the aluminum core wire 201.

This will be described in more detail. Since the connector to which the female crimp terminal is installed is generally used under various environments, the unexpected moisture may be attached to the surface of the insulated wire due to the dew condensation caused by the change of the atmospheric temperature. Further, the moisture may enter into the inner portion of the connector through the surface of the insulated wire.

Further, in the case where any gap is generated between the pressure-bonding section and the conductor tip 201*a* in the inner portion of the pressure-bonding section, the moisture tends to enter through the air gap, and the entering moisture lies between the pressure-bonding section and the conductor tip 201*a*, so that there has been a problem that the conductor tip 201*a* corrodes. Particularly in the case of the wire conductor constructed by the dissimilar metal having different ionization tendencies, and the crimp terminal, there has been a problem that the moisture is attached and the galvanic corrosion is generated in the case of being provided as a part of the connector.

On the contrary, in the female crimp terminal 10 according to the present embodiment, since the sealing portion 30B is formed in the tip side in the long length direction X of the pressure-bonding section 30, and is formed into the continuous shape that the terminal base material 100 is continuous in the whole in the peripheral direction, from the cover pressure-bonding section 30*a* toward the sealing portion 30*b*, and the conductor pressure-bonding section 30*b* is formed to have the smaller diameter than the cover pressure-bonding section 30*a*, it is possible to prevent the moisture from entering into the inner portion of the pressure-bonding section 30, and it is possible to obtain an excellent water-blocking performance.

Further, in the female crimp terminal 10 according to the present embodiment, the rear side diameter reduction portion 30*s* is formed in the boundary portion between the cover pressure-bonding section 30*a* and the conductor pressure-bonding section 30*b*, the rear side diameter reduction portion 30*s* being smaller in diameter little by little from the cover pressure-bonding section 30*a* toward the conductor pressure-bonding section 30*b*.

According to the structure mentioned above, the rear side diameter reduction portion 30*s* can be arranged so as to face to the wire tip portion 200*a* which is arranged along the long length direction X, in comparison with the case that the boundary portion between the cover pressure-bonding section 30*a* and the conductor pressure-bonding section 30*b* is formed along the orthogonal direction which is orthogonal to the long length direction X and the width direction, in other words, formed straight in the diametrical direction.

As a result, in the case where the pressure-bonding section 30 including the rear side diameter reduction portion 30*s* is pressure-bonded, the rear side diameter reduction portion 30*s* can be pressure-bonded in the state in which the rear side diameter reduction portion 30*s* is closely contacted firmly with the boundary portion between the conductor tip portion 202*a* and the conductor tip 201*a*.

Further, according to the structure mentioned above, since the rear side diameter reduction portion 30*s* is formed in the boundary portion between the cover pressure-bonding section 30*a* and the conductor pressure-bonding section 30*b*, the rear side diameter reduction portion 30*s* being smaller in diameter little by little from the cover pressure-bonding section 30*a* toward the conductor pressure-bonding section 30*b*, it is possible to align the boundary portion between the cover pressure-bonding section 30*a* and the conductor pressure-bonding section 30*b*, with the boundary portion 200*c* between the conductor tip portion 202*a* and the conductor tip 201*a* in the wire tip portion 200*a* in the long length direction X, in the state in which the wire tip portion 200*a* is inserted to the pressure-bonding section 30 (refer to FIG. 4).

Further, in the boundary portion between the conductor tip portion 202*a* and the conductor tip 201*a*, for example, there is arranged a base end portion of the conductor tip 201*a* which is diameter-reduced little by little toward the tip side just after being derived to an outer side from the insulating cover 202 (refer to FIG. 4).

As a result, it is possible to form so as to correspond to the shape of the base end portion of the conductor tip 201*a* by forming the rear side diameter reduction portion 30*s* in the boundary portion between the cover pressure-bonding section 30*a* and the conductor pressure-bonding section 30*b*.

Therefore, the pressure-bonding section 30 can be closely contacted with the tip side of the insulated wire 200 including the boundary portion between the cover pressure-bonding section 30*a* and the conductor pressure-bonding section 30*b* at the pressure-bonding time between the pressure-bonding section 30 and the tip side of the insulated wire 200, and it is particularly possible to prevent generation of the internal air gap in the boundary portion between the cover pressure-bonding section 30*a* and the conductor pressure-bonding section 30*b*.

Further, in the female crimp terminal 10 according to the present embodiment, the front side diameter reduction portion 30*t* is formed in the boundary portion between the conductor pressure-bonding section 30*b* and the sealing portion 30B, the front side diameter reduction portion 30*t* being smaller in diameter little by little from the conductor pressure-bonding section 30*b* toward the sealing portion 30B.

According to the structure mentioned above, in comparison with the case that the boundary portion between the conductor pressure-bonding section 30*b* and the sealing portion 30B is formed along the orthogonal direction which is orthogonal to the long length direction X and the width direction, in other words, the case that the boundary portion is formed straight in the diametrical direction, the front side diameter reduction portion 30*t* can be arranged, for example, so as to face to the conductor tip 201*a* arranged along the long length direction X, and the bottom surface portion 35 of the pressure-bonding section 30. As a result, in the case of pressure-bonding the pressure-bonding section 30 including the front side diameter reduction portion 30*t*, it is possible to pressure-bond the front side diameter reduction portion 30*t*, for example, in the state in which the front side diameter reduction portion 30*t* is closely contacted firmly with the conductor tip 201*a* arranged along the long length direction X, and the bottom surface portion 35 of the pressure-bonding section 30.

Further, according to the structure mentioned above, the front side diameter reduction portion 30*t* is formed in the boundary portion between the conductor pressure-bonding section 30*b* and the sealing portion 30B, the front side diameter reduction portion 30*t* being smaller in diameter little by little from the conductor pressure-bonding section 30*b* toward the sealing portion 30B. Therefore, it is possible to insert the tip portion of the conductor tip 201*a*, for example, tip portions of at least partial raw wires 201*aa* of a plurality of aluminum raw wires 201*aa* constructing the aluminum core wire 201 of the conductor tip 201*a*, to the front side diameter reduction portion 30*t*.

Therefore, in the case of pressure-bonding the pressure-bonding section 30 and the tip side of the insulated wire 200, it is possible to closely contact with the conductor tip 201*a* even in the boundary portion between the conductor pressure-bonding section 30*b* and the sealing portion 30B, and it is particularly possible to prevent generation of any internal air gap in the boundary portion between the conductor pressure-bonding section 30*b* and the sealing portion 30B (refer to FIG. 3).

Subsequently, a description will be given of a manufacturing method of the female crimp terminal 10 mentioned above with reference to FIGS. 6 and 7.

Figure 6A:
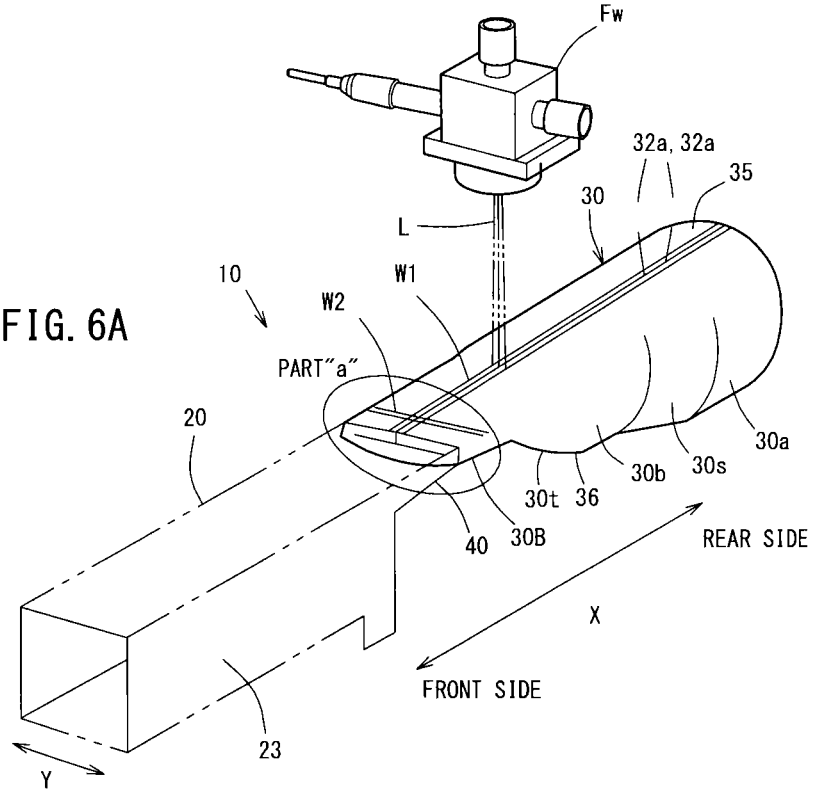
Figure 6A:
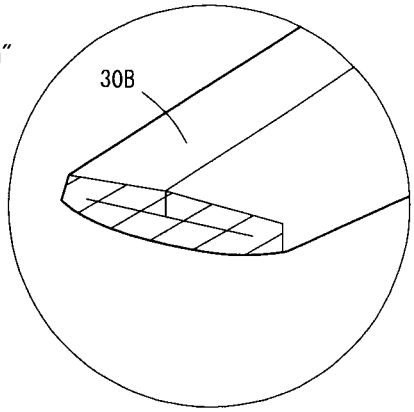

FIG. 6 shows an explanatory view explaining welding in the pressure-bonding section 30. This will be described in more detail. FIG. 6A is an explanatory view of an operation and shows a state in which fiber laser welding is carried out by a fiber laser welding apparatus Fw, and FIG. 6B is an enlarged view of a part "a" in FIG. 6A.

Figure 7:
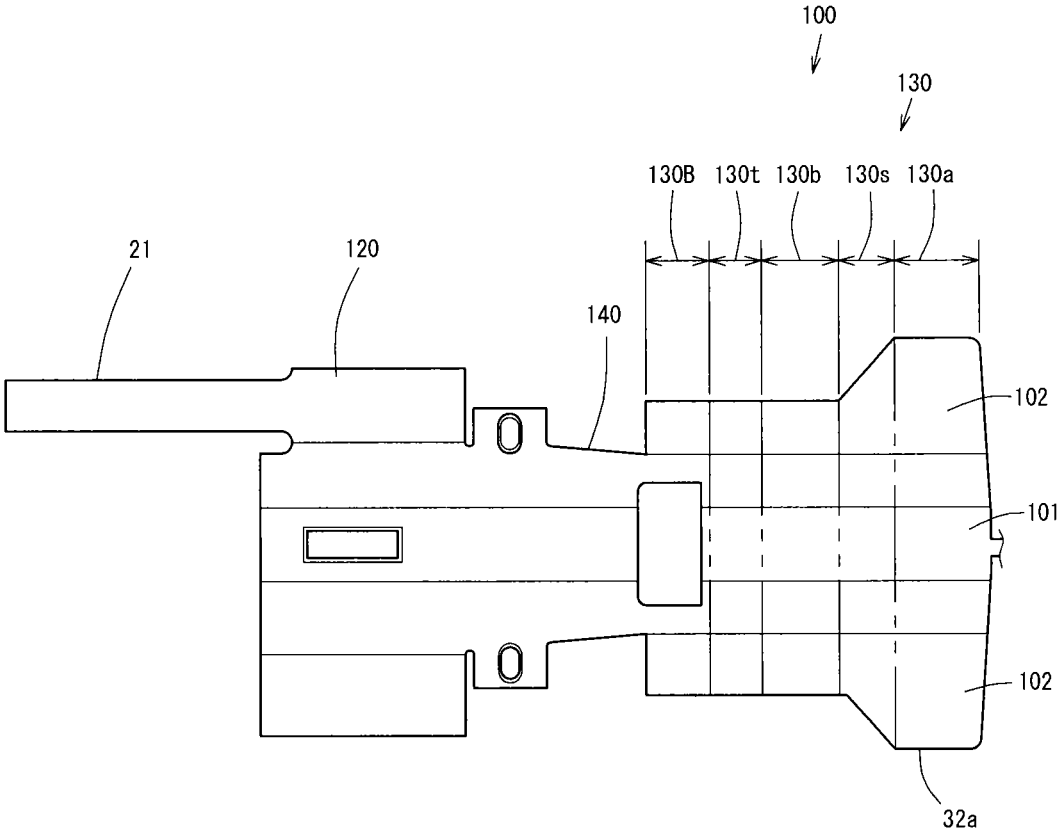
FIG. 7 is a plan view of a terminal base material which constructs the female crimp terminal.

FIG. 7 is a plan view of the terminal base material 100 constructing the female crimp terminal 10.

Further, the terminal base material 100 is a sheet member obtained by punching a cupper alloy steak (not shown) such as brass having a tin plated (Sn plated) surface into a terminal shape which is plane expanded as shown in FIG. 7.

The terminal base material 100 is formed by a box portion corresponding portion 120 which corresponds to the box portion 20, a transition corresponding portion which corresponds to the transition section 40, and a pressure-bonding section corresponding portion 130 which corresponds to the pressure-bonding section 30, when being bent into the terminal shape.

The pressure-bonding section corresponding portion 130 is constructed by a barrel bottom portion 101 and a barrel piece 102, and is obtained by arranging a sealing portion corresponding portion 130B, a front side diameter reduction portion corresponding portion 130*t*, a conductor pressure-bonding section corresponding portion 130*b*, a rear side diameter reduction portion corresponding portion 130*s* and a cover pressure-bonding section corresponding portion 130*a* in this order from a front side to a rear side in the long length direction.

The barrel piece 102 in the cover pressure-bonding section corresponding portion 130*a* protrudes in a width direction more than the barrel piece 102 in the sealing portion corresponding portion 130B, the front side diameter reduction portion corresponding portion 130*t* and the conductor pressure-bonding section corresponding portion 130*b*, and the barrel piece 102 in the sealing portion corresponding portion 130B, the front side diameter reduction portion corresponding portion 130*t* and the conductor pressure-bonding section corresponding portion 130*b* is formed so as to protrude at approximately the same protruding length in the width direction.

Further, the barrel piece 102 of the rear side diameter reduction portion corresponding portion 130*s* is formed by inclining the tip portion in the protruding direction in a plan view so that the protruding length protrudes little by little from the front side to the rear side in the long length direction X.

The close barrel type female crimp terminal 10 is constructed by bending the pressure-bonding base material 100 mentioned above into a stereoscopic terminal shape which is constructed by the box portion 20 having a hollow square columnar body and the pressure-bonding section 30 having an approximately O shape in the rear view, and welding the pressure-bonding section 30.

This will be described in more detail. The barrel piece 102 of the pressure-bonding section 30 is constructed as a cylindrical shape by being rounded so that the facing end portions 32*a* confront to each other in their bottom surface side, and the front portion of the cylindrical shape is deformed into an approximately tabular shape by being pressed to the bottom surface side from the upper surface side. Further, a long length direction weld portion W1 is formed by welding positions which are along the long length direction X and are obtained by confronting the facing end portions 32*a* of the cylindrical shape, and a width direction weld portion W2 is thereafter formed by welding the width direction weld positions W2 in the width direction Y.

Here, the rear side diameter reduction portion 30*s* and the front side diameter reduction portion 30*t* are formed by diameter-reducing the portions at least excluding the bottom surface portion 35 in the peripheral direction. However, the bottom surface portions 35 in the diameter reduction portions 30*s* and 30*t* are formed into a flat shape without being diameter-reduced.

As a result, the bottom surface portion 35 of the pressure-bonding section 30 can be formed into a flat shape in which a diameter does not fluctuate along the long length direction X.

Accordingly, it is possible to securely form the weld portions W1 and W2 without displacement of focal point of the laser L according to fluctuation of the diameter in the boundary portions of the cover pressure-bonding section 30*a*, the conductor pressure-bonding section 30*b* and the sealing portion 30B, in the laser irradiation distance irradiating to a pair of facing end portions, in the case of welding a pair of facing end portions while the laser irradiation apparatus Fw is caused to slide along the long length direction X, in the bottom surface portion 35 of the pressure-bonding section 30, as shown in FIG. 6.

Further, it is possible to smoothly form the weld portion without necessity of actuation of the laser irradiator point by point in a direction of moving close to and away from the pressure-bonding section 30, for aligning the focal point of the laser L in the case of welding a pair of facing end portions while the laser irradiation apparatus is caused to slide along the long length direction X, in the bottom surface portion of the pressure-bonding section 30.

In the correspondence of the structures of the present invention to the embodiment, the following correspondence can be established.

The pressure-bonding connection structural body of the present invention corresponds to the electric wire 1 with the female crimp terminal according to the embodiment.

In the same manner, the female crimp terminal corresponds to the female crimp terminal 10.

The rear side diameter reduction portion corresponds to the rear side diameter reduction portion 30*s*.

The front side diameter reduction portion corresponds to the front side diameter reduction portion 30*t*.

The conductor corresponds to the aluminum core wire 201.

The tip side in the long length direction corresponds to the front side in the long length direction X.

The base end side in the long length direction corresponds to the rear side in the long length direction X.

However, the present invention is not limited only to the structures of the embodiment mentioned above, but can be applied on the basis of the technical ideas shown in claims, and a lot of embodiments can be obtained.

In the present embodiment, the description is given of the example in which the barrel portion 130 of the crimp terminal 100 is pressure-bonded and connected to the aluminum core wire 201 which is made of the less noble metal such as the aluminum or the aluminum alloy. However, the barrel portion may be pressure-bonded and connected, for example, to the conductor portion which is made of the nobler metal material such as the copper or the copper alloy, in addition to the less noble metal, and it is possible to achieve approximately the same operations and effects as those of the embodiment.

This will be described in more detail. Since the barrel portion 130 having the structure mentioned above can prevent the moisture intrusion in the pressure-bonding state, it is possible to connect, for example, the insulated wire which has been conventionally necessary to be sealed after the post-pressure bonding state for water-blocking between the wires, the insulated wire being constructed by the core wire such as the copper or the copper alloy.

Further, in the description mentioned above, the approximately tubular pressure-bonding section 30 having the opening in the rear side of the long length direction X is formed by rounding the copper alloy streak punched into the terminal shape, confronting the end portions 32*a* to each other and welding along the weld portion W1 in the long length direction X so as to form into the approximately O-shape in the rear view, thereafter collapsing the front end portion in the long length direction X, welding and sealing along the weld position W2 in the width direction Y, and sealing the front end in the long length direction X with the sealing portion 30B, as shown in FIG. 6. However, as shown in FIG. 8 which is an explanatory view explaining the other welding method in the pressure-bonding section 30, the pressure-bonding section 30 may be formed by forming the shape of the pressure-bonding section 30 and thereafter welding the weld position.

Figures 8A, 8B, 8C:
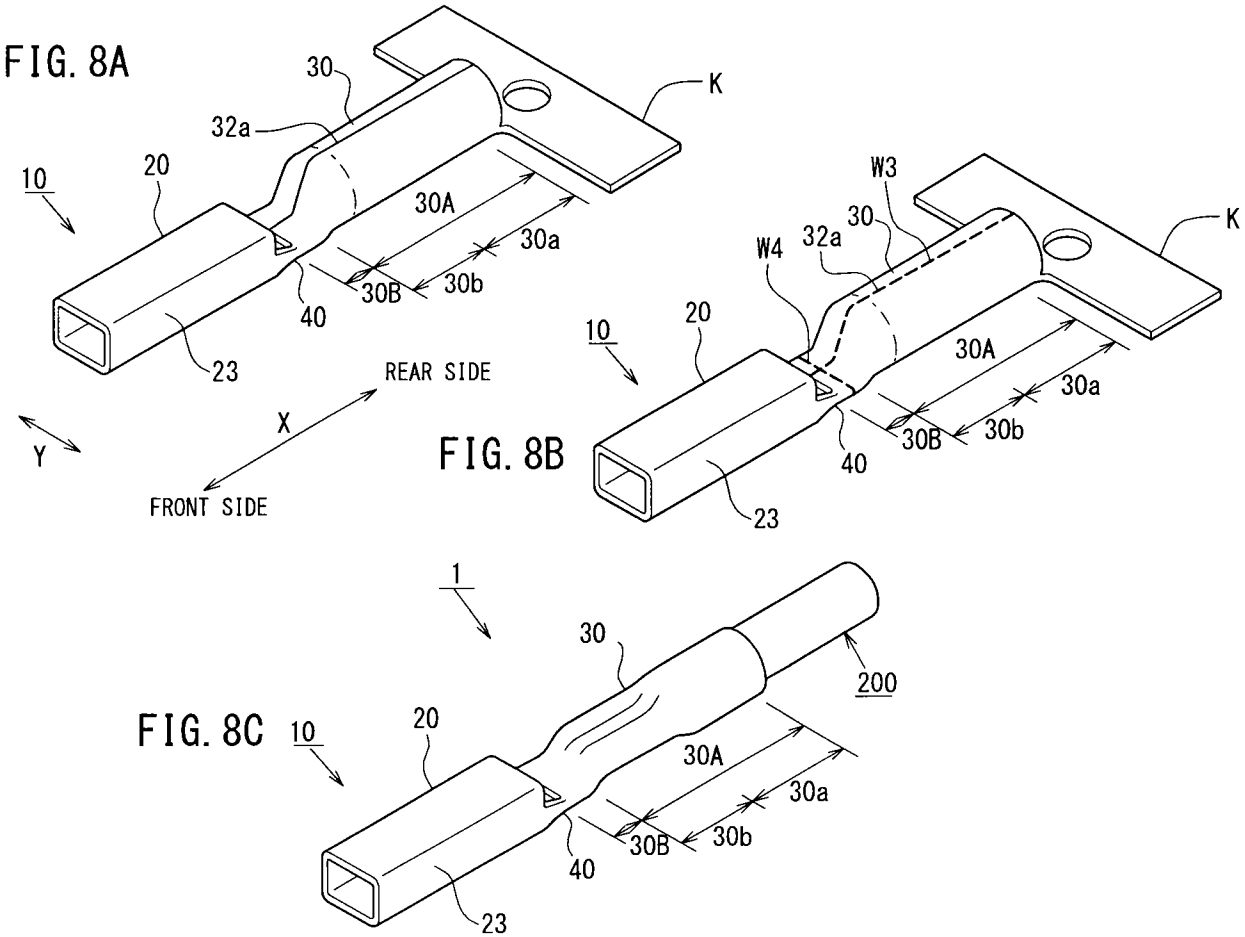
FIGS. 8A, 8B and 8C are explanatory views explaining the other welding method in the pressure-bonding section.

This will be described in more detail. As shown in FIG. 8A, a pressure-bonding section 30 including a sealing portion 30B is previously formed by rounding the copper alloy streak punched into the terminal shape and collapsing the front end portion in the long length direction X.

Further, the pressure-bonding section 30 is completed by welding the rounded and confronted end portions 32*a* to each other along a weld position W3 in the long length direction X, and welding and sealing along a weld position W4 in the width direction Y in the sealing portion 30B.

Further, the end portions 32*a* may be confronted and welded in the bottom surface side of the pressure-bonding section 30, as shown in FIG. 6, and the end portions 32*a* may be confronted and welded in the upper surface side of the pressure-bonding section 30, as shown in FIGS. 8A and 8B.

Further, as shown in FIG. 8C, the cover pressure-bonding section 30*a* of the pressure-bonding section 30 may be pressure-bonded into a circular shape in a front view to the insulating cover 202 of the insulated wire 200, and the conductor pressure-bonding section 30*b* may be pressure-bonded into an approximately U-shaped form in a front view to the aluminum core wire, in the pressure-bonding state.

Further, the crimp terminal 100 may be separated from a carrier K on pressure-bonding and connecting the insulated wire 200 or after pressure-bonding and connecting the insulated wire 200, after welding the pressure-bonding section 30 in a state in which the crimp terminal 100 is attached to a band-like carrier K, as shown in FIG. 8. However, the crimp terminal 100 may be formed in a state in which the crimp terminal 100 is separated from the carrier K, and the insulated wire 200 may be pressure-bonded and connected.

Further, in the description mentioned above, the wire tip pressure-bonding section 30A is constructed by continuously arranging in series the cover pressure-bonding section 30*a*, the rear side diameter reduction portion 30*s*, the conductor pressure-bonding section 30*b* and the front side diameter reduction portion 30*t* in this order from the rear side to the front side. However, the wire tip pressure-bonding section 30A may be constructed by a stepped diameter reduction portion 30*c* in place of the rear side diameter reduction portion 30*s*, the conductor pressure-bonding section 30*b* and the front side diameter reduction portion 30*t* as shown in FIG. 9 which is an explanatory view explaining the other pressure-bonding section.

The stepped diameter reduction portion 30*c* has a smaller diameter than the cover pressure-bonding section 30*a*, and is diameter-reduced step by step toward the front side in the long length direction X. Each of stages of the stepped diameter reduction portion 30*c* diameter-reduced step by step is constructed by a difference in a height direction, a diameter reduction amount in each of the stages corresponds to a thickness of the insulating cover 202 of the insulated wire 200, and a length in the long length direction X of each of the stages corresponds to a length of the aluminum core wire 201 in the insulated wire 200.

In the stepped diameter reduction portion 30*c* constructed as mentioned above, in the case where the electric wire 1 with the female crimp terminal is constructed by inserting and pressure-bonding the insulated wires 200 having various diameters, it is possible to achieve a secure pressure-bonding state by inserting the wire tip portion 200*a* to the wire tip pressure-bonding section 30A at an appropriate insertion position.

Figure 9A:
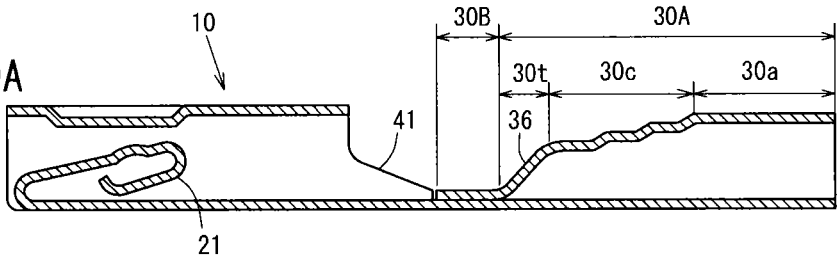
FIGS. 9A, 9B, 9C and 9D are explanatory views explaining the other pressure-bonding section.
Figure 9B:
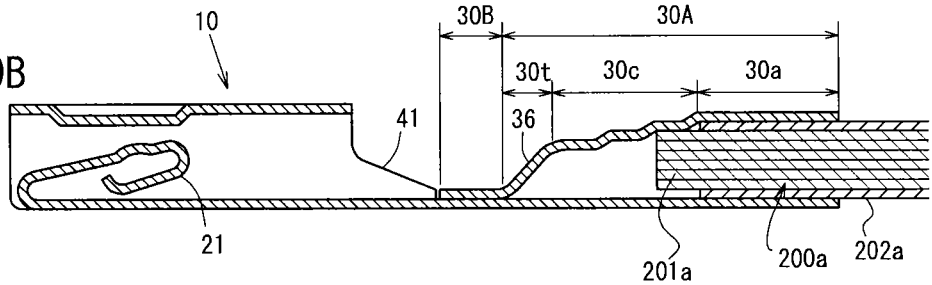

This will be described in more detail. In the case of the insulated wire 200 having a large diameter, for example, as shown in FIG. 9B, the insulated wire cannot be inserted any more by inserting the insulated wire until the conductor tip 201*a* comes into contact with a stage portion in the rear side in the long length direction X (a left side in FIG. 9) in the stepped diameter reduction portion 30*c*, and can be inserted to an appropriate insertion position.

Figure 9C:
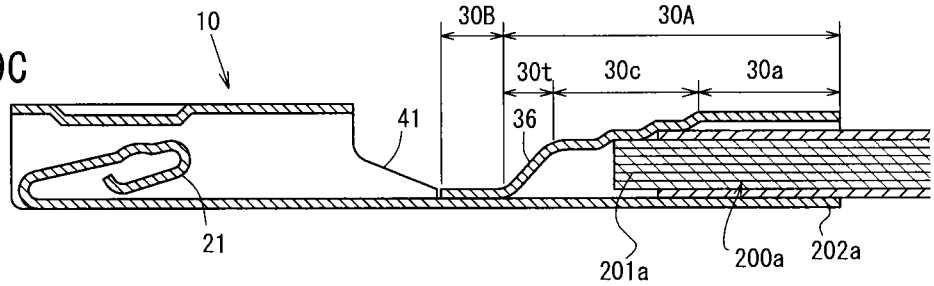

In the case of the insulated wire 200 having a medium diameter as shown in FIG. 9C, the insulated wire can be inserted to a position where the insulated wire comes into contact with an intermediate stage portion in the long length direction X. In other words, it is possible to insert to the position which is closer to the front side in the long length direction X than the insulated wire 200 having the large diameter.

Figure 9D:
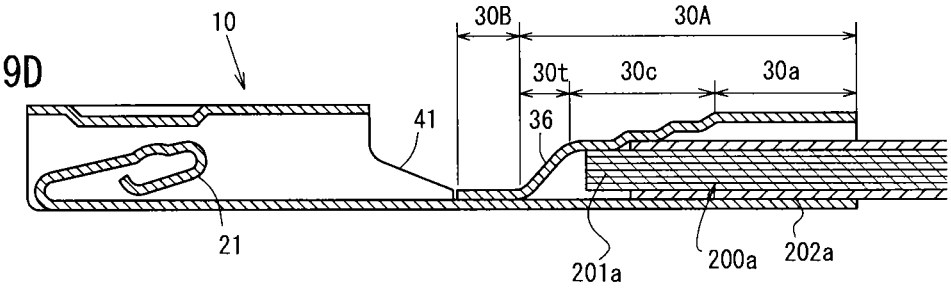
Figure 10A:
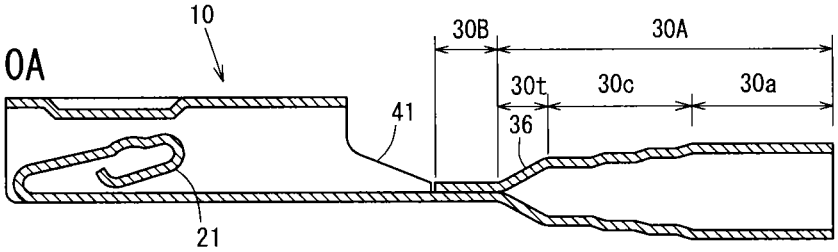
FIGS. 10A, 10B, 10C and 10D are explanatory views explaining further the other pressure-bonding section.
Figure 10B:
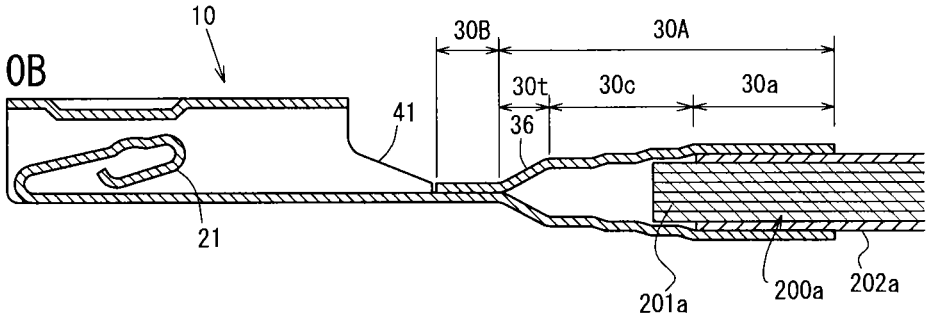
Figure 10C:
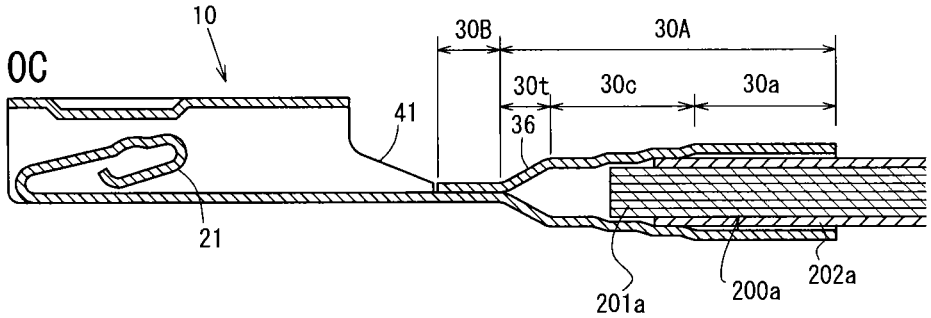
Figure 10D:
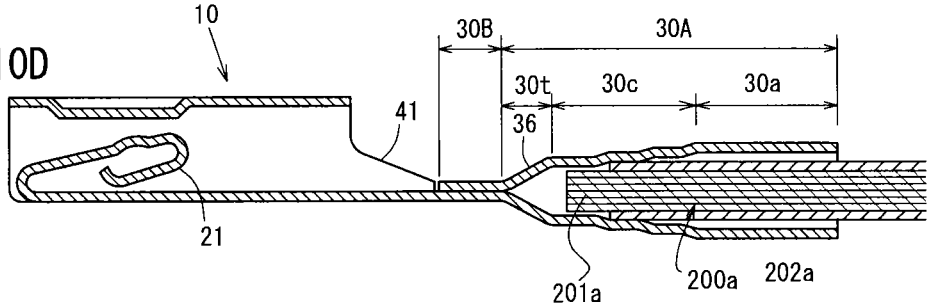

Further, in the case of the insulated wire 200 having a small diameter as shown in FIG. 9D, the insulated wire can be inserted to a position where the insulated wire comes into contact with a stage portion in the front side in the long length direction X (a right side in FIG. 9). In other words, it is possible to insert to the position which is further closer to the front side in the long length direction X than the insulated wire 200 having the medium diameter.

As mentioned above, the stepped diameter reduction portion 30*c* can be appropriately inserted to the stage portion in correspondence to the diameter of the insulated wire 200. Since each of the stage portions is diameter-reduced step by step from the rear side toward the front side in the long length direction X, that is, since the conductor tip 201*a* is pressure-bonded by each of the stage portions which are diameter-reduced in correspondence to the conductor tip 201*a* of the wire tip portion 200*a* inserted to the stage portion, the pressure-bonding amount does not depend on the diameter of the conductor tip 201*a* and it is possible to pressure-bond at the same level of pressure-bonding amount. Therefore, any problem such as a crack is not generated in the pressure-bonding section 30 due to the great pressure-bonding deformation, that is, too great pressure-bonding amount, for pressuring-bonding the aluminum core wire 201 having the small diameter, and it is possible to securely pressure-bond at an appropriate pressure-bonding amount. In other words, the electric wire 1 with the female crimp terminal can be constructed by securely pressure-bonding many kinds of insulated wires 200 by the stepped diameter reduction portion 30*c*.

Further, the stepped diameter reduction portion 30*c* of the description mentioned above has the smaller diameter than the cover pressure-bonding section 30*a* in the pressure-bonding section 30 in which the bottom surface portion is flat, and is diameter-reduced step by step toward the front side in the long length direction X. However, as shown in FIG. 10 which is an explanatory view explaining further the other pressure-bonding section 30, a whole periphery of the pressure-bonding section 30 may be diameter-reduced, that is, a center of each of the stages diameter-reduced in the stepped diameter reduction portion 30*c* may be formed so as to be fixed along the long length direction X.

As mentioned above, in the case where the electric wire 1 with the female crimp terminal is constructed by using the stepped diameter reduction portion 30*c* which is not flat in the bottom surface and is diameter-reduced in a whole periphery, and inserting and pressure-bonding the insulated wires 200 having various diameters, it is possible to achieve the same effect as that of the stepped diameter reduction portion 30*c* in the pressure-bonding section 30 which is flat in the bottom surface, and it is possible to form a guide for inserting the conductor tip 201*a* in the insulated wires 200 having various diameters to the predetermined position and it is possible to easily insert. Further, the deviation of processing strain in the case of processing and manufacturing the female crimp terminal 10 becomes less than the stepped diameter reduction portion 30*c* in the pressure-bonding section 30 which is flat in the bottom surface, and it is possible to manufacture the durable female crimp terminal 10. Further, it is possible to reduce the load due to the pressure-bonding deformation acting on the pressure-bonding section 30 by pressure-bonding from all the peripheral direction at the pressure-bonding time.

Further, in the case of fixing the length in the long length direction X of the inclined step portion between the stage portions in the stepped diameter reduction portion 30*c*, an angle of incline of the step portion can be formed gently in comparison with the stepped diameter reduction portion 30*c* in the pressure-bonding section 30 which is flat in the bottom portion. Therefore, it is possible to reduce the processing load. On the contrary, in the case where the step portion is formed at a fixed angle of incline, it is possible to form the step portion such that the length in the long length direction X of the step portion is short.

FIGS. 9 and 10 show the example which is diameter-reduced in three stages. However, the number of the stages may be two or four or more.

Embodiment 2

First of all, a description will be given in detail of an insulated wire 400 and a crimp terminal 200 according to the present embodiment with reference to FIGS. 11 to 13.

Figure 11:
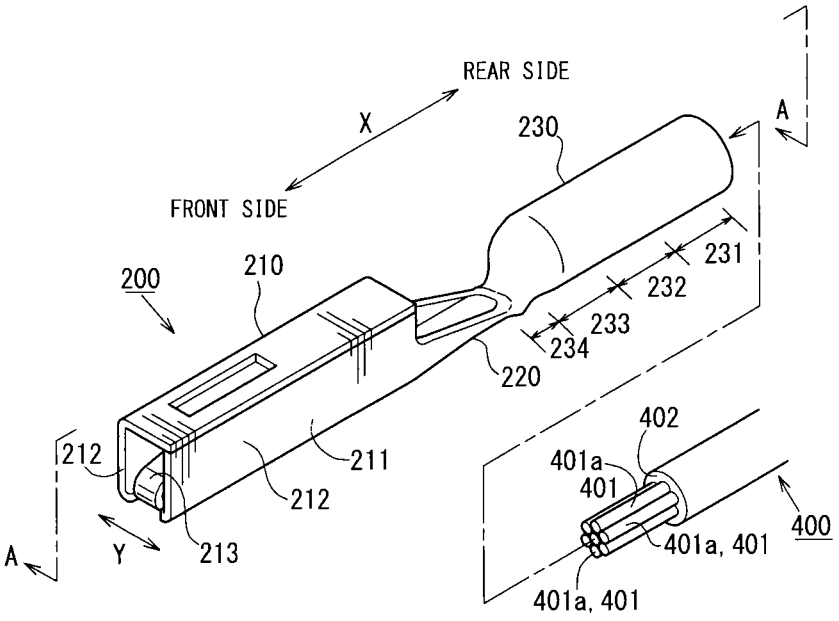
FIG. 11 is an outer appearance perspective view showing an outer appearance from the above in the insulated wire and the crimp terminal.
Figure 12A:
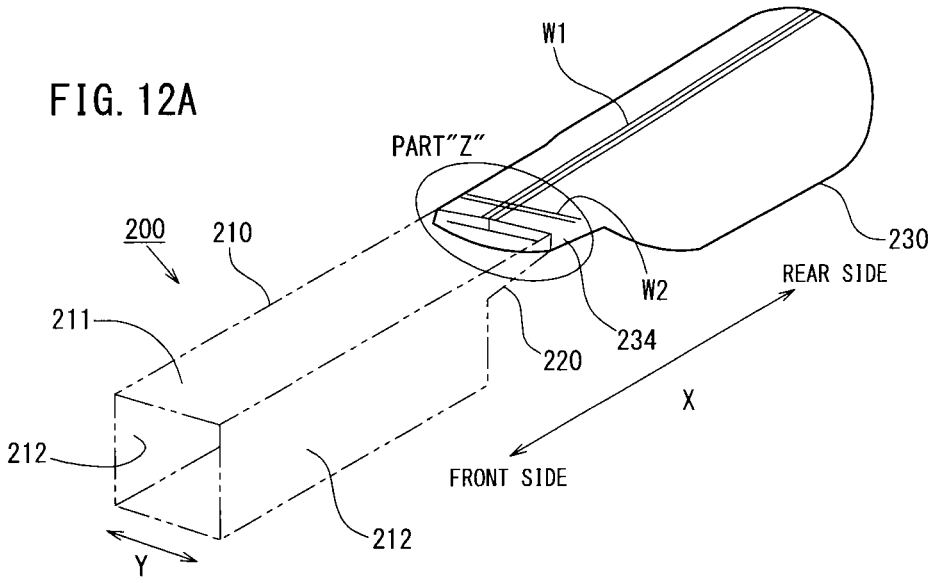
FIGS. 12A and 12B are explanatory views explaining welding in a barrel portion.
Figure 12B:
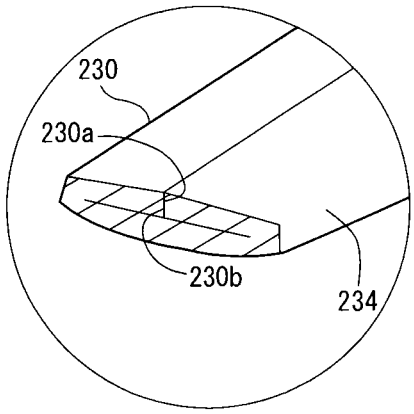
Figure 13:
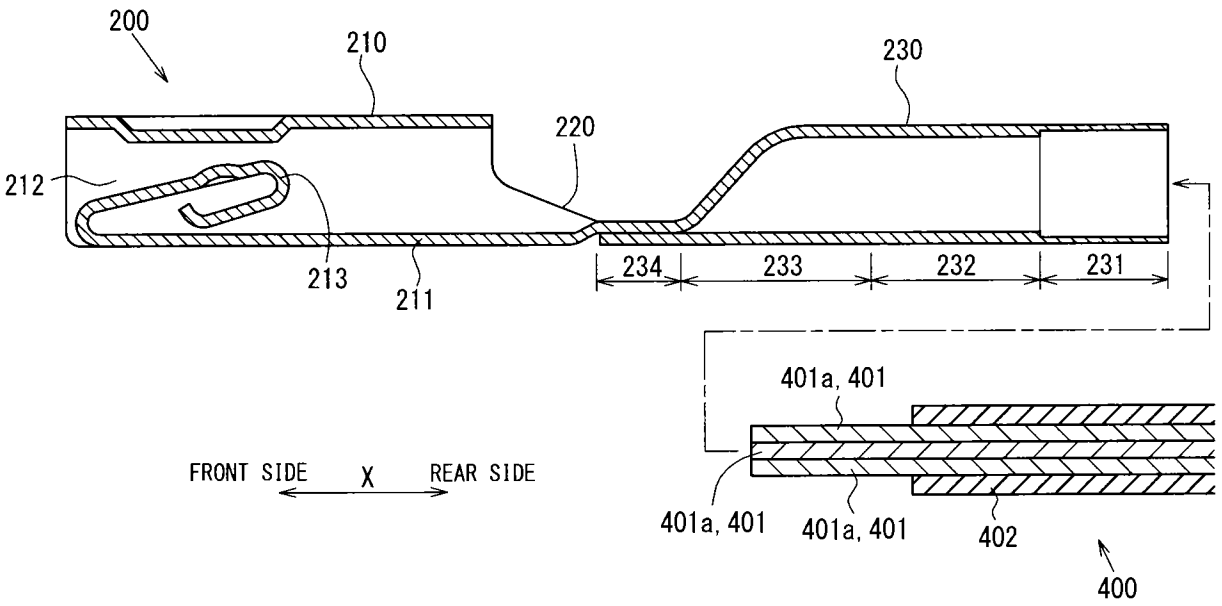
FIG. 13 is a cross sectional view as seen from an arrow A-A in FIG. 11.

FIG. 11 shows a perspective view of an outer appearance from the above in the insulated wire 400 and the crimp terminal 200, FIG. 12 shows an explanatory view explaining welding in a barrel portion 230, and FIG. 13 shows a cross sectional view as seen from an arrow A-A in FIG. 11.

Further, in FIG. 11, an arrow X indicates a long length direction (hereinafter, refer to as "long length direction X"), and an arrow Y indicates a width direction (hereinafter, refer to as "width direction Y"). Further, a side of a box portion 210 mentioned later (a left side in the drawing) is set to a front side, and a side of the insulated wire 400 mentioned later in relation to the box portion 210 is set to a rear side, in the long length direction X.

Further, FIG. 12A shows a schematically perspective view of a bottom surface side of the crimp terminal 200 while setting the box portion 210 to a permeable state shown by a two-dot chain line, and FIG. 12B shows an enlarged view of a part "Z" in FIG. 12A.

The insulated wire 400 is structured, as shown in FIGS. 11 and 13, such that an aluminum core wire 401 obtained by bundling aluminum raw wires 101*a* is coated with an insulating cover 402 which is constructed by an insulating resin. This will be described in more detail. The aluminum core wire 401 is constructed by twisting aluminum alloy wires so that a cross sectional area is 0.75 $mm^2$. Further, the insulated wire 400 exposes the aluminum core wire 401 at a predetermined length from a tip of the insulating cover 402.

The crimp terminal 200 is integrally constructed by a box portion 210 which is a female type terminal and allows insertion of a male tab of a male type terminal (not shown) from a front side toward a rear side in the long length direction X, and a barrel portion 230 which is arranged in a rear side of the box portion 210 via a transition section 220 having a predetermined length, as shown in FIGS. 11 to 13.

The crimp terminal 200 is a close barrel type terminal which is constructed by punching a copper alloy streak (not shown) such as brass having a tin plated (Sn plated) surface into a terminal shape which is expanded to a plane, thereafter bending into a stereoscopic terminal shape constructed by a box portion 210 of a hollow square columnar body and a barrel portion 230 formed into an approximately O-shaped form in a rear view, and welding the barrel portion 230.

The box portion 210 is constructed by a tilting hollow square columnar body which is formed into an approximately rectangular shape as seen from a front side in the long length direction X by folding one of side surface portions 212 continuously provided in both side portions in the width direction Y which is orthogonal to the long length direction X of the bottom surface portion 211 so as to lap over the other end portion.

Further, an inner portion of the box portion 210 is provided with an elastic contact piece 213 which is formed by extending the front side in the long length direction X in the bottom surface portion 211 and folding toward the rear side in the long length direction X, and comes into contact with the insertion tab (not shown) of the inserted male type terminal.

The barrel portion 230 is constructed by integrating a weak pressure-bonding section 231 which pressure-bonds the insulating cover 402, a cover pressure-bonding section 232, and a core wire pressure-bonding section 233 which pressure-bonds the exposed aluminum core wire 401 in this order from the rear side, and is constructed by a sealing portion 234 which is deformed so as to crush a front end portion of the core wire pressure-bonding section 233 into an approximately tabular shape.

The barrel portion 230 is formed into an approximately O-shaped form in a rear view by rounding the barrel portion 230 in the copper alloy streak punched into the terminal shape to a magnitude surrounding an outer periphery of the insulated wire 400, and confronting rounded end portions 230*b* to each other so as to weld along a weld position W1 in the long length direction X, as shown in FIG. 12. In other words, the barrel portion 230 is formed into a closed cross sectional shape in a cross sectional shape in the width direction Y.

Further, the sealing portion 234 of the barrel portion 230 is welded and sealed along a weld position W2 in the width direction Y so as to close a front end in the long length direction X of the barrel portion 230 as shown in FIG. 12.

In other words, the barrel portion 230 is formed into an approximately tubular shape having an opening in a rear side in the long length direction X by welding and closing the end portions 230*a* and 230*b* and the front ends in the long length direction X.

Further, the weak pressure-bonding section 231 in the barrel portion 230 is formed into a smaller thickness than a thickness of the cover-pressure bonding section 232 when the copper alloy streak is punched into the terminal shape, with a length which is approximately the same as the length in the long length direction X in the cover pressure-bonding section 232, as shown in FIG. 13.

Further, in a state of being rounded to the magnitude surrounding the outer periphery of the insulated wire 400, the weak pressure-bonding section 231 is formed into a shape having an outer diameter which is approximately the same as an outer diameter of the cover pressure-bonding section 232, and having an inner diameter which is larger than an inner diameter of the cover pressure-bonding section 232.

Next, a description will be given in detail of a process of inserting the insulated wire 400 to the barrel portion 230 of the crimp terminal 200 having the structure mentioned above and caulking and pressure-bonding the barrel portion 230, and a pressure-bonding connection structural body 1A of a post-pressure-bonding state, with reference to FIG. 14.

Figures 14A, 14B:
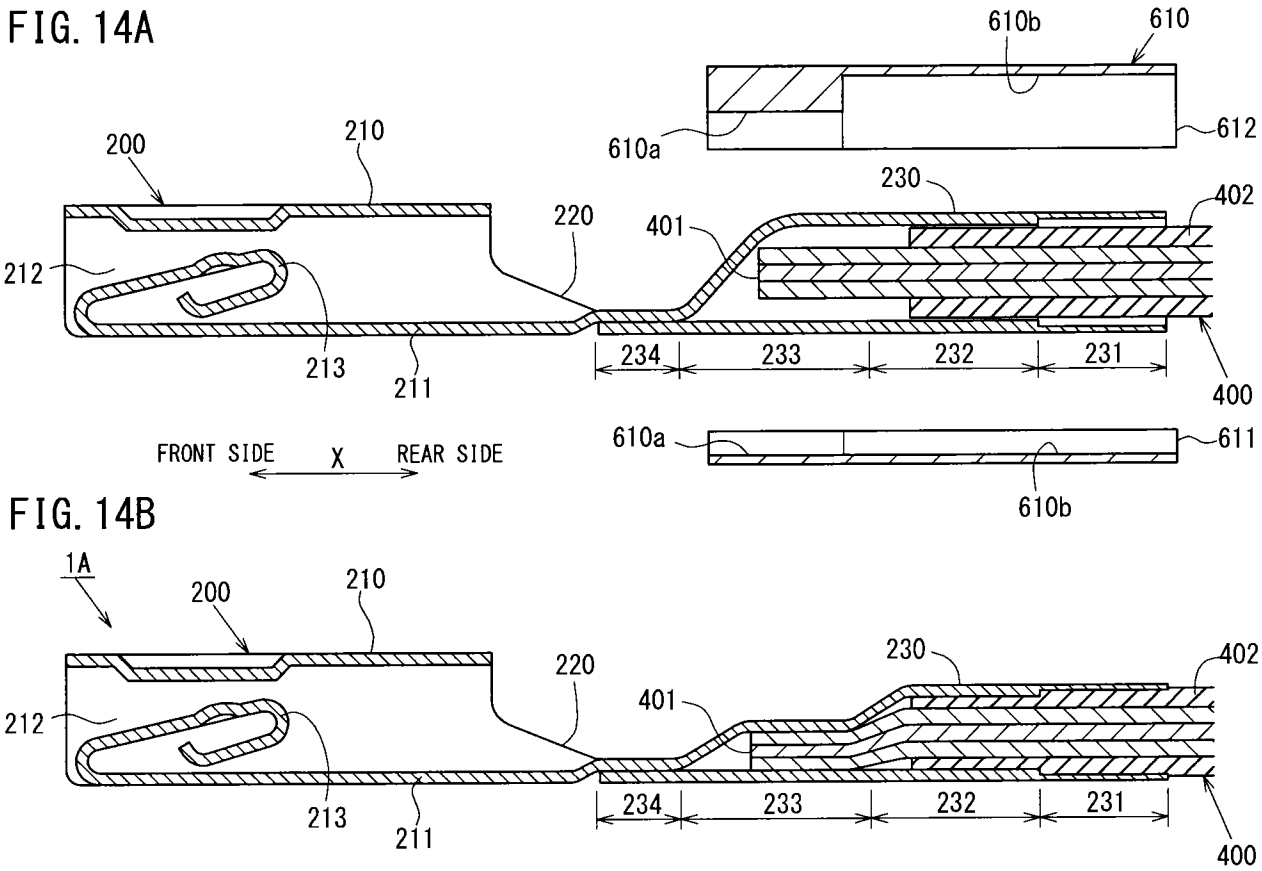
FIGS. 14A and 14B are explanatory views explaining states before and after caulking in the insulated wire and the crimp terminal.

FIG. 14 shows an explanatory view explaining states before and after caulking in the insulated wire 400 and the crimp terminal 200, FIG. 14A shows an explanatory view explaining a state before caulking the crimp terminal 200 to which the insulated wire 400 is inserted by a crimp tool 610, and FIG. 14B shows a cross sectional view of a cross sectional shape of the pressure-bonding connection structural body 1A to which the insulated wire 400 and the crimp terminal 200 are connected.

The insulated wire 400 from which the aluminum core wire 401 is exposed from a rear side is inserted to an inner portion, as shown in FIG. 14A, in relation to the barrel portion 230 of the crimp terminal 200 mentioned above. At this time, the insulated wire is inserted so that the exposed aluminum core wire 401 is arranged in the core wire pressure-bonding section 233.

Thereafter, the barrel portion 230 of the crimp terminal 200 to which the insulated wire 400 is inserted so as to be pinched by a set of crimp tool 610 which is constructed by an anvil and a crimper, as shown in FIG. 14A.

The one set of crimp tools 610 is constructed by a first crimp mold 611 which forms the anvil, and a second crimp mold 612 which forms the crimper, as shown in FIG. 14A. Further, the crimp tool 610 is constructed by integrating a core wire caulking portion 610*a* which is formed into an inner surface shape corresponding to an outer surface shape of the core wire pressure-bonding section 233 in the post-pressure-bonding state, and a cover caulking portion 610*b* which is formed into an inner surface shape corresponding to an outer surface shape of the weak pressure-bonding section 231 and the cover pressure-bonding section 232 in the post-pressure-bonding state.

The pressure-bonding connection structural body 1A is constructed with the crimp tool 610 by caulking the weak pressure-bonding section 231, the cover pressure-bonding section 232 and the core wire pressure-bonding section 233 with a uniform force in such a manner as to pinch the barrel portion 230 of the crimp terminal 200 to which the insulated wire 400 is inserted, by one set of crimp tool 610, and pressure-bonding the insulating cover 402 and the aluminum core wire 401.

More specifically, the pressure-bonding connection structural body 1A is structured, as shown in FIG. 14B, such that the core wire pressure-bonding section 233 and the aluminum core wire 401 are pressure-bonded and can be conducted and connected by caulking the core wire pressure-bonding section 233 with the core wire caulking portion 610*a* of the crimp tool 610. Further, the cover pressure-bonding section 232 and the weak pressure-bonding section 231 are pressure-bonded and connected to the insulating cover 402 by caulking the cover pressure-bonding section 232 and the weak pressure-bonding section 231 with the cover caulking portion 610*b* of the crimp tool 610.

At this time, in the pressure-bonding connection structural body 1A, a compression amount of the insulating cover 402 by the weak pressure-bonding section 231 becomes small in comparison with a compression amount of the insulating cover 402 by the cover pressure-bonding section 232, on the basis of a difference between the inner diameter of the cover pressure-bonding section 232 and the inner diameter of the weak pressure-bonding section 231. In other words, the crimp terminal 200 is structured such that the compression force with which the weak pressure-bonding section 231 compresses the insulating cover 402 becomes small in comparison with the compression force with which the cover pressure-bonding section 232 compresses the insulating cover 402.

The insulated wire 400 is pressure-bonded and connected by caulking the barrel of the crimp terminal 200 as mentioned above, and there is constructed the pressure-bonding connection structural body 1A which secures the conductivity between the aluminum core wire 401 and the crimp terminal 200.

Next, a description will be given of a connector in which the pressure-bonding connection structural body 1A mentioned above is installed to an inner portion of a connector housing with reference to FIG. 15.

Figure 15:
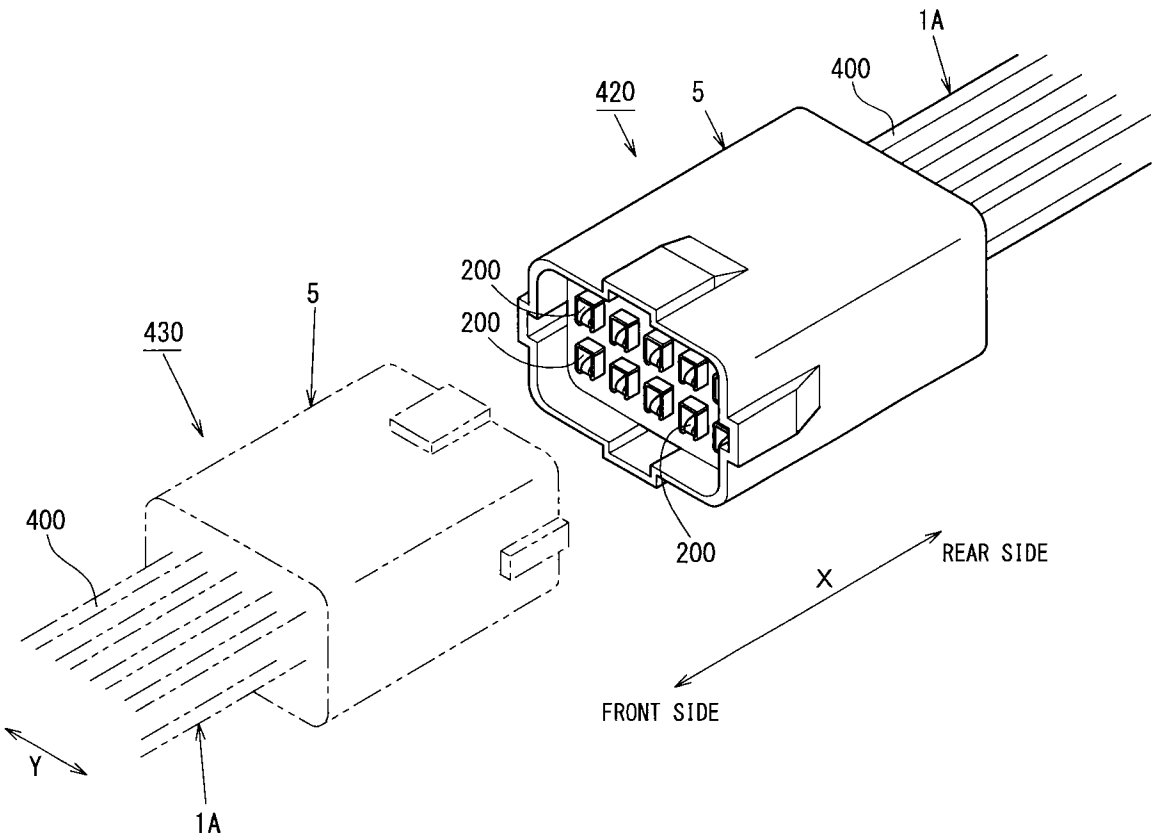
FIG. 15 is a perspective view showing a connection corresponding state of a female type connector and a male type connector.

FIG. 15 shows a perspective view of a connection corresponding state of a female type connector 521 and a male type connector 531, and the male type connector 531 is shown by a two-dot chain line in FIG. 15.

A female type connector housing 522 has a plurality of openings which can install the crimp terminal 200 along the long length direction X in its inner portion, and is formed into a box shape in which a cross sectional shape in the width direction Y is approximately formed into a rectangular shape. A wire harness 420 having the female type connector 521 is constructed by installing a plurality of pressure-bonding connection structural bodies 1A each being constructed by the crimp terminal 200 mentioned above, along the long length direction X, to an inner portion of the female type connector housing 522 mentioned above.

Further, a male type connector housing 532 corresponding to the female type connector housing 522 has a plurality of openings which can install the crimp terminal 200 in its inner portion, in the same manner as the female type connector housing 522, is formed into an approximately rectangular shape in its cross sectional shape in the width direction Y and is formed so as to be connectable to the female type connector housing 522 in a concavo-convex corresponding manner.

A wire harness 430 having the male type connector 531 is constructed by installing the pressure-bonding connection structural body 1A constructed by a male crimp terminal (not shown) along the long length direction X to an inner portion of the male type connector housing 532 mentioned above.

Further, the wire harness 420 and the wire harness 430 are connected by fitting the female type connector 521 and the male type connector 531.

The crimp terminal 200, the pressure-bonding connection structural body 1A and the female type connector 521 achieving the structure mentioned above can secure a stable water-blocking performance.

Specifically, since the insulated wire 400 is pressure-bonded by caulking the barrel portion 230 with the uniform force, the weak pressure-bonding section 231 can compress the insulating cover 402 with the compression force which is smaller than the compression force with which the cover pressure-bonding section 232 compresses the insulating cover 402. More specifically, it is possible to make the compression amount of the insulating cover 402 by the weak pressure-bonding section 231 smaller than the compression amount of the insulating cover 402 by the cover pressure-bonding section 232.

Further, it is possible to enlarge the compression amount of the insulating cover 402 by the weak pressure-bonding section 231 according to the increase of the load caulking the barrel portion 230. Namely, the crimp terminal 200 can retain the insulated wire 400 even by the weak pressure-bonding section 231 in addition to the cover pressure-bonding section 232. In other words, the crimp terminal 200 can block the moisture intrusion into the inner portion of the barrel portion from the insulated wire 400 side by the cover pressure-bonding section 232 and the weak pressure-bonding section 231.

Further, in the case of caulking the cover pressure-bonding section 232, for example, until the insulating cover 402 is damaged, the crimp terminal 200 can compress and retain the insulating cover 402 with the weak pressure-bonding section 231. As a result, the crimp terminal 200 can block the moisture intrusion into the inner portion of the barrel portion from the insulated wire 400 side by the weak pressure-bonding section 231 which is formed in the insulated wire 400 side of the cover pressure-bonding section 232.

This will be described in more detail. A description will be given of a collapsing amount of the barrel portion from a state of coming into contact with the insulating cover 402 with reference to FIG. 16 showing an explanatory view which explains comparison between the present embodiment and the prior art in relation to the collapsing amount.

Figures 16A, 16B:
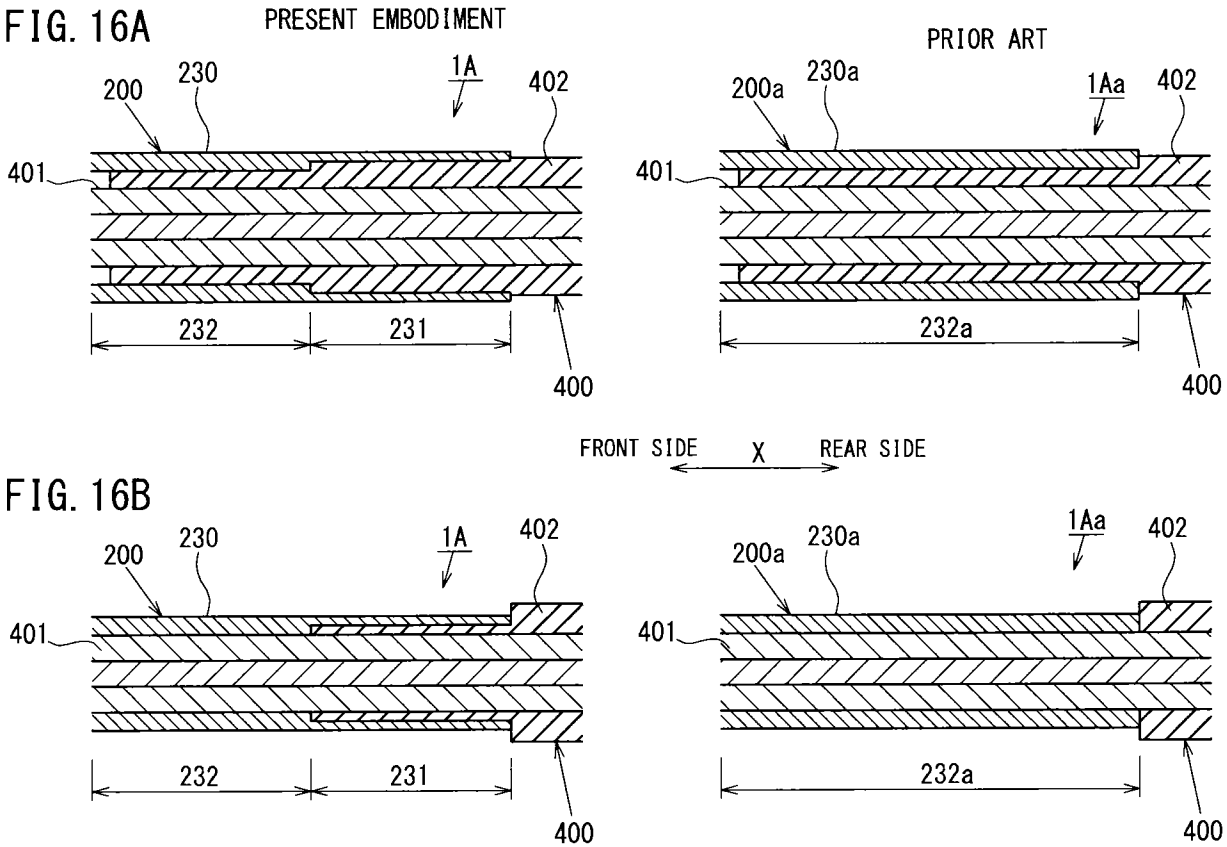
FIGS. 16A and 16B are explanatory views explaining comparison between the present embodiment and a prior art in relation to a collapsing amount of the barrel portion from a state of being contact with an insulating cover.

FIG. 16A shows the case that the collapsing amount of the barrel portion from the state of coming into contact with the insulating cover 402 is smaller than 0.6 mm, and FIG. 16B shows the case that the collapsing amount of the barrel portion from the state of coming into contact with the insulating cover 402 is equal to or more than 0.6 mm and smaller than 0.8 mm. Further, a left side in FIG. 16 shows the pressure-bonding connection structural body 1A in the present embodiment, and a right side shows the pressure-bonding connection structural body 1Aa in the prior art.

The pressure-bonding connection structural body 1Aa is constructed by pressure-bonding the insulated wire 400 and the crimp terminal 200*a* mentioned above as shown in FIG. 16. The crimp terminal 200*a* constructs a barrel portion 230*a* by a cover pressure-bonding section 232*a*, a core wire pressure-bonding section (not shown), and a sealing portion.

Here, a thickness of the insulating cover 402 is set to 0.3 mm, thicknesses of the cover pressure-bonding section 232, and the cover pressure-bonding section 232*a* are set to 0.25 mm, and the weak pressure-bonding section 231 is formed 0.1 mm thinner than the cover pressure-bonding section 232.

In the case where the collapsing amount of the barrel portion from the state of being in contact with the insulating cover 402 is smaller than 0.6 mm, the pressure-bonding connection structural body 1A in the present embodiment and the pressure-bonding connection structural body 1Aa in the prior art are respectively structured, as shown in FIG. 16A, such that the cover pressure-bonding section 232 and the cover pressure-bonding section 232*a* compress the insulating cover 402 so as to retain the insulated wire 400, and it is possible to secure the water-blocking performance.

In the case where the collapsing amount of the barrel portion from the state of being in contact with the insulating cover 402 is equal to or more than 0.6 mm, and smaller than 0.8 mm, the pressure-bonding connection structural body 1Aa in the prior art cannot maintain the water-blocking performance against the moisture intrusion from the insulated wire 400 side since the insulating cover 402 is sheared by the end portion of the cover pressure-bonding section 232*a*, as shown in FIG. 16B.

On the other hand, the pressure-bonding connection structural body 1A in the present embodiment can secure the water-blocking performance against the moisture intrusion from the insulated wire 400 side, since the weak pressure-bonding section 231 maintains the state of compressing the insulating cover 402 in spite of the fact that the insulating cover 402 is sheared by the end portion of the cover pressure-bonding section 232.

More specifically, in comparison with the case that the moisture intrusion into the inner portion of the barrel portion from the insulated wire 400 side is blocked only by the cover pressure-bonding section 232, the crimp terminal 200 can enlarge the collapsing amount of the barrel portion 230 until the water-blocking performance is deteriorated, by integrally forming the weak pressure-bonding section 231.

As a result, the crimp terminal 200 can prevent the insulating cover 402 from being damaged by the dispersion of the collapsing amount of the cover pressure-bonding section 232 at the caulking time of the barrel portion 230, and prevent the insecure water-blocking performance against the moisture intrusion into the inner portion of the barrel portion 230 from the insulated wire 400 side, by means of the weak pressure-bonding section 231.

Therefore, since the crimp terminal 200 is provided with the weak pressure-bonding section 231 in relation to the dispersion of the collapsing amount of the barrel portion 230, it is possible to secure the stable water-blocking performance.

Further, since the weak pressure-bonding section 231 is formed thinner than the thickness of the cover pressure-bonding section 232, it is possible to differentiate the compression amount of the insulating cover 402 by the cover pressure-bonding section 232, and the compression amount of the insulating cover 402 by the weak pressure-bonding section 231, even if the barrel portion 230 is caulked by the uniform force. In other words, the crimp terminal 200 can save the man hour for caulking the cover pressure-bonding section 232 and the weak pressure-bonding section 231 with the different forces.

As a result, the crimp terminal 200 can caulk the weak pressure-bonding section 231 so as to pressure-bond the insulated wire 400 without increase of an assembling man hour at the caulking time of the barrel portion 230. Further, the existing crimp tool 610 can be used.

Therefore, the crimp terminal 200 can suppress the increase of the assembling man hour at the caulking time of the barrel portion 230, by making the thickness of the weak pressure-bonding section 231 smaller than the thickness of the cover pressure-bonding section 232.

Further, since the weak pressure-bonding section 231 is formed into the approximately cylindrical shape, the weak pressure-bonding section 231 can make the distance between the inner surfaces facing in the diametrical direction constant, in the cross section in the long length direction X. Accordingly, the weak pressure-bonding section 231 can compress the insulating cover 402 with the uniform compression force, that is, compress the insulating cover 402 with the uniform compression amount. As a result, the weak pressure-bonding section 231 can secure the more stable water-blocking performance.

As a result, even if the insulating cover 402 is damaged by the cover pressure-bonding section 232, the crimp terminal 200 can make the moisture arrival at the damaged position of the insulating cover 402 from the insulated wire 400 side harder, by the weak pressure-bonding section 231.

Therefore, the crimp terminal 200 can secure the stable conductivity by securing the more stable water-blocking performance.

Further, since the sealing portion 234 is provided in the barrel portion 230, the crimp terminal 200 can prevent the moisture intrusion from the opening in the aluminum core wire 401 side in the barrel portion 230. Further, the crimp terminal 200 can set the inner portion of the barrel portion 230 in the pressure-bonding state to the sealed state, with the sealing portion 234, the cover pressure-bonding section 232 and the weak pressure-bonding section 231. As a result, the crimp terminal 200 can more securely prevent the moisture intrusion into the inner portion of the barrel portion 230.

Therefore, the crimp terminal 200 can secure the complete water-blocking performance and secure the more stable conductivity by setting the inner portion of the barrel portion 230 in the pressure-bonding state to the sealed state.

Further, it is possible to construct the pressure-bonding connection structural body 1A which can secure the complete water-blocking performance only by pressure-bonding to the barrel portion 230 of the crimp terminal 200, with the crimp terminal 200 having the weak pressure-bonding section 231 mentioned above.

Therefore, the pressure-bonding connection structural body 1A can secure the more stable conductivity.

Further, since the core wire of the insulated wire 400 is constructed by the aluminum alloy and the barrel portion 230 is constructed by the copper alloy, it is possible to save weight in comparison with the insulated wire 400 having the core wire constructed by the copper wire. Further, on the basis of the secure water-blocking performance achieved by the sealing portion 234, the cover pressure-bonding section 232 and the weak pressure-bonding section 231, it is possible to prevent generation of galvanic corrosion due to the crimp terminal 200 and the insulated wire 400 which are constructed by the dissimilar metal.

Further, since the female type connector 521 is constructed by arranging the crimp terminal 200 in the pressure-bonding connection structural body 1A in the inner portion of the female type connector housing 522, the crimp terminal 200 of the female side connector 21 can be connected to the male type connector 531 while the water-blocking performance is secured at the time of connecting the crimp terminal of the male type connector 531 to the crimp terminal 200 arranged within the female type connector housing 522.

Therefore, the female type connector 521 can secure a connection state provided with the secure conductivity.

In the embodiment 2 mentioned above, the inner surface shape of the weak pressure-bonding section 231 is formed into the shape having the inner diameter which is larger than the inner diameter of the cover pressure-bonding section 232, but is not limited to this, and may be formed into an appropriate inner surface shape as shown in FIGS. 17 to 20 which show explanatory views explaining the other crimp terminal 200 and pressure-bonding connection structural body 1A, as long as the inner surface shape can reduce the compression amount of the insulating cover 402 by the weak pressure-bonding section 231 in comparison with the compression amount of the insulating cover 402 by the cover pressure-bonding section 232.

In FIGS. 17 to 20, in order to clearly show a substantial part, illustration of the box portion, the transition section, the sealing portion and the core wire pressure-bonding section in the crimp terminal 200 and the pressure-bonding connection structural body 1A is omitted.

Figure 17A:
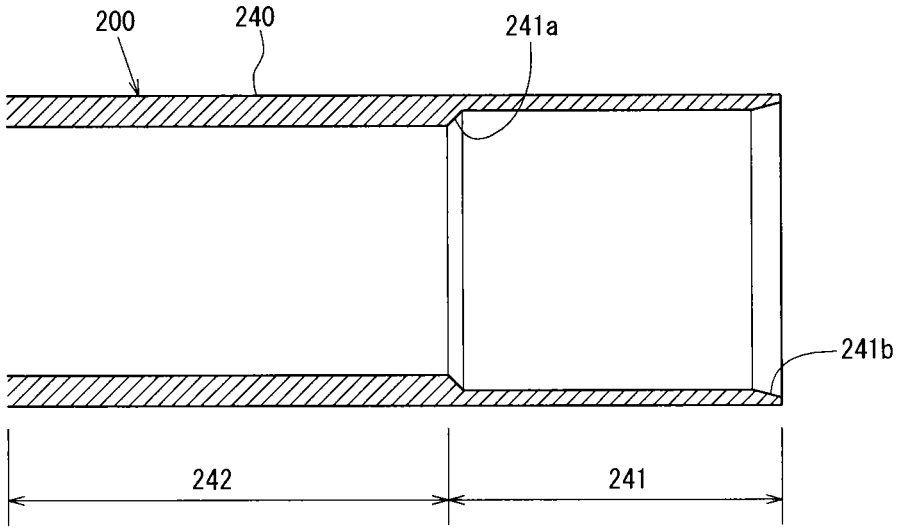
FIGS. 17A and 17B are explanatory views explaining the other cross sectional shape in the crimp terminal and a pressure-bonding connection structural body.

For example, as shown in FIG. 17A, it is possible to employ a crimp terminal 200 in which an inner surface shape of a weak pressure-bonding section 241 in a barrel portion 240 is different from that of the weak pressure-bonding section 231 in the embodiment 2 mentioned above. The inner surface shape of the weak pressure-bonding section 241 is different from the inner surface shape of the weak pressure-bonding section 231 in the embodiment 2 mentioned above in a point that an inclined surface 241*a* continuously provided in a cover pressure-bonding section 242 is formed in the cover pressure-bonding section 242 side, and a bell mouth portion 241*b* which is expanded by thinning a rear end is formed.

Figure 17B:
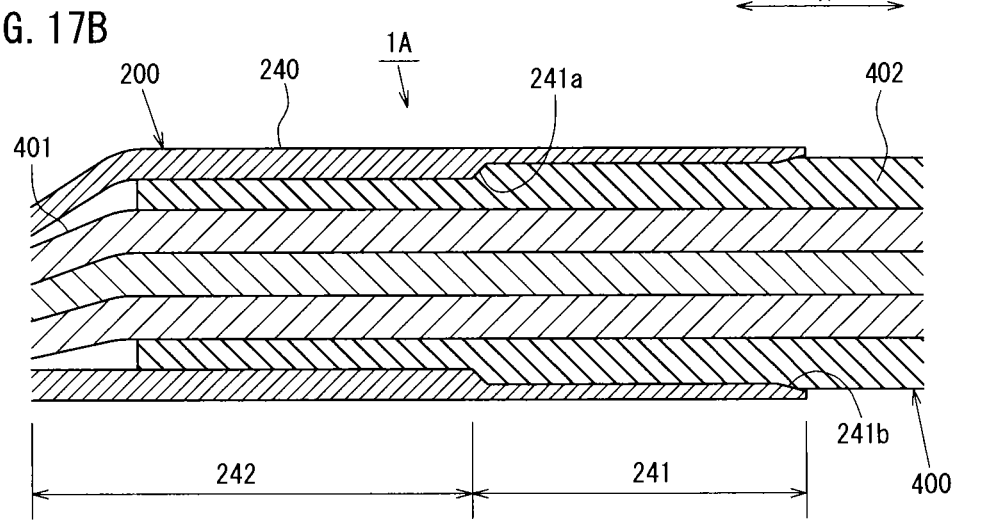

At this time, the pressure-bonding connection structural body 1A can be compressed uniformly with a compression force which is smaller than a compression force by the cover pressure-bonding section 242, by a portion between the inclined portion 241*a* and the bell mouth portion 241*b*, as shown in FIG. 17B. As a result, it is possible to achieve the same effect as that of the embodiment 2 mentioned above.

Further, on the basis of the inclined portion 241*a*, it is possible to lighten the step due to the inner diameter difference between the weak pressure-bonding section 231 and the cover pressure-bonding section 232 such as the embodiment 2 mentioned above, and it is possible to prevent the insulating cover 402 from being damaged at the caulking time of the barrel portion 240. In addition, on the basis of the bell mouth portion 241*b*, it is possible to lighten a risk that the insulating cover 402 wears or is damaged due to friction between the rear end of the barrel portion 240 and the insulating cover 402, when the insulated wire 400 is oscillated by the bell mouth portion 241*b*.

Figure 18A:
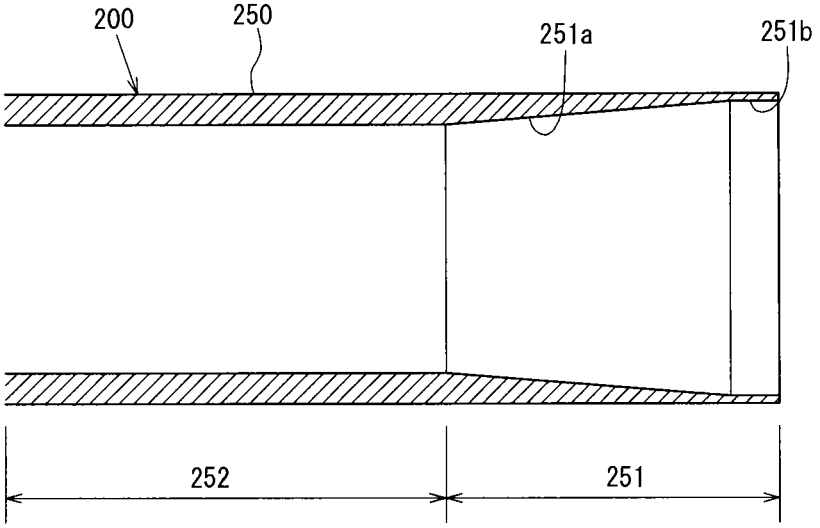
FIGS. 18A and 18B are explanatory views explaining the other cross sectional shape in the crimp terminal and the pressure-bonding connection structural body.

Further, as the other example of the crimp terminal 200, there may be provided an inner surface shape obtained by setting a cover pressure-bonding section 252 side to a small diameter, in a weak pressure-bonding section 251 having an outer diameter which is approximately the same as an outer diameter of the cover pressure-bonding section 252 in a barrel portion 250, and forming a taper portion 251*a* which is larger in an inner diameter at a rear end than an outer diameter of an insulating cover 402 and is formed approximately into a taper shape, and a rear end diameter expansion portion 251*b* which is approximately the same in an inner diameter as an inner diameter at a rear end of the taper portion 251*a* in this order from a front side, as shown in FIG. 18A.

Figure 18B:
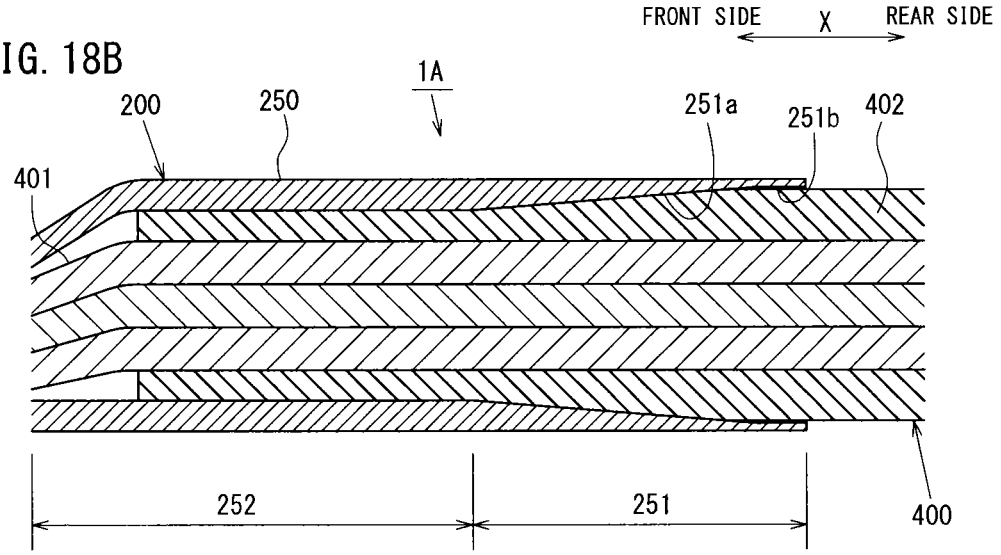

At this time, in the pressure-bonding connection structural body 1A, as shown in FIG. 18B, it is possible to further stabilize a compression force with which the weak pressure-bonding section 251 compresses the insulating cover 402. For example, in the case of the barrel portion 230 as shown in FIG. 13, the inner diameter difference between the cover pressure-bonding section 232 and the weak pressure-bonding section 231 comes to a difference between the compression amount of the insulating cover 402 by the cover pressure-bonding section 232 and the compression amount of the insulating cover 402 by the weak pressure-bonding section 231.

Accordingly, in the case where the collapsing amount of the barrel portion 230 is close to the minimum value, there is a risk that the crimp terminal 200 cannot sufficiently secure the compression amount of the insulating cover 402 by the weak pressure-bonding section 231. More specifically, there is a risk that the crimp terminal 200 cannot compress the insulating cover 402 with the stable compression force.

On the other hand, in the case where the collapsing amount of the barrel portion 230 is close to the maximum value, there is a risk that the crimp terminal 200 easily shears the insulating cover 402 due to the step on the basis of the inner diameter difference between the cover pressure-bonding section 232 and the weak pressure-bonding section 231.

The crimp terminal 200 can gently enlarge the compression force with which the weak pressure-bonding section 251 compresses the insulating cover 402 from the rear side toward the front side in the long length direction X, by forming the inner surface shape of the weak pressure-bonding section 251 in the barrel portion 250 into an approximately taper shape. Therefore, in the crimp terminal 200, it is possible to compress the insulating cover 402 with the compression force which can secure the stable water-blocking performance at any position in the long length direction X in the approximately tapered inner surface shape of the weak pressure-bonding section 251, in relation to the dispersion of the collapsing amount of the barrel portion 250.

Further, the crimp terminal 200 can prevent the weak pressure-bonding section 251 from easily shearing the insulating cover 402 by dissolving the step due to the inner diameter difference on the basis of the approximately tapered inner surface shape.

Therefore, in the crimp terminal 200, it is possible to more stably secure the water-blocking performance against the moisture intrusion from the insulated wire 400 side in the barrel portion 250, by forming the inner surface shape of the weak pressure-bonding section 251 into the approximately tapered shape.

Figure 19A:
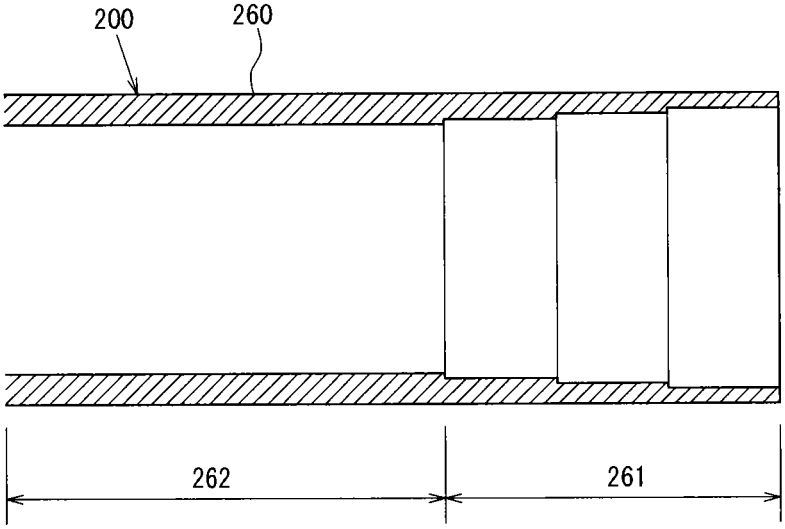
FIGS. 19A and 19B are explanatory views explaining the other cross sectional shape in the crimp terminal and the pressure-bonding connection structural body.

Further, as the other example of the crimp terminal 200, as shown in FIG. 19A, there is provided an inner surface shape which is diameter-expanded step by step from a front side toward a rear side in a long length direction X in relation to an inner diameter of a cover pressure-bonding section 262, in a weak pressure-bonding section 261 having an outer diameter which is approximately the same as an outer diameter of the cover pressure-bonding section 262 in a barrel portion 260.

Figure 19B:
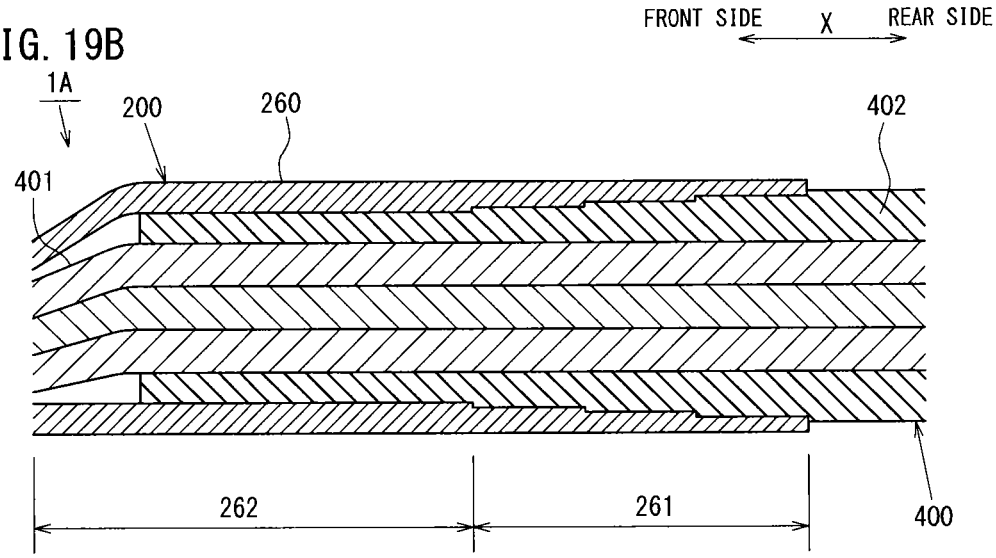

At this time, the pressure-bonding connection structural body 1A is structured, as shown in FIG. 19B, such that a boundary between the weak pressure-bonding section 261 and the insulating cover 402 is formed into a step pressure-bonding section which is diameter-reduced in a whole periphery step by step. As a result, in the case where a length in the long length direction X of the weak pressure-bonding section 261 is made equal to the length of the weak pressure-bonding section 231 in the embodiment 2, the weak pressure-bonding section 261 can complicate the moisture intrusion route from the insulated wire 400 side toward the inner portion of the barrel portion 260 in relation to the weak pressure-bonding section 231, and elongate the distance of the intrusion route.

As a result, even if the moisture enters into the inner portion of the barrel portion 260 from the insulated wire 400 side, the crimp terminal 200 can make the arriving of the entering moisture at the wire conductor hard.

Therefore, the crimp terminal 200 can more stably secure the water-blocking performance against the moisture intrusion from the insulated wire 400 side in the weak pressure-bonding section 261.

Figure 20A:
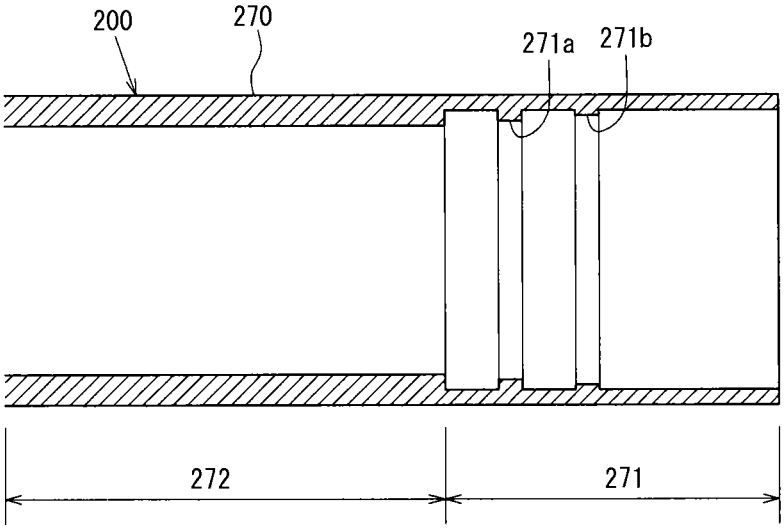
FIGS. 20A and 20B are explanatory views explaining the other cross sectional shape in the crimp terminal and the pressure-bonding connection structural body.

Further, as the other example of the crimp terminal 200, as shown in FIG. 20A, there may be provided an inner surface shape which is diameter-expanded into a larger inner diameter than an inner diameter of a cover pressure-bonding section 272 in a weak pressure-bonding section 271 having an outer diameter which is approximately the same as an outer diameter of the cover pressure-bonding section 272 in a barrel portion 270, and has annular protruding portions 271*a* and 271*b* protruding toward an inner side in a diametrical direction. Here, a protruding height of the annular protruding portion 271*b* positioned at the rear side is formed to be smaller than a protruding height of the annular protruding portion 271*a*.

Figure 20B:
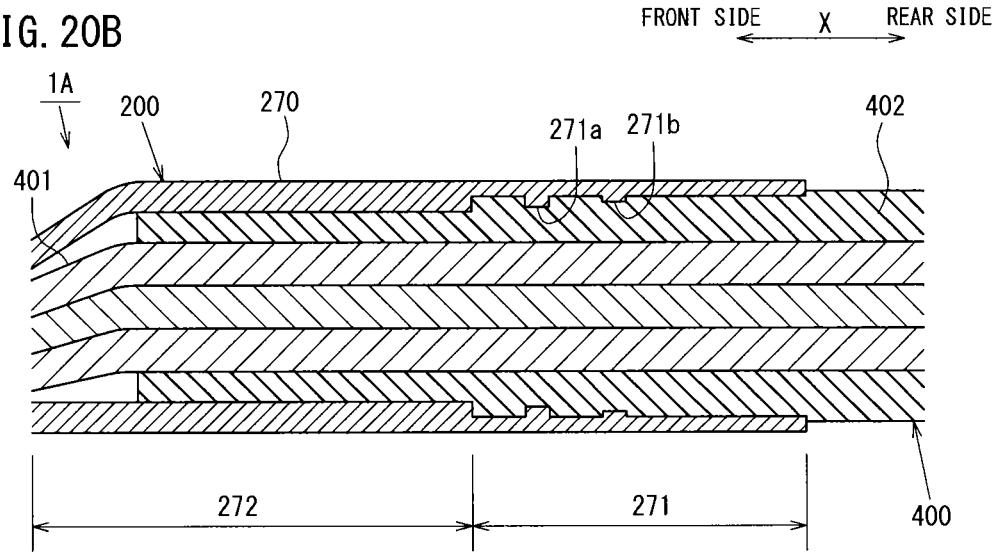

At this time, the pressure-bonding connection structural body 1A is structured, as shown in FIG. 20B, such that the weak pressure-bonding section 271 can compress the insulating cover 402 with a smaller compression force than the compression force by the cover pressure-bonding section 272. Further, it is possible to pressure-bond so that the annular protruding portions 271*a* and 271*b* bite the insulating cover 402. As a result, in the case where a length in the long length direction X of the weak pressure-bonding section 271 is made equal to the length of the weak pressure-bonding section 231 according to the embodiment 2, the weak pressure-bonding section 271 can further complicate the moisture intrusion route from the insulated wire 400 side toward the inner portion of the barrel portion 270 in relation to the weak pressure-bonding section 231.

Therefore, the crimp terminal 200 can more stably secure the water-blocking performance against the moisture intrusion from the insulated wire 400 side in the weak pressure-bonding section 271.

Further, the length in the long length direction X of the weak pressure-bonding section 231 is set to the length which is approximately the same as the length in the long length direction X in the cover pressure-bonding section 232, but is not limited to this length, and may be set to a length which can secure the water-blocking performance against the moisture intrusion from the insulated wire 400 into the inner portion of the barrel portion 230.

Embodiment 3

Next, a description will be given of a crimp terminal 300 having a different structure of a weak pressure-bonding section 331 from the embodiment 2, and the pressure-bonding connection structural body 1A with reference to FIGS. 21 and 22.

Figure 21:
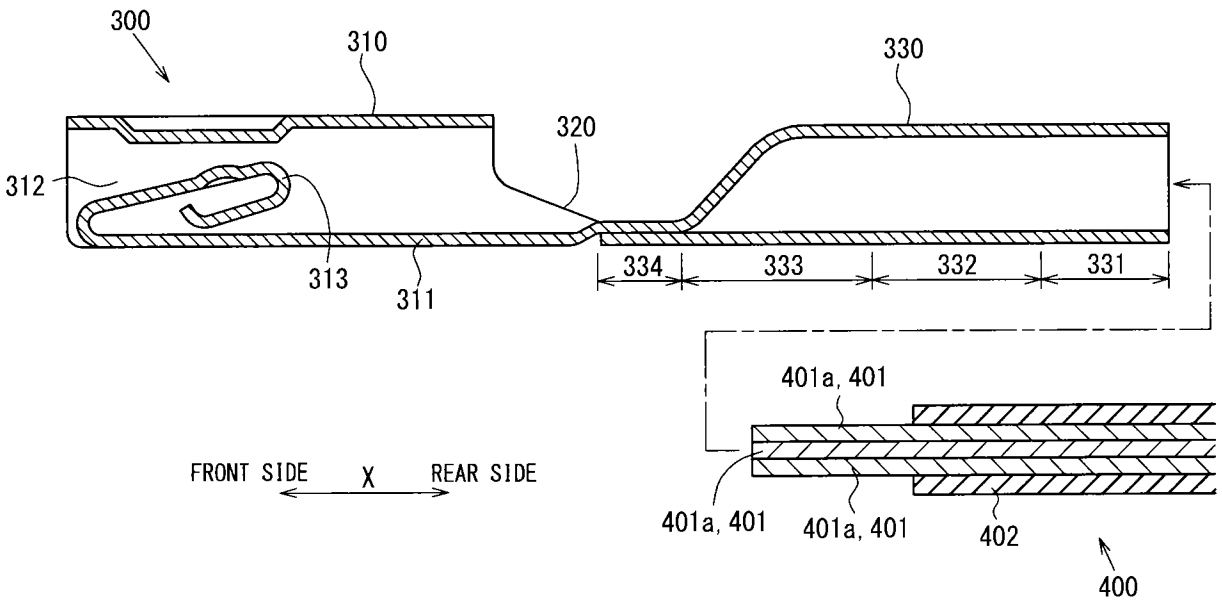
FIG. 21 is a cross sectional view showing a cross sectional shape of an insulated wire and a crimp terminal according to an embodiment 3.

FIG. 21 shows a cross sectional view of a cross sectional shape of the insulated wire 400 and the crimp terminal 300 in the embodiment 3, and FIG. 22 shows an explanatory view explaining a state before and after caulking in the insulated wire 400 and the crimp terminal 300 in the embodiment 3.

Figures 22A, 22B:
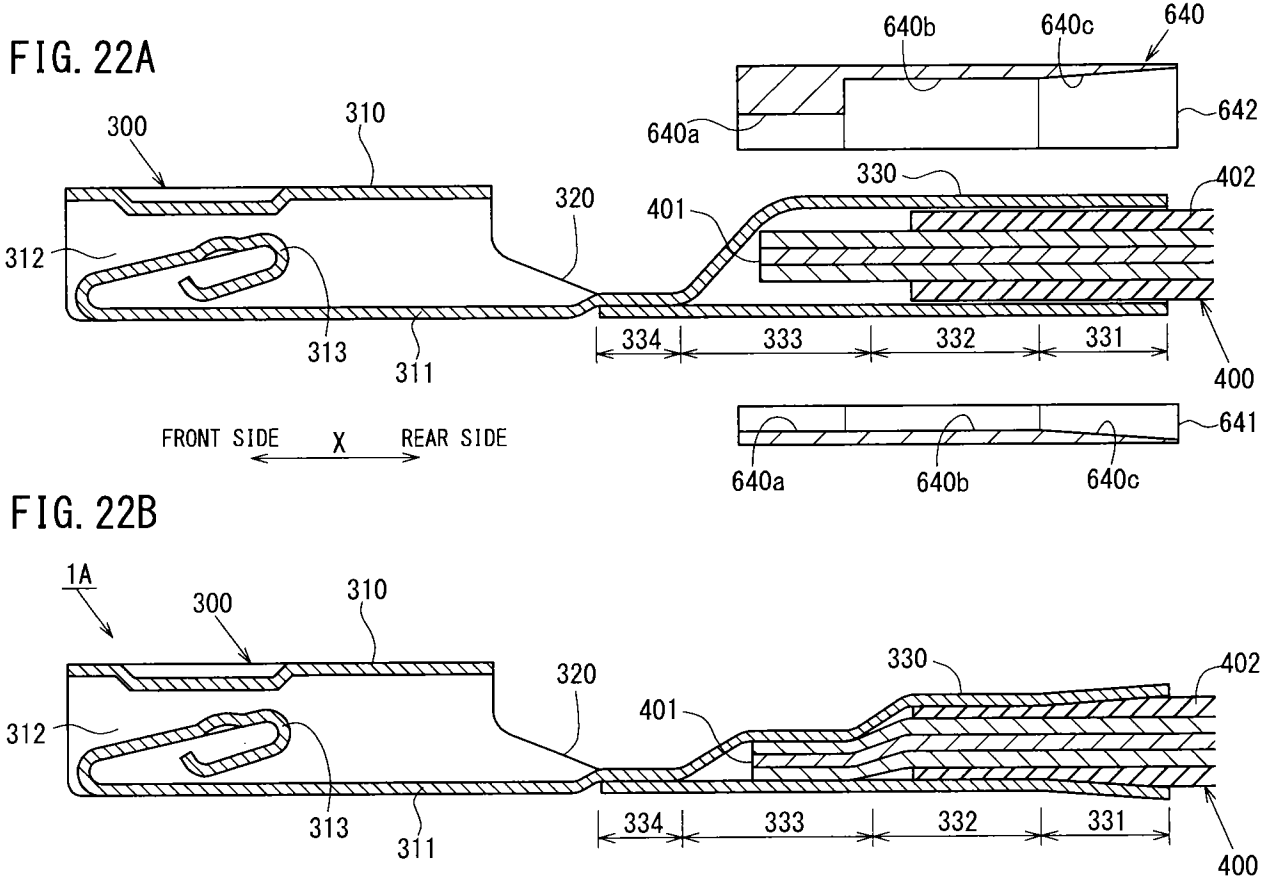
FIGS. 22A and 22B are explanatory views explaining states before and after caulking in the insulated wire and the crimp terminal according to the embodiment 3.

Further, FIG. 22A shows an explanatory view explaining a state before caulking the crimp terminal 300 to which the insulated wire 400 is inserted, by a crimp tool 640, and FIG. 22B shows a cross sectional view of a cross sectional shape of the pressure-bonding connection structural body 1A to which the insulated wire 400 and the crimp terminal 300 are connected.

The crimp terminal 300 is different in an inner surface shape of the weak pressure-bonding section 331 from the crimp terminal 200 according to the embodiment 2 mentioned above, as shown in FIG. 21. This will be described in more detail. The weak pressure-bonding section 331 of a barrel portion 330 is formed with inner and outer diameters which are approximately identical to inner and outer diameters of a cover pressure-bonding section 332, as shown in FIG. 21.

Since a box portion 310, a transition section 320, a sealing portion 334 of the barrel portion 330, a core wire pressure-bonding section 333, and the cover pressure-bonding section 332 have the same structures as the box portion 210, the transition section 220, the sealing portion 234, the core wire pressure-bonding section 233 and the cover pressure-bonding section 232 in the embodiment 2 mentioned above, a detailed description will be omitted here.

Next, a description will be given in detail of a process of inserting the insulated wire 400 to the barrel portion 330 of the crimp terminal 300 having the structure mentioned above and caulking the barrel portion 330 so as to pressure-bond, and the pressure-bonding connection structural body 1A of a post-pressure-bonding state with reference to FIG. 22.

The insulated wire 400 in which the aluminum core wire 401 is exposed from a rear side is inserted to an inner portion, as shown in FIG. 22A, in relation to the barrel portion 330 of the crimp terminal 300 mentioned above. At this time, the insulated wire is inserted so that the exposed aluminum core wire 401 is arranged in the core wire pressure-bonding section 333.

Therefore, as shown in FIG. 22A, the barrel portion 330 of the crimp terminal 300 to which the insulated wire 400 is inserted is caulked so as to be pinched by one set of crimp tool 640 which is constructed by an anvil and a crimper.

The one set of crimp tool 640 is constructed by a first crimp mold 641 which forms the anvil, and a second crimp mold 642 which forms the crimper, as shown in FIG. 22A. Further, the crimp tool 640 is constructed by integrating a core wire caulking portion 640*a* which is formed into an inner surface shape corresponding to an outer surface shape of the core wire pressure-bonding section 333 in the post-pressure-bonding state, a first cover caulking portion 640*b* which is formed into an inner surface shape corresponding to an outer surface shape of the cover pressure-bonding section 332 in the post-pressure-bonding state, and a second cover caulking portion 640*c* which is formed into an inner surface shape corresponding to an outer surface shape of the weak pressure-bonding section 331 in the post-pressure-bonding state.

This will be described in more detail. The second cover caulking portion 640*c* is formed into an approximately tapered inner surface shape which is small in diameter in the first cover caulking portion 640*b*.

The pressure-bonding connection structural body 1A is constructed with the crimp tool 640 by caulking the weak pressure-bonding section 331, the cover pressure-bonding section 332 and the core wire pressure-bonding section 333 with a uniform force in such a manner as to pinch the barrel portion 330 of the crimp terminal 300 to which the insulated wire 400 is inserted, by means of the one set of the crimp tool 640 mentioned above, and pressure-bonding the insulating cover 402 and the aluminum core wire 401.

More specifically, the pressure-bonding connection structural body 1A is structured, as shown in FIG. 22B, such that the core wire pressure-bonding section 333 and the aluminum core wire 401 are pressure-bonded and connected in a conductible manner, by caulking the core wire pressure-bonding section 333 by the core wire caulking portion 640*a* of the crimp tool 640. Further, the cover pressure-bonding section 332 and the weak pressure-bonding section 331, and the insulating cover 402 are pressure-bonded and connected by caulking the cover pressure-bonding section 332 and the weak pressure-bonding section 331 by the first cover caulking portion 640*b* and the second cover caulking portion 640*c*.

At this time, the weak pressure-bonding section 331 is formed into an approximately tapered shape which has approximately the same thickness as the cover pressure-bonding section 332 and is small in diameter in a front side, in a cross section in the long length direction X. As a result, in the pressure-bonding connection structural body 1A, a compression amount of the insulating cover 402 by the weak pressure-bonding section 331 becomes gently smaller from the front side toward the rear side, in relation to the compression amount of the insulating cover 402 by the cover pressure-bonding section 332.

Namely, in the pressure-bonding connection structural body 1A, the weak pressure-bonding section 331 is formed so that the compression force compressing the insulating cover 402 becomes gently smaller from the front side toward the rear side than the compression force with which the cover pressure-bonding section 332 compresses the insulating cover 402.

The insulated wire 400 is pressure-bonded and connected by caulking the barrel of the crimp terminal 300 as mentioned above, and there is constructed the pressure-bonding connection structural body 1A which secures the conductivity between the aluminum core wire 401 and the crimp terminal 300.

The crimp terminal 300 and the pressure-bonding connection structural body 1A having the structure mentioned above can achieve the same effects as the embodiment 2 mentioned above.

Further, since the pressure-bonding method of the crimp terminal 300 forms the weak pressure-bonding section 331 at the caulking time of the barrel portion 330 in relation to the insulating cover 402, it is possible to more securely form the weak pressure-bonding section 331 while the deformation of the cover pressure-bonding section 332 is followed at the pressure-bonding time.

As a result, the pressure-bonding method of the crimp terminal 300 can inhibit the weak pressure-bonding section 331 from deforming into an irregular shape at the pressure-bonding time, and can uniformly compress the insulating cover 402, in comparison with the case that the weak pressure-bonding section 331 is previously formed in the barrel portion 330.

Further, since the weak pressure-bonding section 331 can be formed at the same time of the process of caulking and pressure-bonding the barrel portion 330 in relation to the insulating cover 402, the pressure-bonding method of the crimp terminal 300 can make any special process of forming the weak pressure-bonding section 331 unnecessary.

Therefore, the pressure-bonding method of the crimp terminal 300 can efficiently form the weak pressure-bonding section 331, and can secure the more complete water-blocking performance.

In the embodiment 3 mentioned above, the weak pressure-bonding section 331 is formed into the approximately tapered shape, but is not limited to this, and can be formed into an appropriate shape as shown in FIGS. 23 and 24 which show explanatory views explaining the other pressure-bonding connection structural body 1A as long as the compression amount of the insulating cover 402 by the weak pressure-bonding section 331 can be made smaller than the compression amount of the insulating cover 402 by the cover pressure-bonding section 332.

In FIGS. 23 and 24, in order to clearly illustrate a substantial part, an illustration of the box portion, the transition section, the sealing portion and the core wire pressure-bonding section in the crimp construction structural body 1A is omitted.

Figure 23A:
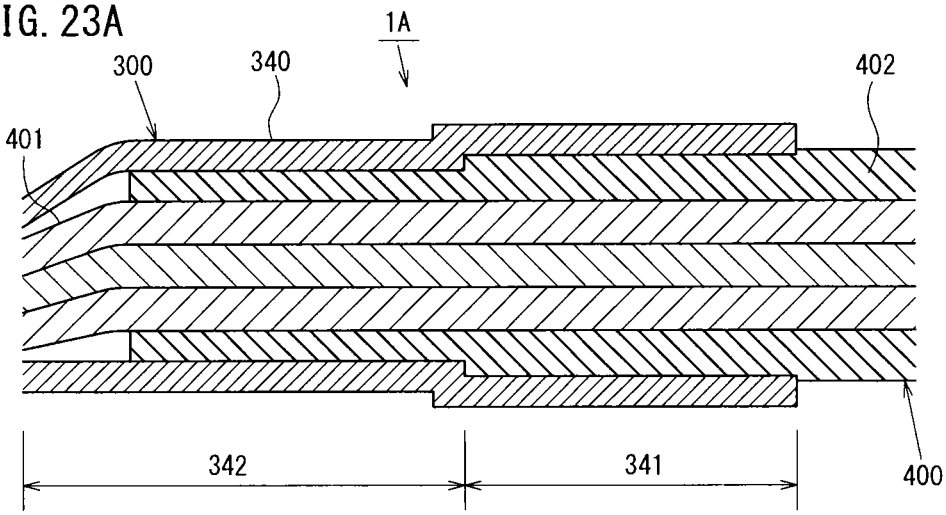
FIGS. 23A and 23B are explanatory views explaining the other cross sectional shape of a pressure-bonding connection structural body according to the embodiment 3.

For example, as shown in FIG. 23A, it is possible to form a weak pressure-bonding section 341 having inner and outer diameters which are larger than magnitudes of inner and outer diameters of the cover pressure-bonding section 342, at the caulking time of a barrel portion 340 by the crimp tool 640.

Figure 23B:
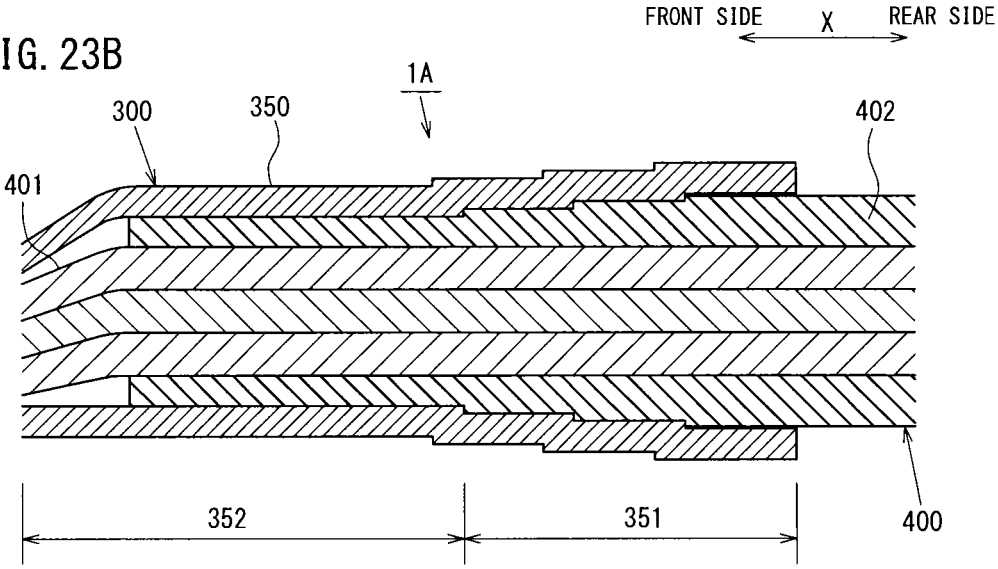

Further, as the other example of the cross sectional shape, as shown in FIG. 23B, it is possible to form a weak pressure-bonding section 351 in which inner and outer diameters are diameter-reduced step by step from a rear end in a barrel portion 350 toward a cover pressure-bonding section 352, at the caulking time of the barrel portion 350 by the crimp tool 640.

Figure 24A:
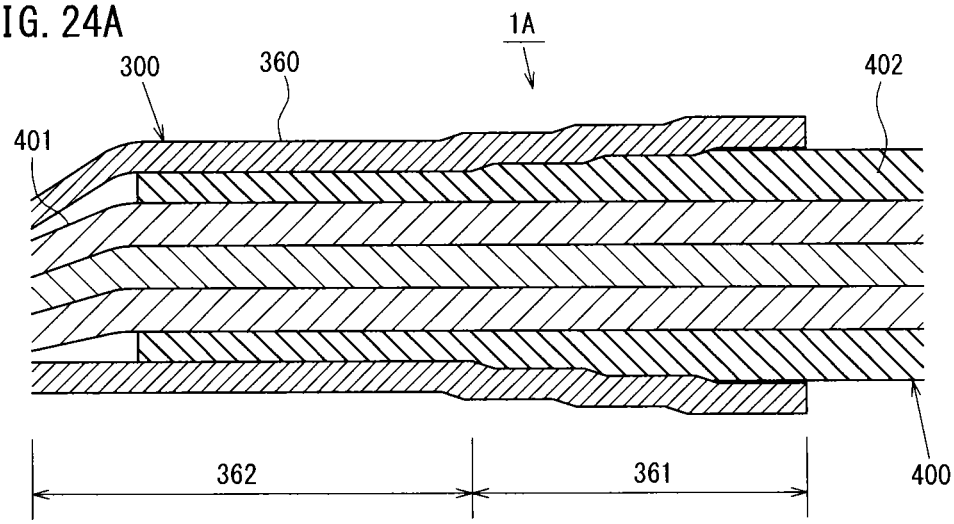
FIGS. 24A and 24B are explanatory views explaining the other cross sectional shape of a pressure-bonding connection structural body according to the embodiment 3.

Further, as the other example of the cross sectional shape, as shown in FIG. 24A, it is possible to form a weak pressure-bonding section 361 in which inner and outer diameters are diameter-reduced gently and step by step from a rear end in the barrel portion 350 toward a cover pressure-bonding section 362, at the caulking time of a barrel portion 360 by the crimp tool 640.

Figure 24B:
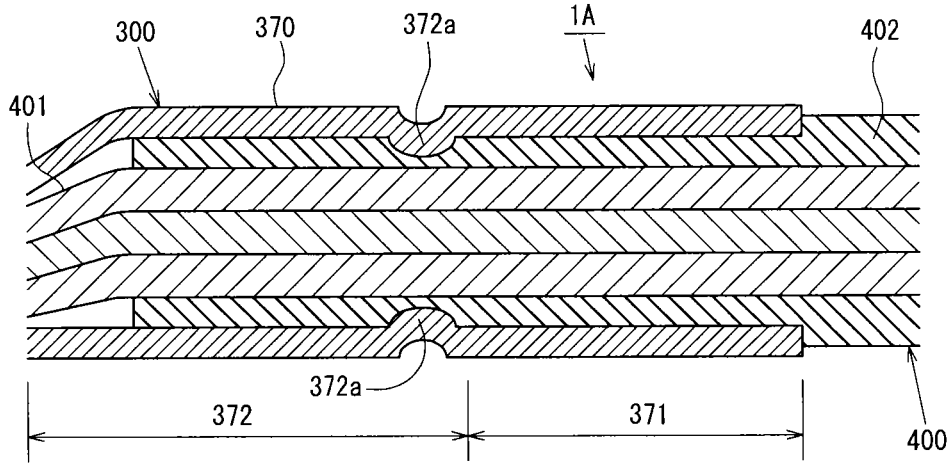

Further, as the other example of the cross sectional shape, as shown in FIG. 24B, it is possible to form a weak pressure-bonding section 371 closer to a rear side than a water-blocking protruding portion 372*a*, by forming the water-blocking protruding portion 372*a* protruding toward an inner side in a diametrical direction, in an inner peripheral surface in a rear end of a cover-pressure-bonding section 372, at the caulking time of a barrel portion 370 by the crimp tool 640.

This will be described in more detail. There is a risk that the water-blocking protruding portion 372*a* of the cover pressure-bonding section 372 collapses and damages the insulating cover 402 due to dispersion of a collapsing amount of the barrel portion 370. Accordingly, the weak pressure-bonding section 371 may be provided in a range which is closer to a rear side than the water-blocking protruding portion 372*a* and compresses the insulating cover 402 with a smaller compression amount than the compression amount of the insulating cover 402 by the water-blocking protruding portion 372*a*.

Further, the weak pressure-bonding sections 341, 351 and 361 are formed at the caulking time of the barrel portions 340, 350 and 360, but are not limited to this, and the weak pressure-bonding sections 341, 351 and 361 may be previously formed at the punching time of the copper alloy streak into the terminal shape, in the same manner as the embodiment 2 mentioned above.

Further, in the embodiment 2 and the embodiment 3 mentioned above, the crimp terminals 200 and 300 are set to the female crimp terminal, but are not limited to the above, and may be constructed by a male crimp terminal which is fitted to the female crimp terminal in the long length direction X. Alternatively, an approximately U-shaped or annular flat plate may be employed in place of the box portions 210 and 310.

Further, the core wire in the insulated wire 400 is made of the aluminum alloy, and the crimp terminals 200 and 300 are made of the copper alloy such as the brass, but are not limited to this, and the core wire in the insulated wire 400 and the crimp terminals 200 and 300 may be constructed by the same metal, for example, the copper alloy such as the brass or the aluminum alloy.

Figure 25A:
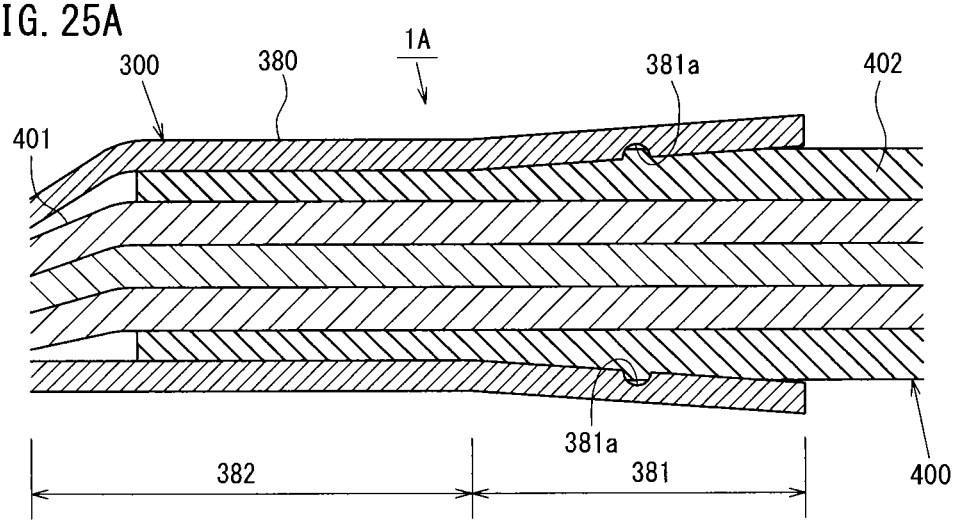
FIGS. 25A and 25B are explanatory views explaining the other cross sectional shape in the pressure-bonding connection structure.

Further, in the weak pressure-bonding section, it is possible to achieve improvement of the water-blocking performance against the moisture intrusion from the insulated wire 400 side. For example, as shown in FIG. 25A in FIG. 25 which shows an explanatory view explaining the other cross sectional shape in the pressure-bonding connection structural body 1A, a concave groove portion 381*a* which is concaved toward an outer side in a diametrical direction may be formed in an inner surface of a weak pressure-bonding section 381 in a barrel portion 380 which has a cover pressure-bonding section 382 and an approximately tapered weak pressure-blocking section 381, in a cross sectional shape in the long length direction X. As a result, it is possible to improve the water-blocking performance in the weak pressure-bonding section 381 by complicating the moisture intrusion route on the basis of the concave groove portion 381*a*, and reserving the entering moisture in the concave groove portion 381*a*, even in the case where the moisture enters from a rear side.

Figure 25B:
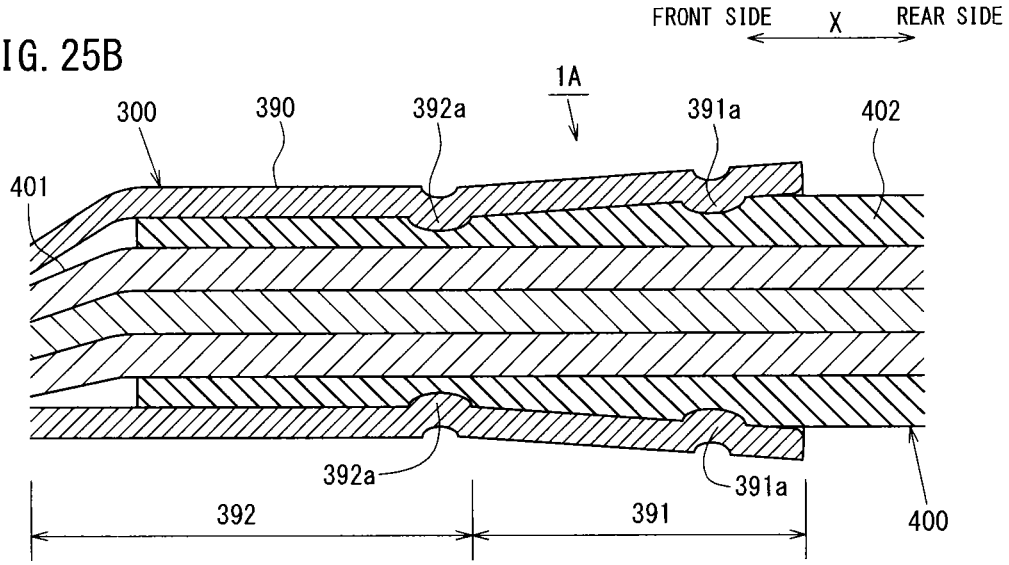

Alternatively, as shown in FIG. 25B, a water-blocking protruding portion 392*a* protruding toward an inner side in a diametrical direction may be provided in a rear end of an inner surface in a cover pressure-bonding section 392 of a barrel portion 390, and a rear end water-blocking protruding portion 391*a* protruding toward an inner side in the diametrical direction may be formed in the vicinity of a rear end in an inner surface of an approximately tapered weak pressure-bonding section 391, in a cross sectional shape in the long length direction X.

As a result, it is possible to improve the water-blocking performance in the weak pressure-bonding section 391 by complicating the moisture intrusion route on the basis of the rear end water-blocking protruding portion 391*a*, even in the case where the moisture enters from the rear side of the barrel portion 390. The water-blocking protruding portion 392*a* and the rear end water-blocking protruding portion 391*a* may be previously of the pre-pressure-bonding state, or may be formed together with the cover pressure-bonding section 392 and the weak pressure-bonding section 391 at the pressure-bonding time.

In the correspondence between the structures of the present invention and the embodiments mentioned above, the wire conductor of the present invention corresponds to the aluminum core wire 401 of the embodiments.

In the same manner, the insulating cover body corresponds to the insulating cover 402.

The conductor pressure-bonding section corresponds to the wire pressure-bonding sections 233 and 333.

The connection structural body corresponds to the pressure-bonding connection structural body 1A.

The aluminum material corresponds to the aluminum alloy.

The copper material corresponds to the copper alloy streak such as the brass.

The connector housing corresponds to the female type connector housing 522, and the male type connector housing 532.

The connector corresponds to the female type connector 521 and the male type connector 531.

However, the present invention is not limited to the structures of the embodiments mentioned above, but a number of embodiments can be obtained.

In the present embodiment, the description is given of the example in which the barrel portion 230 of the crimp terminal 200 is pressure-bonded and connected to the aluminum core wire 401 made of the less noble metal such as the aluminum or the aluminum alloy, but may be pressure-bonded and connected to a conductor portion, for example, made of a nobler metal material such as a copper or a copper alloy, in addition to the less noble metal. It is possible to achieve approximately the same operations and effects as those of the embodiments.

This will be described in more detail. Since the barrel portion 230 having the structure mentioned above can prevent the water intrusion in the pressure-bonding state, it is possible to connect the insulated wire which is necessary to be sealed in the post-pressure-bonding state for water-blocking between the wires and is constructed by the core wire such as the copper or the copper alloy.

Further, in the description mentioned above, the approximately tubular barrel portion 230 having the opening in the rear side in the long length direction X is formed by rounding the copper alloy streak punched into the terminal shape, forming into the approximately O-shaped form in the rear view by confronting the end portions 230*a* to each other and welding along the weld position W1 in the long length direction X, thereafter collapsing the front end portion in the long length direction X, sealing and welding along the weld position W2 in the width direction Y, and sealing the front end in the long length direction X by the sealing portion 234 (334), as shown in FIG. 12. However, as shown in FIG. 26 which is an explanatory view explaining the other welding method in the barrel portion 230, the barrel portion 230 may be formed by forming the shape of the barrel portion 230 and thereafter welding the weld position.

Figures 26A, 26B, 26C:
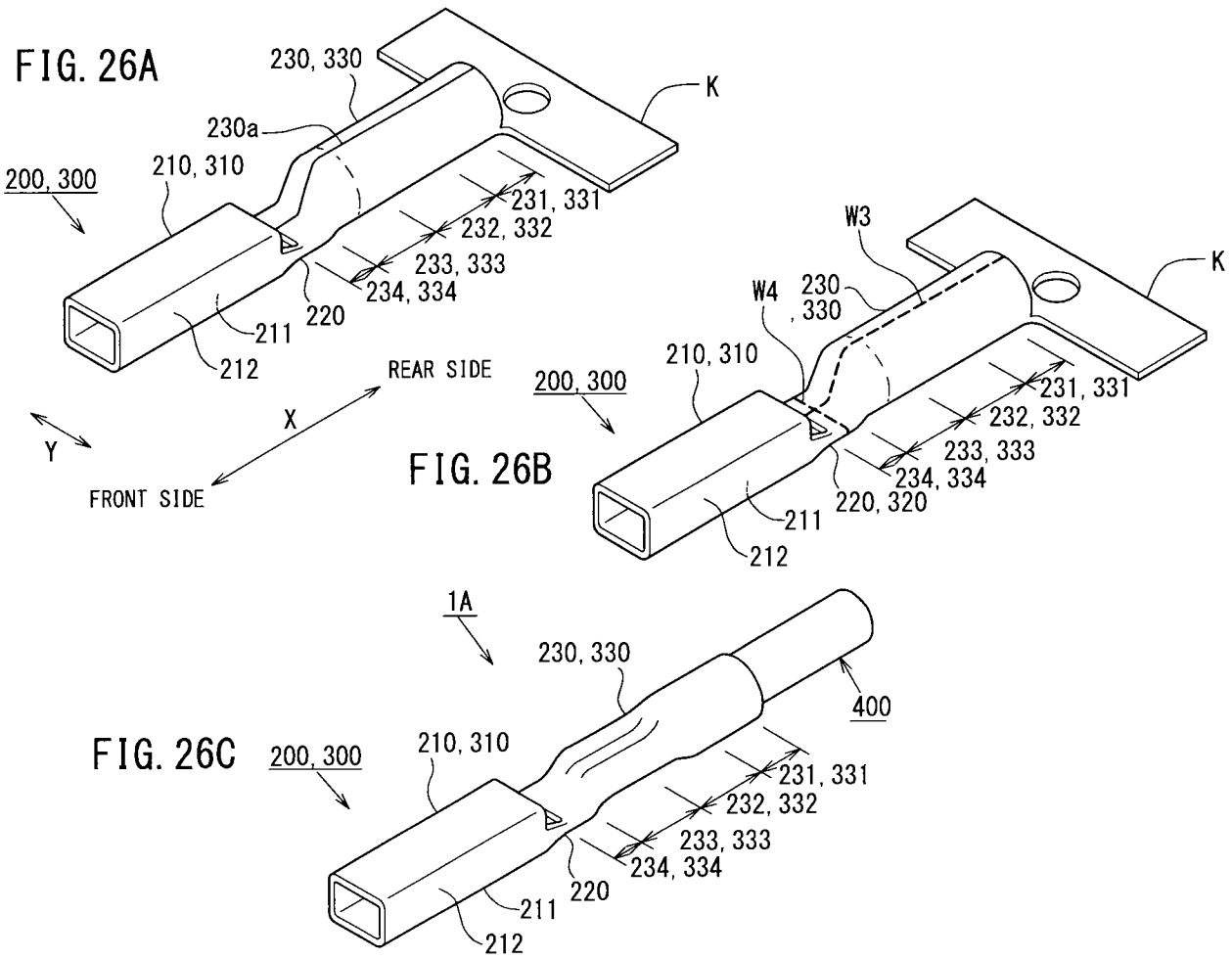
FIGS. 26A, 26B and 26C are explanatory views explaining the other welding method in the barrel portion.

This will be described in more detail. As shown in FIG. 26A, the shape of the barrel portion 230 including the sealing portion 234 (334) is previously formed by rounding the copper alloy streak punched into the terminal shape and collapsing the front end portion in the long length direction X.

Further, the barrel portion 230 is completed by welding the rounded and confronted end portions 230*a* along a weld position W3 in the long length direction X and welding and sealing along a weld position W4 in the width direction Y in the sealing portion 234 (334).

Further, the end portions 230*a* may be confronted and welded in the bottom surface side of the barrel portion 230, as shown in FIG. 12, or the end portions 230*a* may be confronted and welded in the upper surface side of the barrel portion 230, as shown in FIGS. 26A and 26B.

Further, as shown in FIG. 26C, the cover pressure-bonding section 232 (332) of the barrel portion 230 may be pressure-bonded into a circular shape in a front view in relation to the insulating cover 202 of the insulated wire 200, and the core wire pressure-bonding section 233 (333) may be pressure-bonded into an approximately U-shaped form in a front view in relation to the aluminum core wire, in the pressure-bonding state.

Further, the crimp terminal 100 may be separated from the carrier K at the pressure-bonding and connecting the insulated wire 200 or after pressure-bonding and connecting the insulated wire 200, after welding the barrel portion 230 in a state in which the crimp terminal 100 is attached to the band-like carrier K, as shown in FIG. 26, but the crimp terminal 100 may be formed in a state in which the crimp terminal 100 is separated from the carrier K and the insulated wire 200 may be pressure-bonded and connected.

Further, in the description mentioned above, the barrel portion 230 is constructed by the weak pressure-bonding section 231, the cover pressure-bonding section 232, and the core wire pressure-bonding section 233 in this order from the rear side, whereas, as shown in FIG. 27 which is an explanatory view explaining the other pressure-bonding section, the barrel portion 230 may be constructed by a stepped diameter reduction portion 235 in place of the cover pressure-bonding section 232, and the core wire pressure-bonding section 233.

The diameter reduction portion 235 is smaller in diameter than the weak pressure-bonding section 231, and is diameter-reduced step by step toward the front side in the long length direction X. Here, each of stages of the stepped diameter reduction portion 235 which is diameter-reduced step by step corresponds to a difference in the height direction, a diameter reduction amount in each of the stages corresponds to a thickness of the insulating cover 402 of the insulated wire 400, and a length in the long length direction X of each of the stages is set so as to correspond to a length of the aluminum core wire 401 in the insulated wire 400.

The stepped diameter reduction portion 235 constructed as mentioned above can achieve the secure pressure-bonding state by inserting the insulated wire 400 to the barrel portion 230 at an appropriate insertion position in the case where the pressure-bonding connection structural body 1A is constructed by inserting and pressure-bonding the insulated wires 400 having various diameters.

Figure 27A:
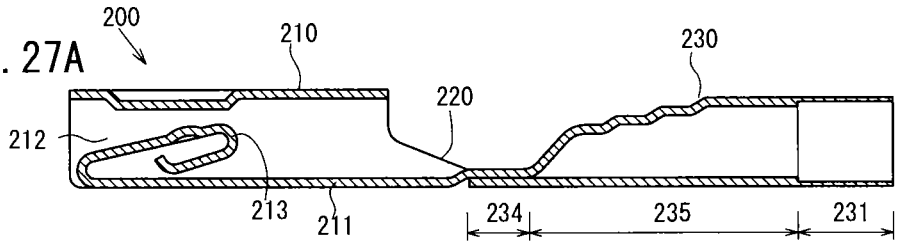
FIGS. 27A, 27B, 27C and 27D are explanatory views explaining the other pressure-bonding section.
Figure 27B:
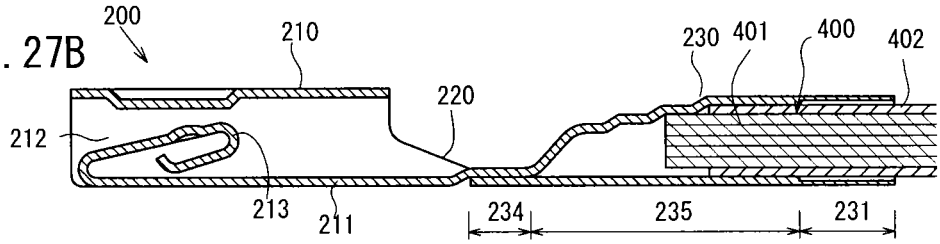

This will be described in more detail. For example, as shown in FIG. 27B, in the case of the insulated wire 400 having a large diameter, the insulated wire cannot be inserted any more by being inserted until the aluminum core wire 401 comes into contact with a stage portion in a rear side in the long length direction X (a left side in FIG. 27) in the stepped diameter reduction portion 235, and can be inserted to an appropriate insertion position.

Figure 27C:
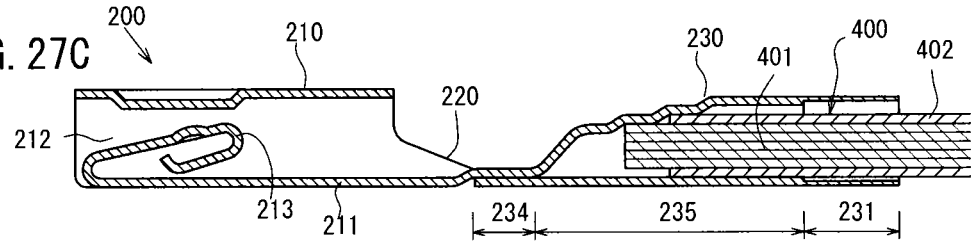

As shown in FIG. 27C, in the case of the insulated wire 400 having a medium diameter, the insulated wire can be inserted to a position where the insulated wire comes into contact with an intermediate stage portion in the long length direction X. In other words, the insulated wire can be inserted to a position which is closer to a front side in the long length direction X than the insulated wire 400 having the large diameter.

Figure 27D:
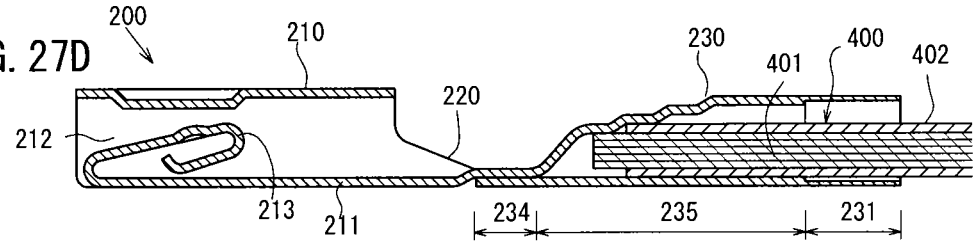
Figure 28A:
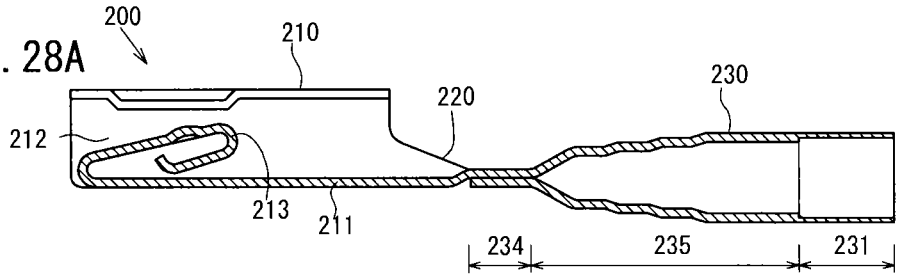
FIGS. 28A, 28B, 28C and 28D are explanatory views explaining further the other pressure-bonding section.
Figure 28B:
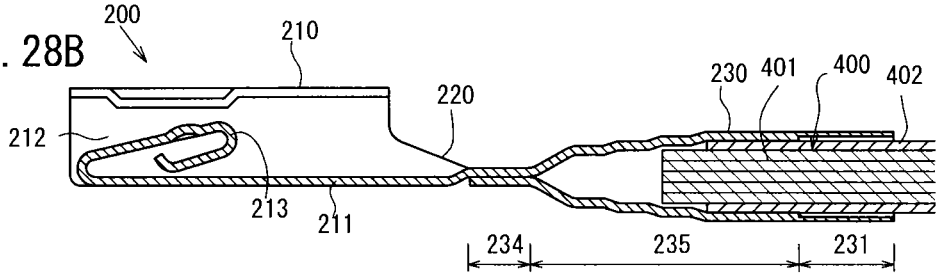
Figure 28C:
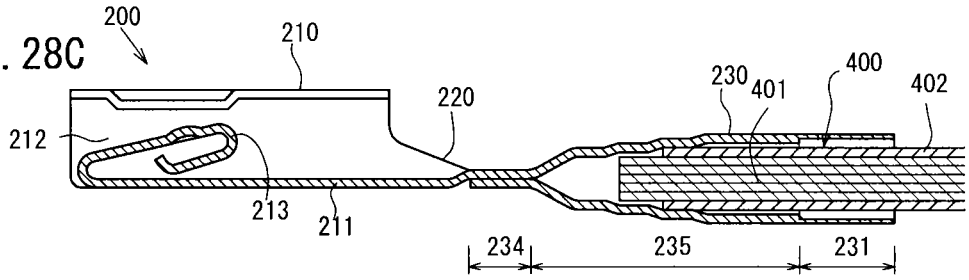
Figure 28D:
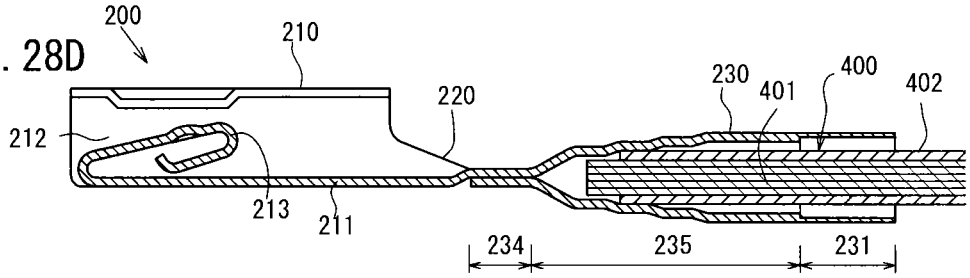

Further, as shown in FIG. 27D, in the case of the insulated wire 400 having a small diameter, the insulated wire can be inserted to a position where the insulated wire comes into contact with a stage portion in a front side in the long length direction (a right side in FIG. 27). In other words, it is possible to insert to the position which is further closer to the front side in the long length direction X than the insulated wire 400 having the medium diameter.

According to the manner mentioned above, the stepped diameter reduction portion 235 can be appropriately inserted to the stage portion in correspondence to the diameter of the insulated wire 400. Since each of the stage portions is diameter-reduced step by step from the rear side toward the front side in the long length direction X, that is, since the aluminum core wire 401 is pressure-bonded in each of the stage portions which are diameter-reduced in correspondence to the aluminum core wire 401 of the insulated wire 400 inserted to the stage portion, the pressure-bonding amount can be pressure-bonded with the same level of pressure-bonding amount regardless of the diameter of the aluminum core wire 401. Therefore, a problem such as a crack is not generated in the pressure-bonding section 30 due to the great pressure-bonding deformation, that is, the too great pressure-bonding amount for pressure-bonding the aluminum core wire 401 having the small diameter, and it is possible to securely pressure-bond with an appropriate pressure-bonding amount. In other words, the pressure-bonding connection structural body 1A can be constructed by securely pressure-bonding many kinds of insulated wires 400 by the stepped diameter reduction portion 235.

Furthermore, the stepped diameter reduction portion 235 in the description mentioned above has the smaller diameter than the weak pressure-bonding section 231 in the barrel portion 230 which is flat in a bottom surface portion, and is diameter-reduced step by step toward the front side in the long length direction X. However, as shown in FIG. 28 which is an explanatory view explaining further the other barrel portion 230, a whole periphery of the barrel portion 230 may be diameter-reduced, that is, centers of the respective stages which are diameter-reduced in the stepped diameter reduction portion 235 may be formed to be fixed along the long length direction X.

As mentioned above, in the case where the pressure-bonding connection structural body 1A is constructed by using the stepped diameter reduction portion 235 which is not flat in its bottom surface and is diameter-reduced in its whole periphery, and inserting and pressure-bonding the insulated wires 400 having the various diameters, it is possible to achieve the same effect as the stepped diameter reduction portion 235 in the barrel portion 230 which is flat in its bottom surface. Further, the stepped diameter reduction portion forms a guide for inserting the aluminum core wire 401 in the insulated wire 400 having the various diameters to a predetermined position, and it is possible to easily insert. Further, in comparison with the stepped diameter reduction portion 235 in the barrel portion 230 which is flat in its bottom surface, deviation of processing strain is reduced at the processing and manufacturing time of the crimp terminal 200, and it is possible to manufacture the durable crimp terminal 200. Further, since the pressure-bonding is carried out from all the peripheral directions, it is possible to reduce a load caused by the pressure-bonding deformation acting on the barrel portion 230.

Further, in the case of fixing the length in the long length direction X of the inclined step portion between the respective stage portions in the stepped diameter reduction portion 235, an angle of incline of the step portion can be formed more gently in comparison with the stepped diameter reduction portion 235 in the barrel portion 230 which is flat in its bottom surface. Therefore, it is possible to reduce the processing load. On the contrary, in the case where the step portion is formed with a fixed angle of incline, it is possible to form the length in the long length direction X of the step portion so as to be short.

The examples which are diameter-reduced in three stages are illustrated in FIGS. 27 and 28, but the number of the stages may be set to two stages or four or more stages.

DESCRIPTION OF REFERENCE SIGNS

10: Female crimp terminal
30: Pressure-bonding section
30*a:* Cover pressure-bonding section
30*b:* Conductor pressure-bonding section
30B: Sealing portion
30*s:* Rear side diameter reduction portion
30*t:* Front side diameter reduction portion
100: terminal base material
201*a:* Conductor tip
200: Insulated wire
201: Aluminum core wire
202: Insulating cover
W1: Weld portion in long length direction
W2: Weld portion in width direction
X: Long length direction
1A: Pressure-bonding connection structural body
200: Crimp terminal
230, 240, 250, 260, 270: Barrel portion
231, 241, 251, 261, 271: Weak pressure-bonding section
232, 242, 252, 262, 272: Cover pressure-bonding section
233: Core wire pressure-bonding section
234: Sealing portion
300: Crimp terminal
330, 340, 350, 360, 370, 380, 390: Barrel portion
331, 341, 351, 361, 371, 381, 391: Weak pressure-bonding section
332, 342, 352, 362, 372, 382, 392: Cover pressure-bonding section
333: Core wire pressure-bonding section
334: Sealing portion
400: Insulated wire
401: Aluminum core wire
402: Insulating cover
521: Female type connector
522: Female type connector housing
531: Male type connector
532: Male type connector housing
X: Long length direction

The invention claimed is:

1. A crimp terminal comprising:

a pressure-bonding section which allows pressure-bonding and connection of at least a conductor tip in an insulated wire obtained by coating a conductor with an insulating cover and having the conductor tip in which the conductor is exposed by peeling off the insulating cover in a tip side, wherein the pressure-bonding section is constructed by arranging a conductor pressure-bonding section, a diameter reduction portion and a cover pressure-bonding section from a tip side to a base end side in a long length direction in this order, the conductor pressure-bonding section pressure-bonding the conductor tip, and the cover pressure-bonding section pressure-bonding a conductor tip portion in the tip side of the insulating cover, wherein the cover pressure-bonding section is formed into a hollow shape which can surround the conductor tip portion, wherein the conductor pressure-bonding section is formed to have a smaller diameter than the cover pressure-bonding section, and is formed into a hollow shape which can surround the conductor tip, and wherein the pressure-bonding section is formed into a tubular shape by rounding a barrel piece in which the conductor pressure-bonding section and the cover pressure-bonding section are integrally formed via the diameter reduction portion and welding confronting end portions obtained by confronting both end portions in a width direction of the barrel piece, and is formed so that a barrel width is wider in the cover pressure-bonding section than in the conductor pressure-bonding section.

2. The crimp terminal according to claim 1, wherein a sealing portion sealing the tip side is formed in the tip side in the long length direction of the pressure-bonding section, and wherein the pressure-bonding section is formed into a continuous shape which is continuous in a whole of a peripheral direction from the cover pressure-bonding section toward the sealing portion.

3. The crimp terminal according to claim 1 wherein a first diameter reduction portion is formed in a boundary portion between the cover pressure-bonding section and the conductor pressure-bonding section, a diameter of the first diameter reduction portion being smaller little by little from the cover pressure-bonding section toward the conductor pressure-bonding section.

4. The crimp terminal according to claim 2, wherein a second diameter reduction portion is formed in a boundary portion between the conductor pressure-bonding section and the sealing portion, a diameter of the second diameter reduction portion being smaller little by little from the conductor pressure-bonding section toward the sealing portion.

5. The crimp terminal according to claim 1, wherein the pressure-bonding section constructed by the cover pressure-bonding section and the conductor pressure-bonding section is constructed by a stepped pressure-bonding section which is diameter-reduced step by step in its whole periphery.

6. The crimp terminal according to claim 1, wherein the pressure-bonding section is formed by a terminal base material which is formed by an expanded shape expanding the pressure-bonding section, and is formed into a hollow cross sectional shape obtained by rounding the terminal base material so as to set a long length direction to a center axis, wherein a diameter reduction portion is formed at least partially except a bottom surface portion in a peripheral direction, the diameter reduction portion diameter-reducing from a base end side toward a tip side in a boundary portion of each of the sealing portion, the conductor tip, and the conductor tip portion, and wherein a weld portion is formed in a bottom surface portion of the pressure-bonding section along a long length direction, the weld portion welding a pair of facing end portions facing to each other in the terminal base material.

7. The crimp terminal according to claim 1, wherein the conductor portion is constructed by an aluminum material, and at least the pressure-bonding section can be formed by a copper material.

8. A connection structural body connecting the insulated wire and the crimp terminal by the pressure-bonding section in the crimp terminal according to claim 1.

9. A wire hardness constructed by bundling a plurality of the connection structural bodies according to claim 8.

10. A connector in which the crimp terminal in the connection structural body according to claim 8 is arranged within a connector housing.

* * * * *